US009257071B2

(12) United States Patent
Kimura

(10) Patent No.: US 9,257,071 B2
(45) Date of Patent: Feb. 9, 2016

(54) SEMICONDUCTOR DEVICE AND METHOD FOR DRIVING SEMICONDUCTOR DEVICE

(71) Applicant: Semiconductor Energy Laboratory Co., Ltd., Kanagawa-ken (JP)

(72) Inventor: Hajime Kimura, Kanagawa (JP)

(73) Assignee: Semiconductor Energy Laboratory Co., Ltd. (JP)

( * ) Notice: Subject to any disclaimer, the term of this patent is extended or adjusted under 35 U.S.C. 154(b) by 201 days.

(21) Appl. No.: 13/906,830

(22) Filed: May 31, 2013

(65) Prior Publication Data

US 2013/0321249 A1 Dec. 5, 2013

(30) Foreign Application Priority Data

Jun. 1, 2012 (JP) ..... 2012-126376

(51) Int. Cl.
*G09G 3/32* (2006.01)

(52) U.S. Cl.
CPC ..... *G09G 3/3233* (2013.01); *G09G 2300/0819* (2013.01); *G09G 2300/0852* (2013.01); *G09G 2300/0861* (2013.01)

(58) Field of Classification Search
CPC ..... G09G 3/3233; G09G 2300/0861; G09G 2300/0852; G09G 2300/0819
USPC ..... 345/204, 76
See application file for complete search history.

(56) References Cited

U.S. PATENT DOCUMENTS 5,684,365 A 11/1997 Tang et al.
5,956,011 A 9/1999 Koyama et al.
6,037,924 A 3/2000 Koyama et al.
6,310,598 B1 10/2001 Koyama et al.
6,608,613 B2 8/2003 Koyama et al.
6,693,383 B2 2/2004 Bae et al.
6,737,813 B2 5/2004 Kawasaki et al.
6,839,057 B2 1/2005 Iguchi
6,928,136 B2 8/2005 Nagao et al.

(Continued)

FOREIGN PATENT DOCUMENTS

EP 1 459 126 B1 1/2007
JP 8-234683 9/1996

(Continued)

OTHER PUBLICATIONS

Kamiya, T. et al., "Carrier Transport Properties and Electronic Structures of Amorphous Oxide Semiconductors: The Present Status," Solid State Physics, vol. 44, No. 9, Sep. 1, 2009, pp. 621-633, Agne Gijutsu Center.

*Primary Examiner* — Christopher E Leiby
(74) *Attorney, Agent, or Firm* — Husch Blackwell LLP

(57) ABSTRACT

One electrode of SW1 is connected to a first wiring, and the other electrode of the SW1 is connected to one electrode of SW2, one electrode of second capacitor, and a gate electrode of a transistor. The other electrode of the SW2 is electrically connected to one electrode of SW3 and one electrode of first capacitor. The other electrode of the SW3 is connected to the other electrode of the second capacitor and one electrode of SW4. The other electrode of the SW4 is connected to a source electrode of the transistor and one electrode of SW5. The other electrode of the SW5 is connected to the other electrode of the first capacitor, an anode electrode of a load, and one electrode of SW6. The other electrode of the SW6 is connected to a fourth wiring. A drain electrode of the transistor is connected to a second wiring.

14 Claims, 43 Drawing Sheets

(56) References Cited

U.S. PATENT DOCUMENTS

| | | | | |
|---|---|---|---|---|
| 6,958,750 | B2 | 10/2005 | Azami et al. | |
| 6,975,142 | B2 | 12/2005 | Azami et al. | |
| 7,042,426 | B2 | 5/2006 | Shin | |
| 7,046,240 | B2 * | 5/2006 | Kimura | 345/212 |
| 7,068,076 | B2 | 6/2006 | Azami | |
| 7,129,917 | B2 | 10/2006 | Yamazaki et al. | |
| 7,133,012 | B2 | 11/2006 | Abe | |
| 7,151,278 | B2 | 12/2006 | Nagao et al. | |
| 7,173,590 | B2 * | 2/2007 | Uchino et al. | 345/92 |
| 7,317,429 | B2 | 1/2008 | Shirasaki et al. | |
| 7,327,357 | B2 | 2/2008 | Jeong | |
| 7,365,742 | B2 | 4/2008 | Kim et al. | |
| 7,382,342 | B2 | 6/2008 | Uchino et al. | |
| 7,429,985 | B2 | 9/2008 | Kimura et al. | |
| 7,443,367 | B2 | 10/2008 | Numao | |
| 7,456,810 | B2 | 11/2008 | Kimura | |
| 7,502,001 | B2 * | 3/2009 | Fish et al. | 345/81 |
| 7,532,209 | B2 | 5/2009 | Kimura | |
| 7,626,199 | B2 | 12/2009 | Kim | |
| 7,671,826 | B2 | 3/2010 | Kimura | |
| 7,674,650 | B2 | 3/2010 | Akimoto et al. | |
| 7,679,585 | B2 * | 3/2010 | Kimura | 345/76 |
| 7,714,813 | B2 * | 5/2010 | Uchino et al. | 345/77 |
| 7,714,815 | B2 | 5/2010 | Kim et al. | |
| 7,738,014 | B2 | 6/2010 | Kwak et al. | |
| 7,817,117 | B2 | 10/2010 | Kimura | |
| 7,893,895 | B2 * | 2/2011 | Uchino et al. | 345/78 |
| 7,944,416 | B2 * | 5/2011 | Ono et al. | 345/77 |
| 7,982,696 | B2 | 7/2011 | Kimura | |
| 7,986,287 | B2 | 7/2011 | Umezaki et al. | |
| 8,049,743 | B2 | 11/2011 | Kang | |
| 8,063,859 | B2 | 11/2011 | Kimura | |
| 8,164,547 | B2 | 4/2012 | Kimura | |
| 8,264,430 | B2 | 9/2012 | Kimura | |
| 8,305,306 | B2 | 11/2012 | Kimura | |
| 8,325,111 | B2 | 12/2012 | Kimura | |
| 8,665,254 | B2 * | 3/2014 | Chung et al. | 345/205 |
| 8,830,148 | B2 * | 9/2014 | Segawa et al. | 345/77 |
| 8,901,828 | B2 * | 12/2014 | Kimura | 315/169.3 |
| 8,922,464 | B2 * | 12/2014 | Inoue et al. | 345/76 |
| 9,013,457 | B2 * | 4/2015 | Kimura | 345/204 |
| 2003/0090481 | A1 | 5/2003 | Kimura | |
| 2003/0112208 | A1 * | 6/2003 | Okabe et al. | 345/82 |
| 2003/0117352 | A1 | 6/2003 | Kimura | |
| 2003/0132931 | A1 | 7/2003 | Kimura et al. | |
| 2003/0137503 | A1 | 7/2003 | Kimura et al. | |
| 2004/0041750 | A1 * | 3/2004 | Abe | 345/76 |
| 2004/0080474 | A1 | 4/2004 | Kimura | |
| 2004/0095305 | A1 | 5/2004 | Kimura et al. | |
| 2004/0174349 | A1 | 9/2004 | Libsch et al. | |
| 2004/0174354 | A1 * | 9/2004 | Ono et al. | 345/204 |
| 2004/0207614 | A1 * | 10/2004 | Yamashita et al. | 345/211 |
| 2005/0243079 | A1 * | 11/2005 | Ozaki | 345/204 |
| 2006/0082528 | A1 | 4/2006 | Guo et al. | |
| 2006/0109225 | A1 | 5/2006 | Haga et al. | |
| 2006/0170628 | A1 * | 8/2006 | Yamashita et al. | 345/76 |
| 2006/0231740 | A1 * | 10/2006 | Kasai | 250/214.1 |
| 2006/0290613 | A1 | 12/2006 | Hong et al. | |
| 2007/0091029 | A1 * | 4/2007 | Uchino et al. | 345/76 |
| 2007/0103419 | A1 | 5/2007 | Uchino et al. | |
| 2007/0120810 | A1 | 5/2007 | You et al. | |
| 2007/0126664 | A1 * | 6/2007 | Kimura | 345/76 |
| 2007/0126665 | A1 * | 6/2007 | Kimura | 345/76 |
| 2007/0132694 | A1 | 6/2007 | Uchino et al. | |
| 2007/0164962 | A1 | 7/2007 | Uchino et al. | |
| 2007/0200793 | A1 * | 8/2007 | Kwon | 345/39 |
| 2007/0236424 | A1 | 10/2007 | Kimura | |
| 2007/0279403 | A1 | 12/2007 | Uchino et al. | |
| 2008/0225061 | A1 * | 9/2008 | Kimura et al. | 345/690 |
| 2008/0278425 | A1 | 11/2008 | Koyama | |
| 2009/0009676 | A1 | 1/2009 | Kimura et al. | |
| 2009/0021536 | A1 * | 1/2009 | Abe et al. | 345/690 |
| 2009/0051674 | A1 | 2/2009 | Kimura et al. | |
| 2009/0140981 | A1 | 6/2009 | Kwak et al. | |
| 2010/0001983 | A1 * | 1/2010 | Abe | 345/211 |
| 2010/0149160 | A1 | 6/2010 | Kimura | |
| 2010/0220092 | A1 | 9/2010 | Kimura | |
| 2011/0024760 | A1 | 2/2011 | Kimura | |
| 2011/0199357 | A1 * | 8/2011 | Chung et al. | 345/211 |
| 2011/0205144 | A1 | 8/2011 | Kimura et al. | |
| 2011/0260170 | A1 | 10/2011 | Kimura | |
| 2012/0306843 | A1 * | 12/2012 | Wang et al. | 345/212 |
| 2012/0327142 | A1 | 12/2012 | Kimura | |
| 2013/0057174 | A1 | 3/2013 | Kimura | |
| 2013/0092963 | A1 | 4/2013 | Kimura | |

FOREIGN PATENT DOCUMENTS

| | | | |
|---|---|---|---|
| JP | 2003-195810 | A | 7/2003 |
| JP | 2004-280059 | A | 10/2004 |
| JP | 2004-295131 | A | 10/2004 |
| JP | 2005-189643 | A | 7/2005 |
| JP | 2005-195756 | A | 7/2005 |
| WO | WO 03/058328 | A1 | 7/2003 |

* cited by examiner

In

Sn

Zn

O

FIG. 20B
FIG. 20A
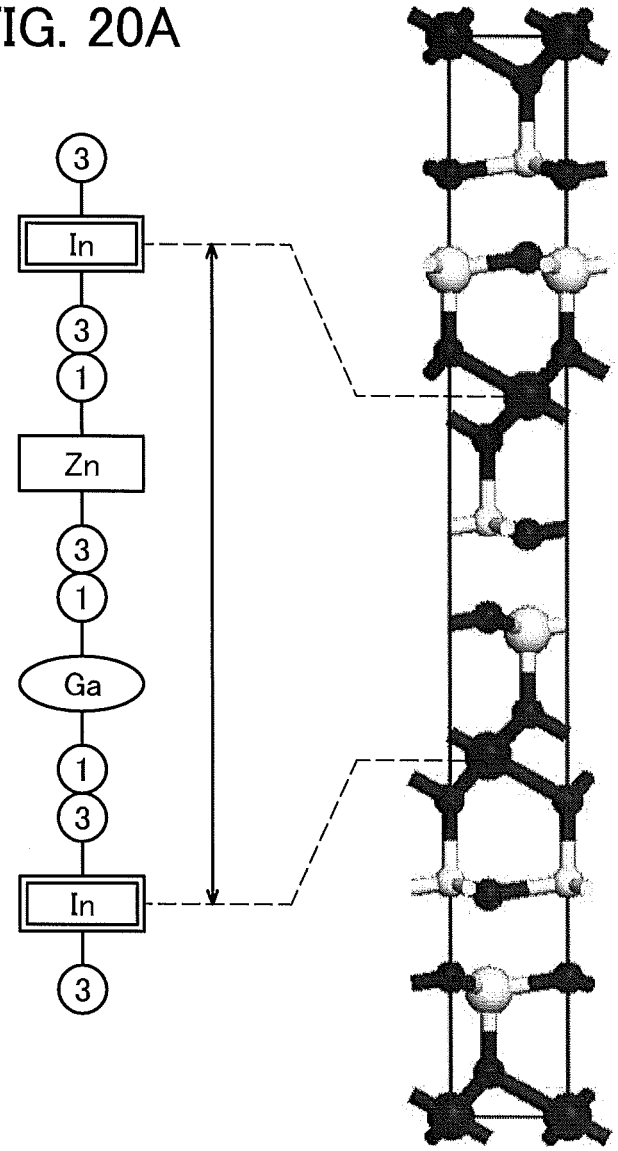
FIG. 20C
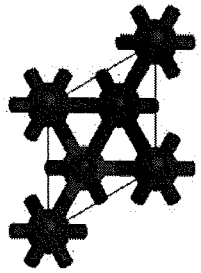
In
Ga
Zn
O

SEMICONDUCTOR DEVICE AND METHOD FOR DRIVING SEMICONDUCTOR DEVICE

BACKGROUND OF THE INVENTION

1. Field of the Invention

One embodiment of the present invention relates to a semiconductor device, a display device, a light-emitting device, a driving method thereof, or a manufacturing method thereof. In particular, one embodiment of the present invention relates to a semiconductor device, a display device, or a light-emitting device which has a function of supplying a current to a load. Further, in particular, one embodiment of the present invention relates to a semiconductor device, a display device, or a light-emitting device which has a function of controlling, with the use of a transistor, a current to be supplied to a load. Further, in particular, one embodiment of the present invention relates to a display device or a light-emitting device which includes a pixel including a display element whose luminance depends on a signal and a signal line driver circuit and a scan line driver circuit which drive the pixel, a driving method thereof, or a manufacturing method thereof. Further, one embodiment of the present invention relates to an electronic device having the display device in a display portion.

2. Description of the Related Art

In recent years, self-luminous display devices, light-emitting devices, and the like including light-emitting elements such as electroluminescence (EL) elements in pixels have attracted attention. As examples of such a light-emitting element used in such a self-luminous display device, an organic EL element and an inorganic EL element are known. These light-emitting elements emit light by themselves; thus the visibility of an image displayed by a display device including the organic EL element or the inorganic EL element is higher than that of an image displayed by a display device including a liquid crystal element. Further, the organic EL element and the inorganic EL element have advantages such as unnecessity of a backlight and high response speed. Note that the luminance of many of light-emitting elements is controlled by the value of current flowing to the light-emitting element.

In addition, active matrix display devices in which each pixel is provided with a transistor that controls light emission of a light-emitting element have been developed. The active matrix display devices have the following advantages, for example: high-definition display and large-screen display which are difficult to achieve in passive matrix display devices can be achieved and they can operate with less power consumption than passive matrix display devices.

FIG. 14 illustrates a configuration example of a pixel in a conventional active matrix display device (see Patent Document 1). The pixel in FIG. 14 includes a first transistor 11, a second transistor 12, a capacitor 13, and a light-emitting element 14. The first transistor 11 is connected to a signal line 15 and a scan line 16. A power supply potential Vdd is supplied to one of a source electrode and a drain electrode of the second transistor 12 and one electrode of the capacitor 13.

As another example, the configuration and the operation method of the pixel in FIG. 15 are suggested in Patent Document 2. The pixel in FIG. 15 includes a first transistor 21, a second transistor 22, a capacitor 23, and a light-emitting element 24, and the first transistor 21 is connected to a signal line 25 and a scan line 26. The second transistor 22 serving as a driver transistor is an n-channel transistor, a ground potential is supplied to one of a source electrode and a drain electrode of the second transistor 22, and Vca is supplied to a cathode of the light-emitting element 24.

FIG. 16 shows a timing chart for operating the pixel. In FIG. 16, one frame period is divided into an initialization period 31, a threshold voltage (Vth) writing period 32, a data writing period 33, and a light emission period 34. Note that one frame period corresponds to a period for displaying an image for one screen, and the initialization period, the threshold voltage (Vth) writing period, and the data writing period are collectively referred to as an address period.

Patent Document 3 discloses another example of a pixel.

REFERENCE

[Patent Document 1] Japanese Published Patent Application No. H8-234683

[Patent Document 2] Japanese Published Patent Application No. 2004-295131

[Patent Document 3] Japanese Published Patent Application No. 2004-280059

SUMMARY OF THE INVENTION

In view of the above, it is an object of one embodiment of the present invention to provide a semiconductor device, a light-emitting device, or a display device which displays high-quality images. It is another object of one embodiment of the present invention to provide a semiconductor device, a light-emitting device, or a display device which displays images with little unevenness. It is another object of one embodiment of the present invention to provide a semiconductor device, a light-emitting device, or a display device which is less influenced by variations in characteristics of transistors. It is another object of one embodiment of the present invention to provide a semiconductor device, a light-emitting device, or a display device that is less influenced by degradation of characteristics of a transistor. It is another object of one embodiment of the present invention to provide a semiconductor device, a light-emitting device, or a display device in which variations in luminance due to variations in threshold voltage of transistors are reduced. It is another object of one embodiment of the present invention to provide a semiconductor device, a light-emitting device, or a display device in which variations in luminance due to variations in mobility of transistors are reduced. It is another object of one embodiment of the present invention to provide a semiconductor device, a light-emitting device, or a display device which correctly operates even when using a normally-on transistor. It is another object of one embodiment of the present invention to provide a semiconductor device, a light-emitting device, or a display device in which the threshold voltage of a transistor can be obtained even when the transistor is a normally-on transistor. It is another object of one embodiment of the present invention to provide a display device with low power consumption. It is another object of one embodiment of the present invention to provide a pixel configuration, a semiconductor device, and a display device in which a luminance deviation from the level specified by a data potential is small. It is another object of one embodiment of the present invention to reduce variations in current value due to variations in threshold voltage of transistors. It is another object of one embodiment of the present invention to provide a semiconductor device, a light-emitting device, or a display device in which a desired circuit can be formed with a small number of transistors. It is another object of one embodiment of the present invention to provide a semiconductor device, a light-emitting device, or a display device in which a desired circuit can be formed with a small number of wirings. It is another object of one embodiment of the present invention to provide a semiconductor device, a light-emitting device, or a display device which is less influenced by degradation of a light-emitting element. It is another object of one embodiment of the present invention to provide a semiconductor device, a light-emitting device, or a display device which is manufactured through a small number of steps.

Note that the descriptions of these objects do not disturb the existence of any other object. Note that it is not necessary to achieve all the objects in one embodiment of the present invention. Other objects will be apparent from and can be derived from the descriptions of the specification, the drawings, the claims, and the like.

One embodiment of the present invention disclosed in this specification relates to a threshold correction pixel circuit in which a threshold voltage is added to a video signal (or a video signal is added to a threshold voltage).

One embodiment of the present invention disclosed in this specification is a semiconductor device including a first switch, a second switch, a third switch, a fourth switch, a fifth switch, a sixth switch, a first capacitor, a second capacitor, a transistor, and a load. One electrode of the first switch is electrically connected to a first wiring, and the other electrode of the first switch is electrically connected to one electrode of the second switch, one electrode of the second capacitor, and a gate electrode of the transistor. The other electrode of the second switch is electrically connected to one electrode of a third switch and one electrode of the first capacitor. The other electrode of the third switch is electrically connected to the other electrode of the second capacitor and one electrode of the fourth switch. The other electrode of the fourth switch is electrically connected to a source electrode of the transistor and one electrode of the fifth switch. The other electrode of the fifth switch is electrically connected to the other electrode of the first capacitor, a first terminal of the load, and one electrode of the sixth switch. The other electrode of the sixth switch is electrically connected to a fourth wiring. A second terminal of the load is electrically connected to a third wiring. A drain electrode of the transistor is electrically connected to a second wiring.

Another embodiment of the present invention disclosed in this specification is a semiconductor device including a first switch, a second switch, a third switch, a fourth switch, a fifth switch, a sixth switch, a first capacitor, a second capacitor, a transistor, and a load. One electrode of the first switch is electrically connected to a first wiring, and the other electrode of the first switch is electrically connected to one electrode of the second switch, one electrode of the second capacitor, and a gate electrode of the transistor. The other electrode of the second switch is electrically connected to one electrode of a third switch and one electrode of the first capacitor. The other electrode of the third switch is electrically connected to the other electrode of the second capacitor and one electrode of the fourth switch. The other electrode of the fourth switch is electrically connected to a source electrode of the transistor, an anode electrode of a light-emitting device, and one electrode of the fifth switch. The other electrode of the fifth switch is electrically connected to the other electrode of the first capacitor and one electrode of the sixth switch. The other electrode of the sixth switch is electrically connected to a fourth wiring. A first terminal of the load is electrically connected to a third wiring. A drain electrode of the transistor is electrically connected to a second wiring.

In the above configuration, the third wiring and the fourth wiring may be electrically connected to each other and may be at the same potential. That is to say, the third wiring and the fourth wiring may be the same wiring.

Further, the first wiring may have a function of supplying a video signal. The second wiring may have a function of supplying a first power supply voltage. The third wiring may have a function of supplying a cathode voltage. The fourth wiring may have a function of supplying a second power supply voltage.

The transistor may be an n-channel transistor. In a channel formation region of the transistor, an oxide semiconductor, amorphous silicon, microcrystalline silicon, polycrystalline silicon, or the like can be used.

Further, transistors can be used as the first to sixth switches.

Another embodiment of the present invention is a display device including the above semiconductor device and a light-emitting element. Another embodiment of the present invention is a display module including the above semiconductor device or the display device and a touch panel and/or an FPC. Another embodiment of the present invention is an electronic device including the display device or the display module and a control switch, an antenna, and/or a sensor.

Note that in drawings used in this specification, the sizes, the layer thicknesses, or regions are exaggerated for simplicity in some cases. Therefore, the sizes, the layer thicknesses, or regions in embodiments of the present invention are not limited to such scales.

Note that drawings are schematic views of ideal examples, and the shapes or the values are not limited to those illustrated in the drawings. For example, the following can be included: a variation in shape due to a manufacturing technique; a variation in shape due to an error; a variation in signal, voltage, or current due to noise; a variation in signal, voltage, or current due to a difference in timing; or the like.

Note that technical terms are in many cases used in order to describe a specific embodiment, example, or the like. However, one embodiment of the present invention should not be construed as being limited by the technical terms.

Note that terms which are not defined (including terms used for science and technology, such as technical terms or academic parlance) can be used as the terms which have meaning equal to general meaning that an ordinary person skilled in the art understands. It is preferable that terms defined by dictionaries or the like be construed as having meaning consistent with the background of related art.

According to one embodiment of the present invention, a variation in current value caused by a variation in threshold voltage of a transistor can be suppressed. Therefore, a desired current can be supplied to a load such as a light-emitting element. Particularly in the case of using a light-emitting element as a load, a display device with few variations in luminance and a high ratio of a light-emitting period to one frame period can be provided. Further, a display device in which a current can be supplied even to a light-emitting element which has deteriorated and a reduction in luminance of a display image due to the deterioration of the light-emitting element is small can be provided. According to another embodiment of the present invention, a semiconductor device, a light-emitting device, or a display device which displays high-quality images can be provided. According to another embodiment of the present invention, a semiconductor device, a light-emitting device, or a display device which displays images with little unevenness can be provided. According to another embodiment of the present invention, a semiconductor device, a light-emitting device, or a display device in which a desired circuit can be formed with a small number of transistors can be provided. According to another embodiment of the present invention, a semiconductor device, a light-emitting device, or a display device in which a desired circuit can be formed with a small number of wirings can be provided. According to another embodiment of the present invention, a semiconductor device, a light-emitting device, or a display device which is less influenced by degradation of a light-emitting element can be provided. According to another embodiment of the present invention, a semiconductor device, a light-emitting device, or a display device which is manufactured through a small number of steps can be provided.

BRIEF DESCRIPTION OF THE DRAWINGS

In the accompanying drawings:

FIGS. 20A to 20C illustrate an example of a semiconductor layer of one embodiment of the present invention;

DETAILED DESCRIPTION OF THE INVENTION

Figure 1:
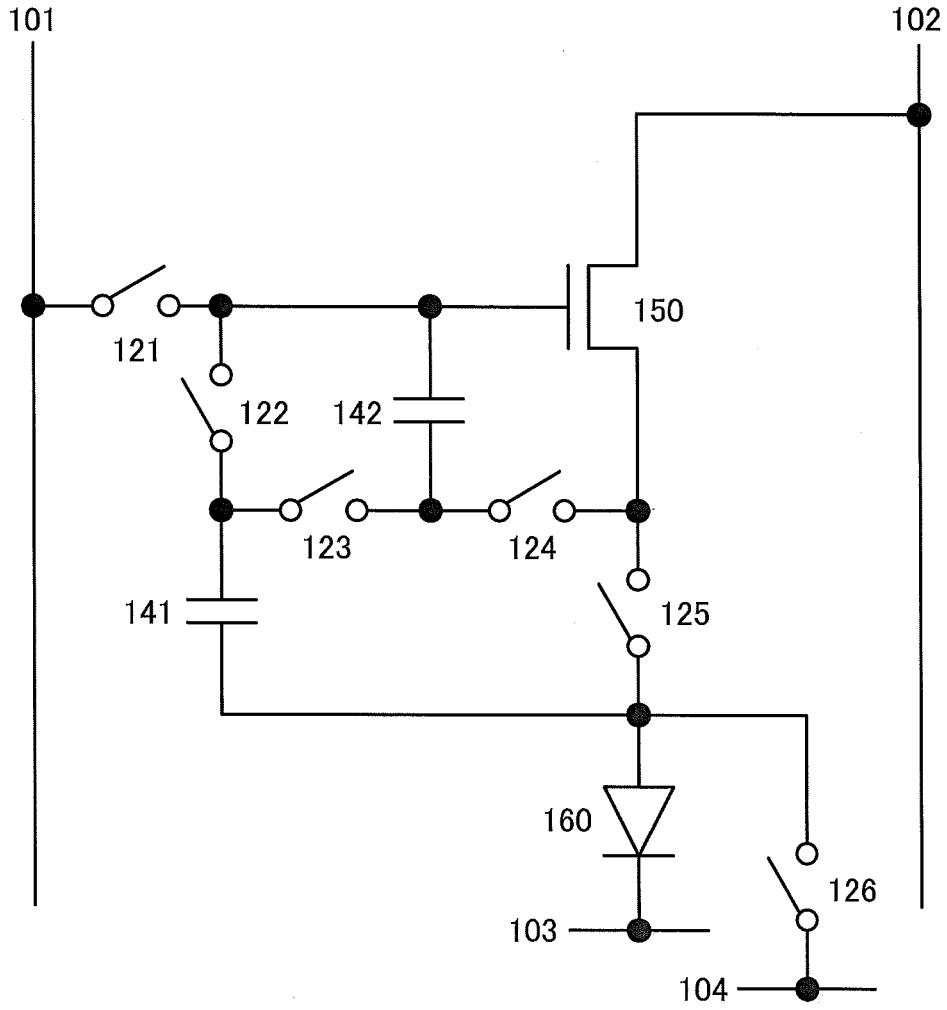
FIG. 1 illustrates a pixel circuit of one embodiment of the present invention.

Hereinafter, embodiments will be described with reference to the accompanying drawings. However, the embodiments can be implemented with various modes. It will be readily appreciated by those skilled in the art that modes and details can be changed in various ways without departing from the spirit and scope of the present invention. Accordingly, the present invention is not construed as being limited to the descriptions of the embodiments. Note that in structures of the invention described below, the same portions or portions having similar functions are denoted by common reference numerals, and the descriptions thereof are not repeated.

Note that what is described (or part thereof) in one embodiment can be applied to, combined with, or exchanged with another content in the same embodiment and/or what is described (or part thereof) in another embodiment or other embodiments.

Note that the structure of a diagram (or may be part of the diagram) illustrated in one embodiment can be combined with the structure of another part of the diagram, the structure of a different diagram (or may be part of the different diagram) illustrated in the embodiment, and/or the structure of a diagram (or may be part of the diagram) illustrated in one or more different embodiments.

Note that an explicit description "X and Y are connected" can mean that X and Y are electrically connected, that X and Y are functionally connected, and that X and Y are directly connected. Here, each of X and Y denotes an object (e.g., a device, an element, a circuit, a wiring, an electrode, a terminal, a conductive film, or a layer). Accordingly, a connection relation other than connection relations illustrated in drawings and texts is also included, without limitation to a predetermined connection relation, for example, the connection relations illustrated in the drawings and the text.

For example, in the case where X and Y are electrically connected, one or more elements which enable electrical connection between X and Y (e.g., a switch, a transistor, a capacitor, an inductor, a resistor, a diode, a display element, a light-emitting element, and/or a load) can be connected between X and Y. Note that a switch is controlled to be turned on or off. That is, the switch has a function of determining whether current flows or not by being turned on or off (being brought into an on state or an off state). Alternatively, the switch has a function of selecting and changing a current path.

For example, in the case where X and Y are functionally connected, one or more circuits which enable functional connection between X and Y (e.g., a logic circuit such as an inverter, a NAND circuit, or a NOR circuit; a signal converter circuit such as a DA converter circuit, an AD converter circuit, or a gamma correction circuit; a potential level converter circuit such as a power supply circuit (e.g., a step-up circuit or a step-down circuit) or a level shifter circuit for changing the potential level of a signal; a voltage source; a current source; a switching circuit; an amplifier circuit such as a circuit that can increase signal amplitude, the amount of current, or the like, an operational amplifier, a differential amplifier circuit, a source follower circuit, or a buffer circuit; a signal generation circuit; a memory circuit; and/or a control circuit) can be connected between X and Y. Note that, for example, in the case where a signal output from X is transmitted to Y even when another circuit is interposed between X and Y, X and Y are functionally connected.

Note that an explicit description "X and Y are connected" can mean that X and Y are electrically connected, that X and Y are functionally connected, and that X and Y are directly connected. That is, when it is explicitly described that "X and Y are electrically connected", the description is the same as the case where it is explicitly and simply described that "X and Y are connected".

Note that even when independent components are electrically connected to each other in a circuit diagram, there is a case where one conductive layer has functions of a plurality of components (e.g., a wiring and an electrode), such as a case where part of a wiring also functions as an electrode. The "electrical connection" in this specification can also means that one conductive layer has functions of a plurality of components.

Note that it might be possible for those skilled in the art to constract one embodiment of the invention even when all the portions to which terminals of an active element (e.g., a transistor or a diode), a passive element (e.g., a capacitor or a resistive element), or the like are connected are not specified. Particularly in the case where the number of portions to which a terminal is connected might be plural, it is not necessary to specify the portions to which the terminal is connected. Therefore, it might be possible to construct one embodiment of the invention by specifying only portions to which some of terminals of an active element (e.g., a transistor or a diode), a passive element (e.g., a capacitor or a resistive element), or the like are connected.

Note that it might be possible for those skilled in the art to identify the invention when at least connection in a circuit is specified. Further, it might be possible for those skilled in the art to identify the invention when at least a function of a circuit is specified. Therefore, when connection in a circuit is specified, the circuit is disclosed as one embodiment of the invention even when a function is not specified, and one embodiment of the invention can be constituted. Alternatively, when a function of a circuit is specified, the circuit is disclosed as one embodiment of the invention even when the connection is not specified, and one embodiment of the invention can be constituted.

Note that the invention excluding a content that is not specified in the drawings and texts in this specification can be constructed. When the numerical range of a value defined by the maximum value and the minimum value is described, by appropriately narrowing the range or appropriately excluding a value in the range, the invention excluding part of the range can be constructed. In this way, the technical scope of the present invention does not include a conventional technology, for example.

As a specific example, a case where a circuit including first to fifth transistors is illustrated in a circuit diagram is considered. In that case, the invention in which the circuit does not include a sixth transistor can be constructed. The invention in which the circuit does not include a capacitor can be constructed. The invention in which the circuit does not include a sixth transistor with a particular connection structure can be constructed. The invention in which the circuit does not include a capacitor with a particular connection structure can be constructed. For example, the invention in which a sixth transistor whose gate is connected to a gate of the third transistor is not included can be constructed. Further, the invention in which a capacitor whose first electrode is connected to the gate of the third transistor is not included can be constructed.

As another specific example, a case in which a description of a value, "a voltage is preferably higher than or equal to 3 V and lower than or equal to 10 V" is provided is considered. In that case, for example, the case where the voltage is higher than or equal to −2 V and lower than or equal to 1 V can be excluded from the invention. Further, the case where the voltage is higher than or equal to 13 V can be excluded from the invention. Note that, for example, the voltage may be higher than or equal to 5 V and lower than or equal to 8 V in the invention. Note that, for example, the voltage may be approximately 9 V in the invention. Note that, for example, the voltage may be higher than or equal to 3 V and lower than or equal to 10 V and may exclude 9 V in the invention.

As another specific example, a case in which a description "a voltage is preferably 10 V" is provided is considered. In that case, for example, the case where the voltage is higher than or equal to −2 V and lower than or equal to 1 V can be excluded from the invention. Further, the case where the voltage is higher than or equal to 13 V can be excluded from the invention.

As still another specific example, a case in which a description "a film is an insulating film" is provided is considered. In that case, for example, the case where the insulating film is an organic insulating film can be excluded from the invention. Further, the case where the insulating film is an inorganic insulating film can be excluded from the invention.

As another specific example, a case in which a description of a stacked structure, "a film is provided between A and B" is provided is considered. In that case, for example, the case where the film is a stacked film of four or more layers can be excluded from the invention. Further, for example, the case where a conductive film is provided between A and the film can be excluded from the invention.

Embodiment 1

One embodiment of the present invention can be used not only as a pixel including a light-emitting element but also as a variety of circuits. For example, one embodiment of the present invention can be used as an analog circuit or a circuit functioning as a current source. In this embodiment, the structure and the operation method of a pixel in a semiconductor device of one embodiment of the present invention will be described as an example.

FIG. 1 is a circuit diagram illustrating a configuration example of a pixel in a semiconductor device of one embodiment of the present invention. The pixel includes a wiring 101, a wiring 102, a wiring 103, a wiring 104, a switch 121, a switch 122, a switch 123, a switch 124, a switch 125, a switch 126, a capacitor 141, a capacitor 142, a transistor 150, and a light-emitting element 160.

The wiring 101 has a function of supplying or transmitting a video signal. As an example, Vsig is a video signal and/or an analog signal. However, one embodiment of the present invention is not limited thereto; Vsig may be a constant potential. Alternatively, the wiring 101 has a function of supplying or transmitting a precharge signal. The wiring 101 has a function of supplying or transmitting a voltage V1.

The wiring 102 has a function of supplying or transmitting a power supply voltage. Alternatively, the wiring 102 has a function of supplying or transmitting a reverse bias voltage. Note that the potential of the wiring 102 is preferably constant; however, one embodiment of the present invention is not limited thereto; the potential of the wiring 102 may vary like a pulse signal. For example, the potential of the wiring 102 may be a potential at which not only forward bias voltage but also a reverse bias voltage is applied to a load. Alternatively, the wiring 102 has a function of supplying a current to the transistor 150. Alternatively, the wiring 102 has a function of supplying a current to a load and the light-emitting element. Alternatively, the wiring 102 functions as a power supply line. Alternatively, the wiring 102 functions as a current supply line.

The wiring 103 has a function of supplying or transmitting a cathode voltage. Alternatively, the wiring 103 has a function of supplying or transmitting an initialization voltage. Alternatively, the wiring 103 has a function of supplying or transmitting an H signal or an L signal. Note that the potential of the wiring 103 is preferably constant; however, one embodiment of the present invention is not limited thereto; the potential of the wiring 103 may vary like a pulse signal.

The wiring 104 has a function of supplying or transmitting a power supply voltage. In the case where the transistor 150 is an n-channel transistor, the wiring 104 can have a lower potential than the wiring 102, whereas in the case where the transistor 150 is a p-channel transistor, the wiring 104 can have a higher potential than the wiring 102. Note that the potential of the wiring 104 is preferably constant; however, one embodiment of the present invention is not limited thereto; the potential of the wiring 104 may vary like a pulse signal.

Figure 28:
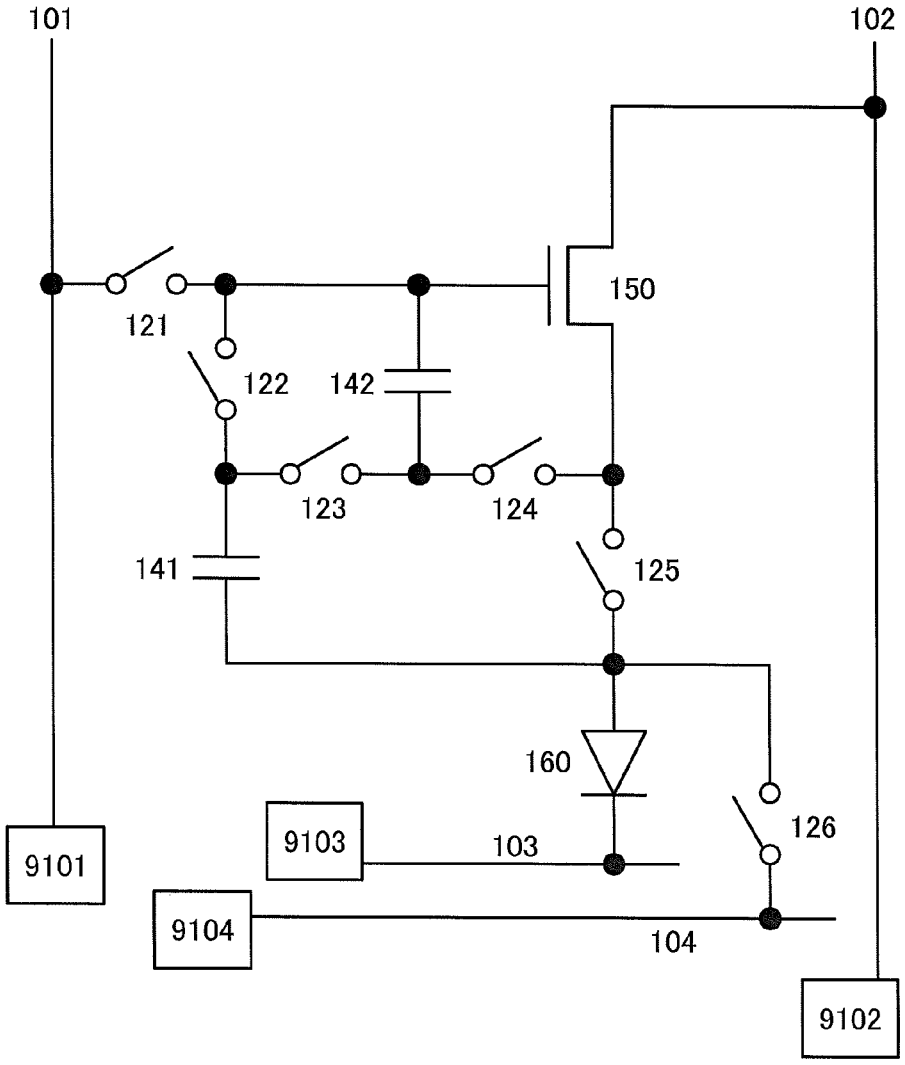
FIG. 28 illustrates a pixel circuit of one embodiment of the present invention.

Note that the wiring 101, the wiring 102, the wiring 103, and the wiring 104 may be connected to a circuit 9101, a circuit 9102, a circuit 9103, and a circuit 9104, respectively, as in FIG. 28.

Here, the circuit 9101, the circuit 9102, the circuit 9103, and the circuit 9104 each have a function of supplying a signal or a constant voltage. Note that the circuit 9101, the circuit 9102, the circuit 9103, and the circuit 9104 may have the same configuration or different configurations. Examples of the circuit 9101, the circuit 9102, the circuit 9103, and the circuit 9104 are a power supply circuit, a pulse output circuit, and a gate driver circuit.

The transistor 150 functions as at least a current source, for example. Thus, for example, the transistor 150 has a function of supplying a substantially constant current even when the level of a voltage across (between a source and a drain of) the transistor 150 is changed. Alternatively, for example, the transistor 150 has a function of supplying a substantially constant current to the light-emitting element 160 even when the potential of the light-emitting element 160 is changed. Alternatively, for example, the transistor 150 has a function of supplying a substantially constant current even when the potential of the wiring 102 is changed.

Note that one embodiment of the present invention is not limited thereto; the transistor 150 does not necessarily function as a current source. For example, the transistor 150 may function as a switch.

Note that there is a voltage source as a power source other than a current source. The voltage source has a function of supplying a constant voltage even when a current flowing through a circuit connected to the voltage source is changed. Accordingly, the voltage source and the current source each have a function of supplying a voltage or a current. However, the function of the voltage source and the function of the current source are different in what is supplied at a constant level even when one factor is changed. The current source has a function of supplying a constant current even when a voltage between both ends is changed. The voltage source has a function of supplying a constant voltage even when a current is changed.

Note that the capacitance of the capacitor 141 and/or the capacitor 142 is preferably higher than the parasitic capacitance of a gate of the transistor 150, more preferably 2 or more times the parasitic capacitance of the gate of the transistor 150, still more preferably 5 or more times the parasitic capacitance of the gate of the transistor 150. Alternatively, the area of electrodes of the capacitor 141 and/or the capacitor 142 is preferably larger than the area of a channel of the transistor 150, more preferably 2 or more times the area of the channel of the transistor 150, still more preferably 5 or more times the area of the channel of the transistor 150. Alternatively, the area of the electrodes of the capacitor 141 and/or the capacitor 142 is preferably larger than the area of the gate electrode of the transistor 150, more preferably 2 or more times the area of the gate electrode of the transistor 150, still more preferably 5 or more times the area of the gate electrode of the transistor 150. Accordingly, when the potential Vsig is input and a voltage is divided by the gate capacitance of the transistor and the capacitor 141 and/or the capacitor 142, a decrease in voltage of the capacitor 141 and/or the capacitor 142 can be reduced. Note that one embodiment of the present invention is not limited thereto.

Note that the capacitance of the capacitor 142 is preferably higher than or equal to the capacitance of the capacitor 141. The capacitance of the capacitor 142 is preferably different from the capacitance of the capacitor 141 by ±20% or lower, more preferably ±10% or lower of the capacitance of the capacitor 141. Further, the area of the electrodes of the capacitor 142 is preferably larger than or equal to the area of the electrodes of the capacitor 141. Under such conditions, optimum operation is possible without any change in the layout area. Note that one embodiment of the present invention is not limited thereto.

One electrode of the switch 121 is connected to the wiring 101. The other electrode of the switch 121 is connected to one electrode of the switch 122, one electrode of the capacitor 142, and the gate electrode of the transistor 150. The other electrode of the switch 122 is connected to one electrode of the switch 123 and one electrode of the capacitor 141. The other electrode of the switch 123 is connected to the other electrode of the capacitor 142 and one electrode of the switch 124. The other electrode of the switch 124 is connected to the source electrode of the transistor 150 and one electrode of the switch 125. The other electrode of the switch 125 is connected to the other electrode of the capacitor 141, an anode electrode of the light-emitting element 160, and one electrode of the switch 126. The other electrode of the switch 126 is connected to the wiring 104. A cathode electrode of the light-emitting element 160 is connected to the wiring 103. The drain electrode of the transistor 150 is connected to the wiring 102.

Figure 8:
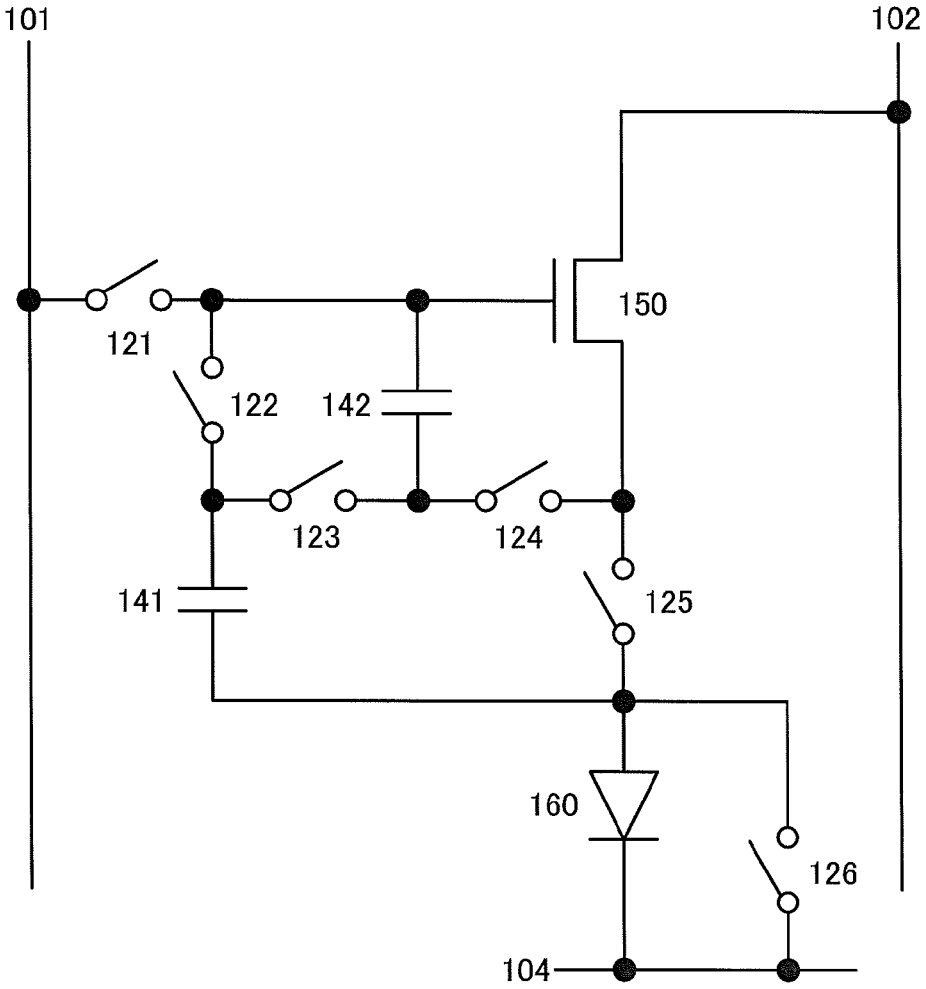
FIG. 8 illustrates a pixel circuit of one embodiment of the present invention.

Note that the wiring 104 in the circuit configuration in FIG. 1 may double as the wiring 103 as in FIG. 8, in which case the number of wirings can be reduced.

Note that FIG. 1 and the like each illustrate an example of a circuit configuration; thus, a transistor can be provided additionally. In each node in FIG. 1 and the like, it is also possible that an additional transistor, switch, passive element, or the like is not provided. For example, it is possible that the number of transistors directly connected to nodes is not increased. Thus, for example, it is possible to directly connect only the transistor 150 to a node and not to directly connect another transistor to the node.

In this embodiment, the gate-source voltage of the transistor is Vgs, the drain-source voltage of the transistor is Vds, the threshold voltage of the transistor is Vth, and voltages accumulated in the capacitor 141 and the capacitor 142 are Vc1 and Vc2, respectively. The transistor 150 is, for example, an n-channel transistor and is turned on when the Vgs of the transistor 150 is higher than Vth. Note that the transistor may be either an enhancement (normally-off) transistor or a depletion (normally-on) transistor. Thus, the transistor may be an n-channel transistor whose Vth is a negative value.

Figure 17:
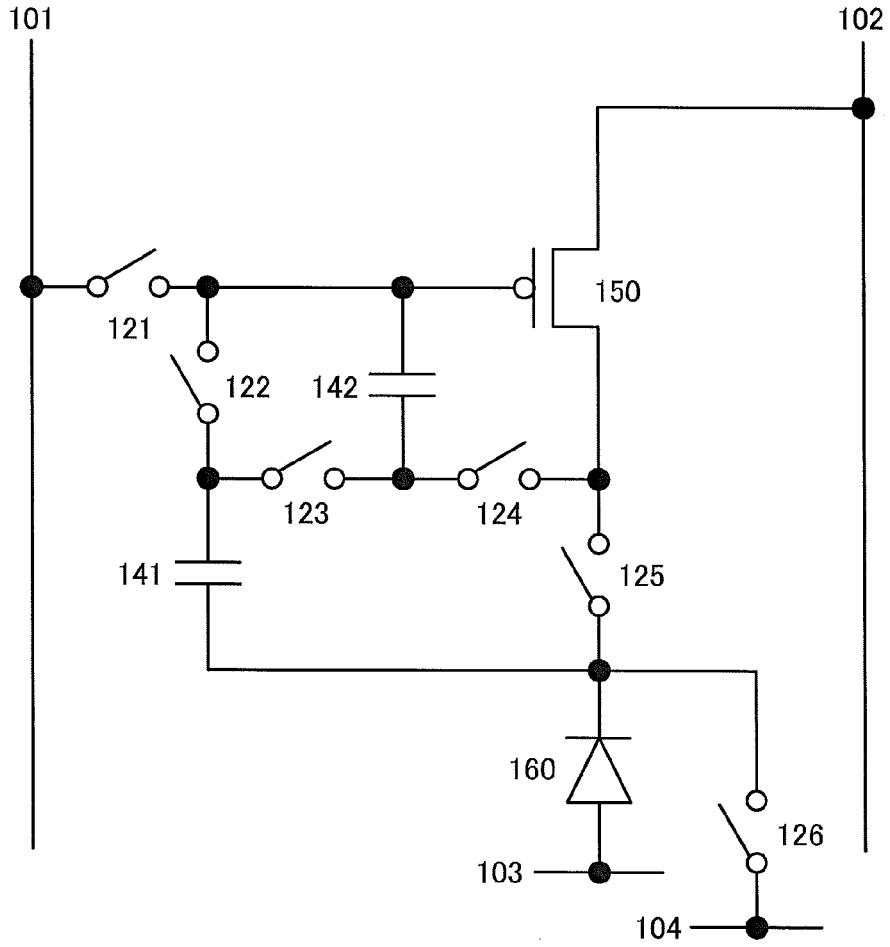
FIG. 17 illustrates a pixel circuit of one embodiment of the present invention.

Note that a p-channel transistor may be used as the transistor, in which case for example, the potential of each wiring is changed and an anode and a cathode of the light-emitting element 160 are interchanged. FIG. 17 illustrates an example of the circuit in FIG. 1 in which the transistor 150 is a p-channel transistor.

The anode electrode and the cathode electrode of the light-emitting element 160 can also be referred to as a pixel electrode and a counter electrode, respectively. Note that in the case where the transistor 150 is a p-channel transistor, the anode electrode and the cathode electrode of the light-emitting element 160 may be a counter electrode and a pixel electrode, respectively. Note that the minimum potential difference needed for the light-emitting element 160 to emit light is Velth.

Figure 29:
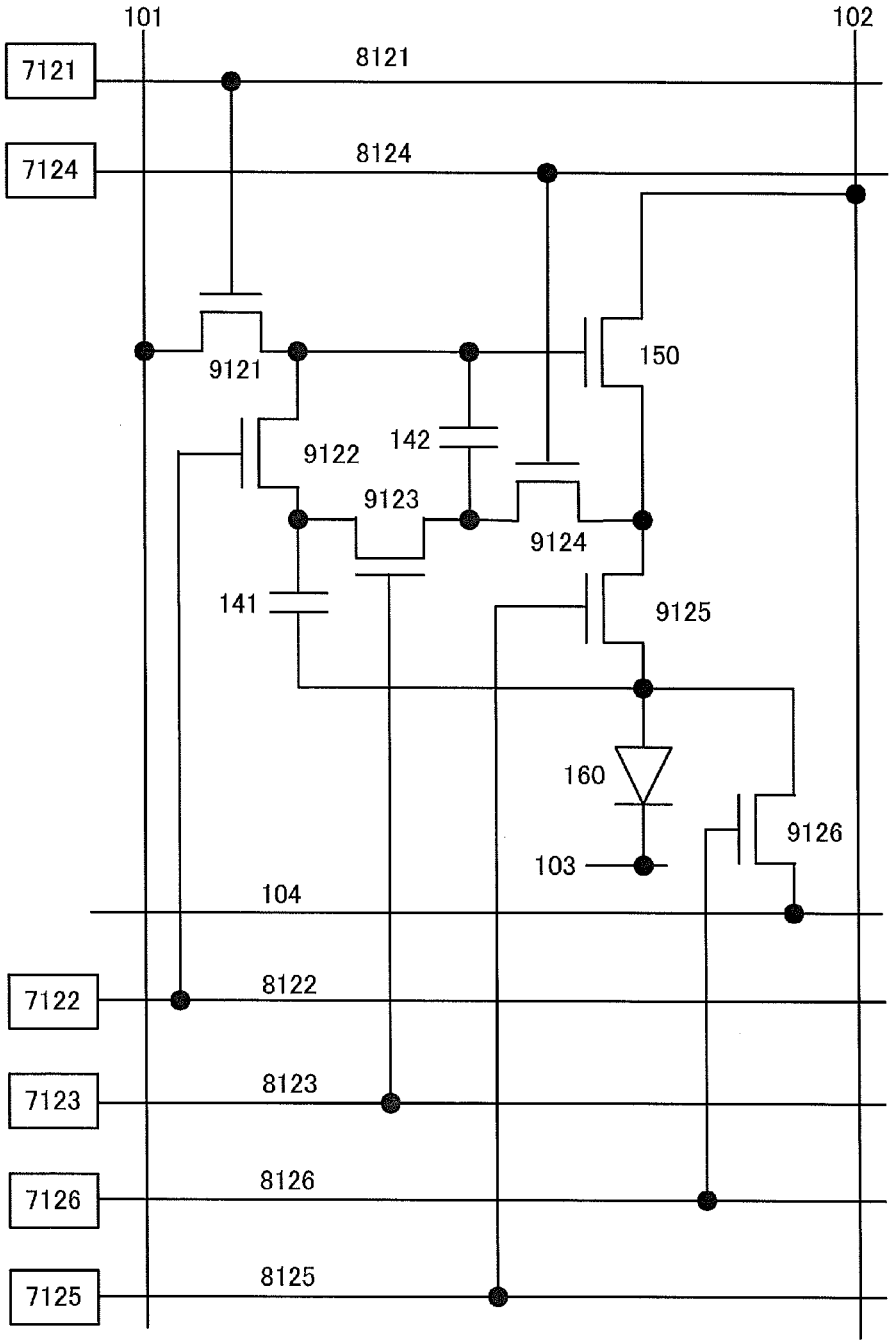
FIG. 29 illustrates a pixel circuit of one embodiment of the present invention.

The switch 121, the switch 122, the switch 123, the switch 124, the switch 125, and the switch 126 are controlled to be turned on and off by a signal input from a control line (not illustrated) such as a scan line connected thereto. For example, transistors can be used as the switches, and scan lines connected to the transistors can be combined depending on the timing of operation. FIG. 29 is a circuit diagram illustrating the case of using a transistor 9121, a transistor 9122, a transistor 9123, a transistor 9124, a transistor 9125, and a transistor 9126. Gates of the transistor 9121, the transistor 9122, the transistor 9123, the transistor 9124, the transistor 9125, and the transistor 9126 are connected to a wiring 8121, a wiring 8122, a wiring 8123, a wiring 8124, a wiring 8125, and a wiring 8126, respectively. The wiring 8121, the wiring 8122, the wiring 8123, the wiring 8124, the wiring 8125, and the wiring 8126 are connected to a circuit 7121, a circuit 7122, a circuit 7123, a circuit 7124, a circuit 7125, and a circuit 7126 each having a function of supplying a pulse signal, respectively. Note that transistors can be used in circuits in circuit diagrams other than FIG. 1 as in FIG. 29. By changing the conductivity type of the transistors, a scan line may be shared by more transistors so that one wiring functions as a plurality of wirings, in which case the number of the wirings can be reduced.

Figure 38:
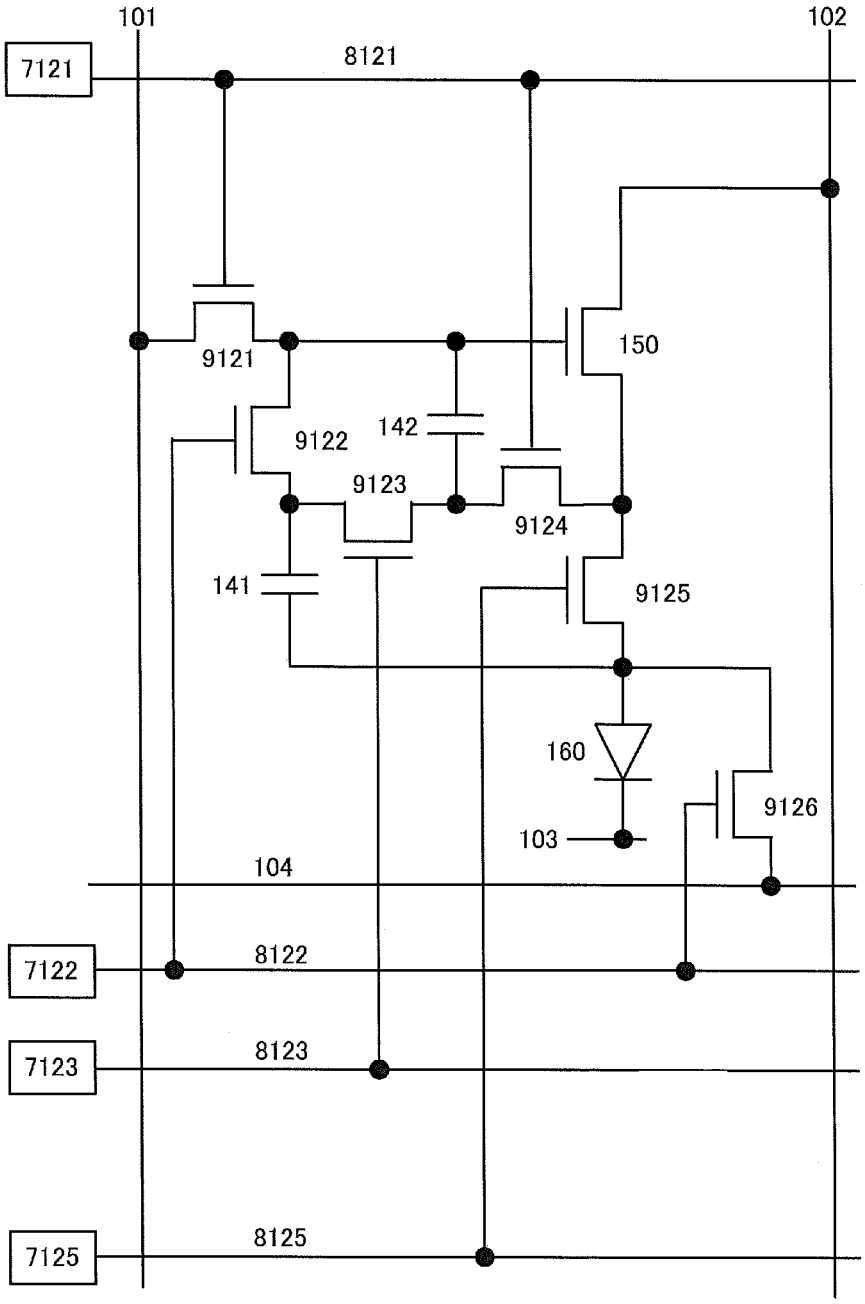
FIG. 38 illustrates a pixel circuit of one embodiment of the present invention.
Figure 39:
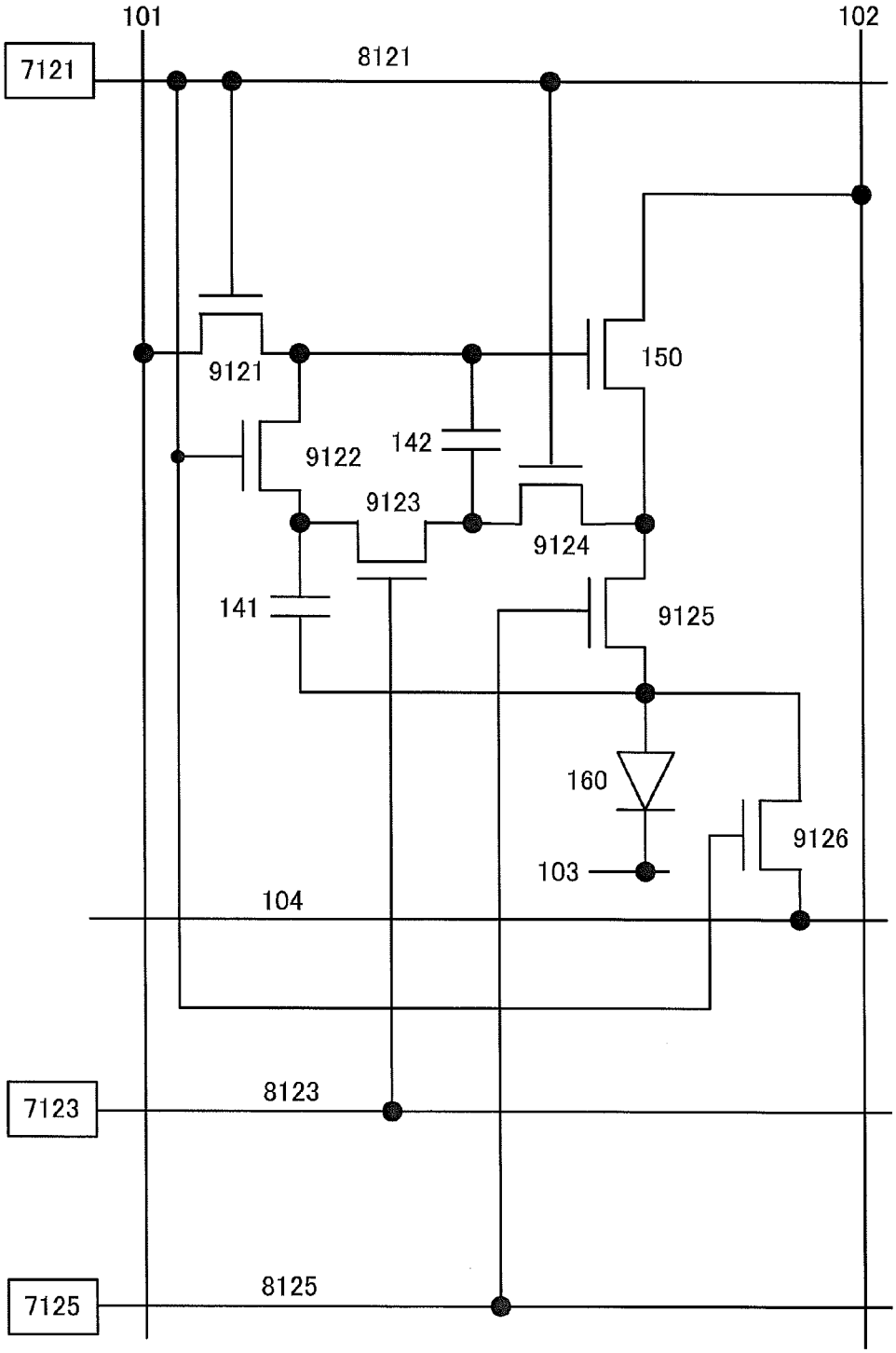
FIG. 39 illustrates a pixel circuit of one embodiment of the present invention.
Figure 40:
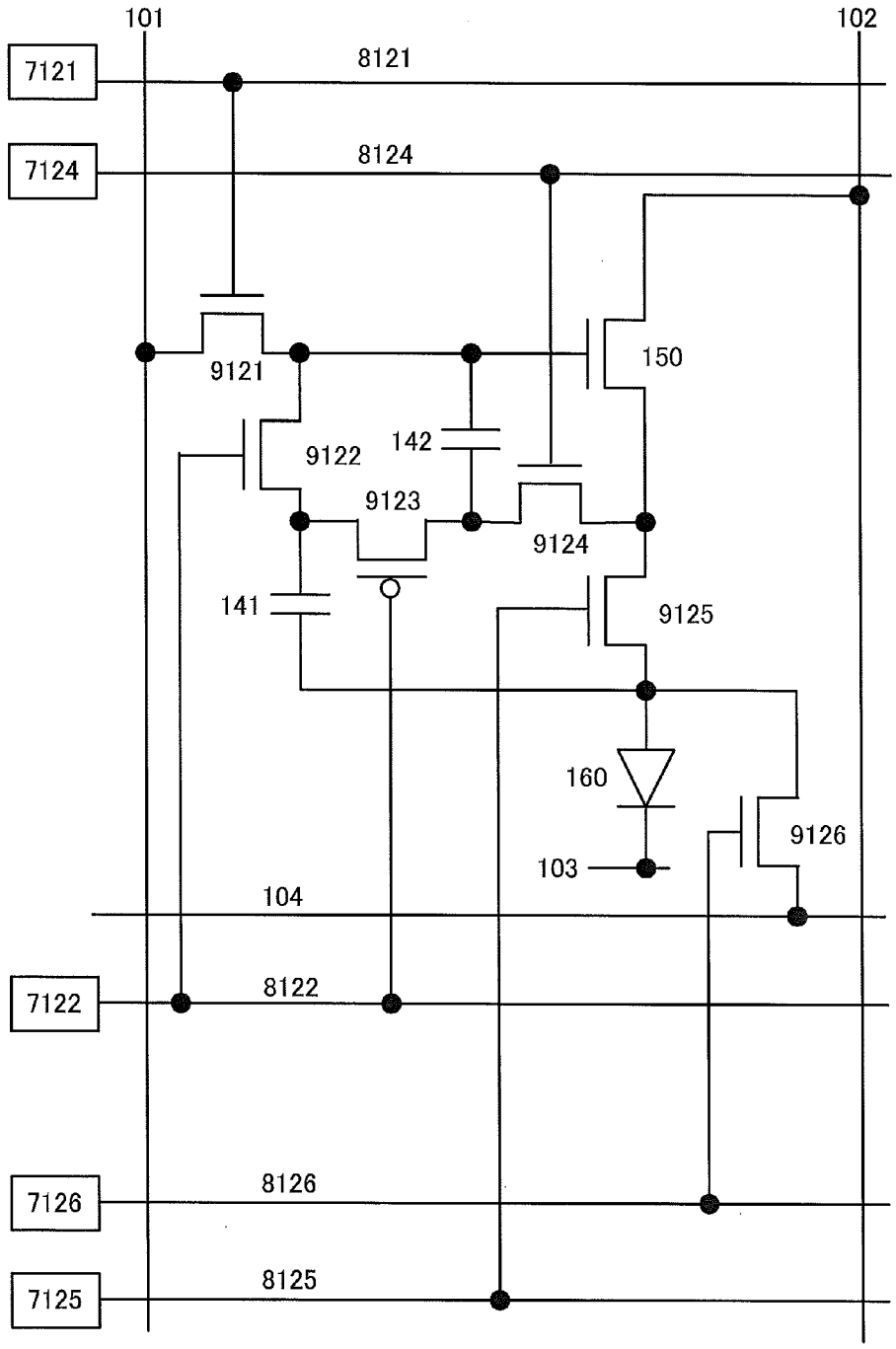
FIG. 40 illustrates a pixel circuit of one embodiment of the present invention.
Figure 41:
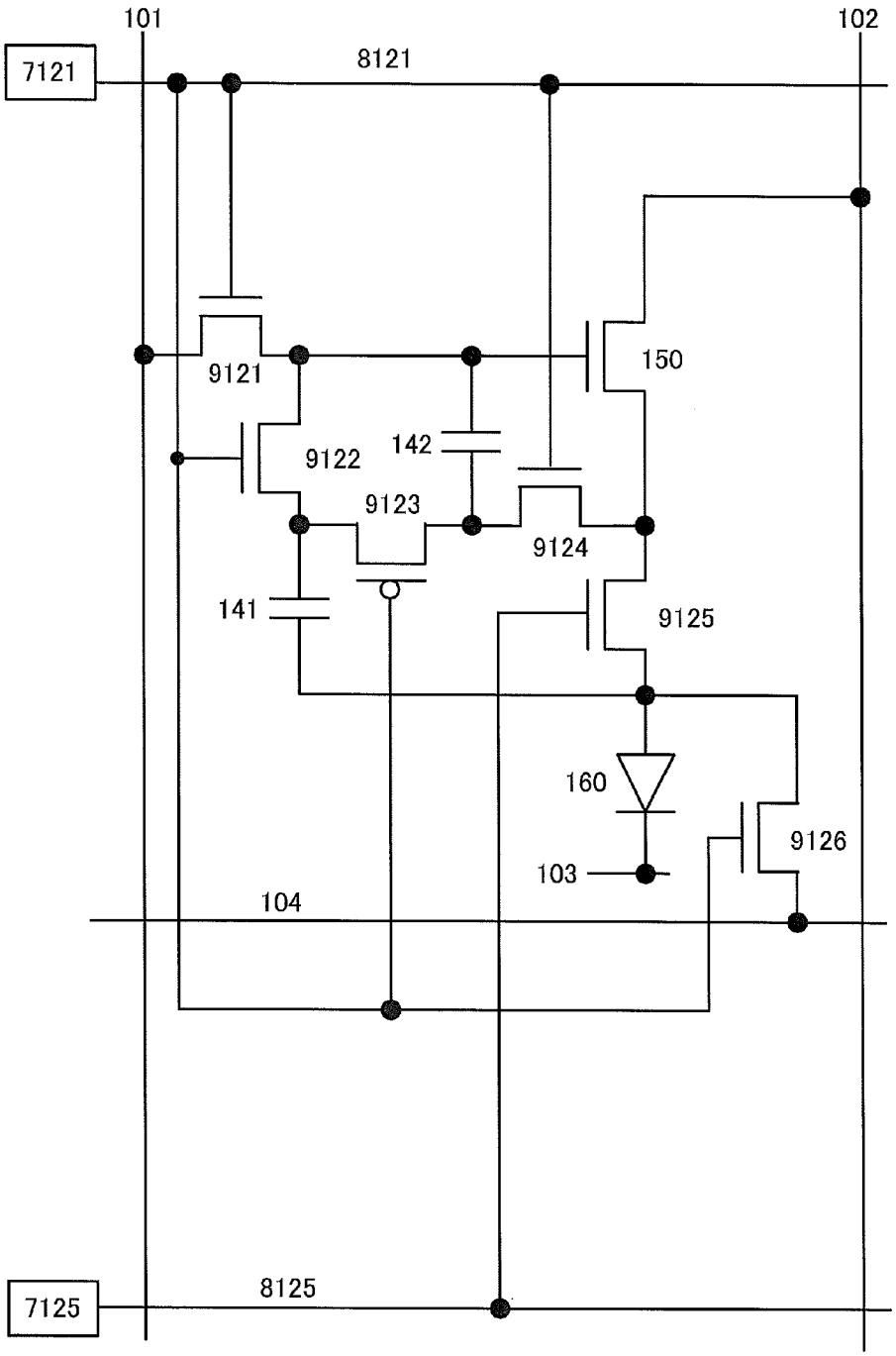
FIG. 41 illustrates a pixel circuit of one embodiment of the present invention.

For example, an example of the case where some of the wirings in FIG. 29 are combined into one wiring will be described. FIG. 38 illustrates the case where the wiring 8121 doubles as the wiring 8124 and the wiring 8122 doubles as the wiring 8126. FIG. 39 illustrates the case where the wiring 8121 doubles as the wiring 8124 and the wiring 8122 in FIG. 38. That is to say, the wiring 8121, the wiring 8122, the wiring 8124, and the wiring 8126 in FIG. 29 can be combined into one wiring, or the wiring 8121 and the wiring 8124 in FIG. 29 can be combined into one wiring and the wiring 8122 and the wiring 8126 in FIG. 29 can be combined into one wiring. Alternatively, when the conductivity type of the transistor 9123 is different from those of other transistors, the wiring 8122 can double as at least one of the wiring 8121, the wiring 8123, and the wiring 8126. FIG. 40 illustrates the case where the wiring 8122 doubles as the wiring 8123. FIG. 41 illustrates the case where FIG. 39 and FIG. 40 are combined so that wirings are combined.

Figure 42:
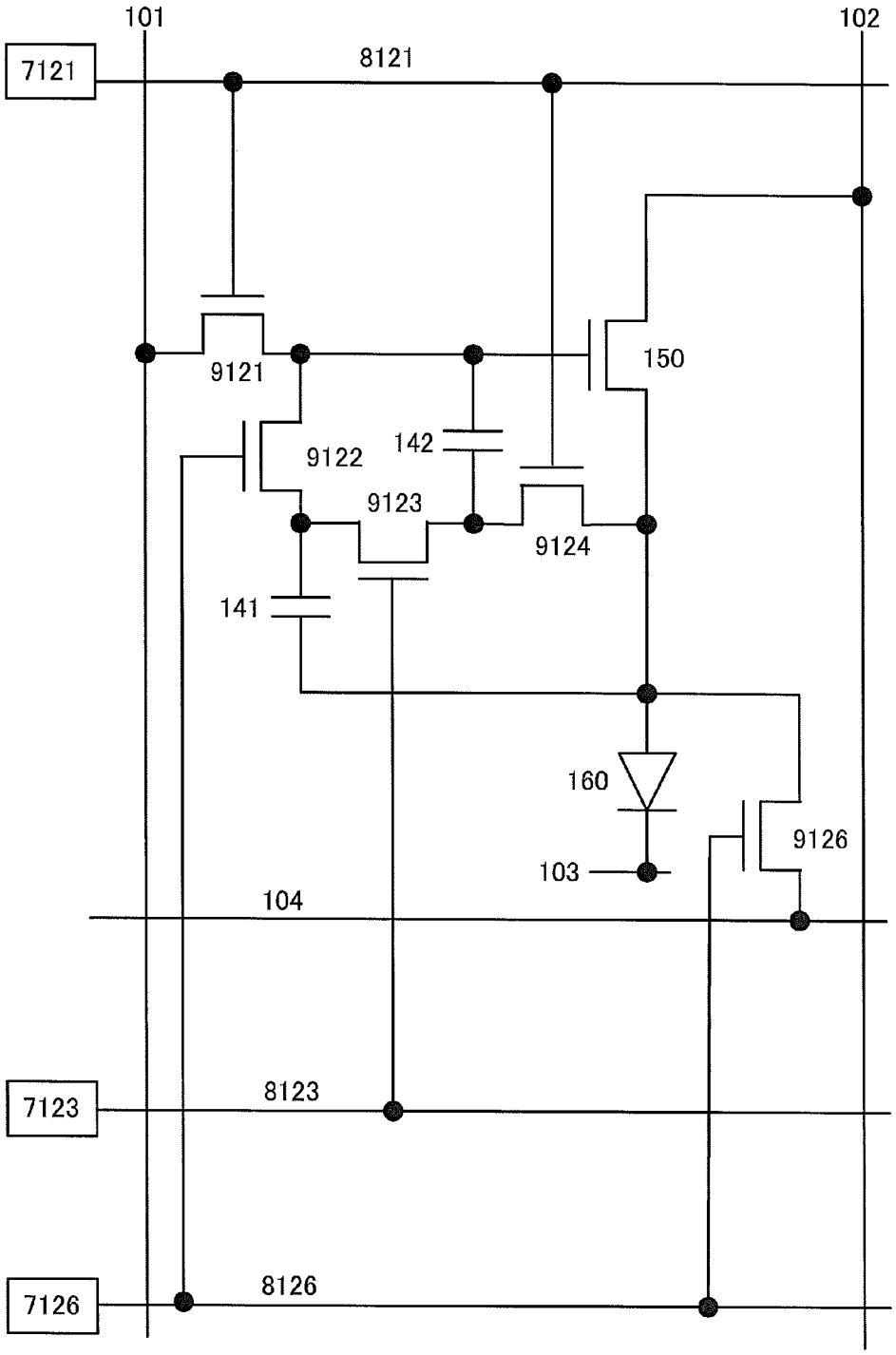
FIG. 42 illustrates a pixel circuit of one embodiment of the present invention.
Figure 43:
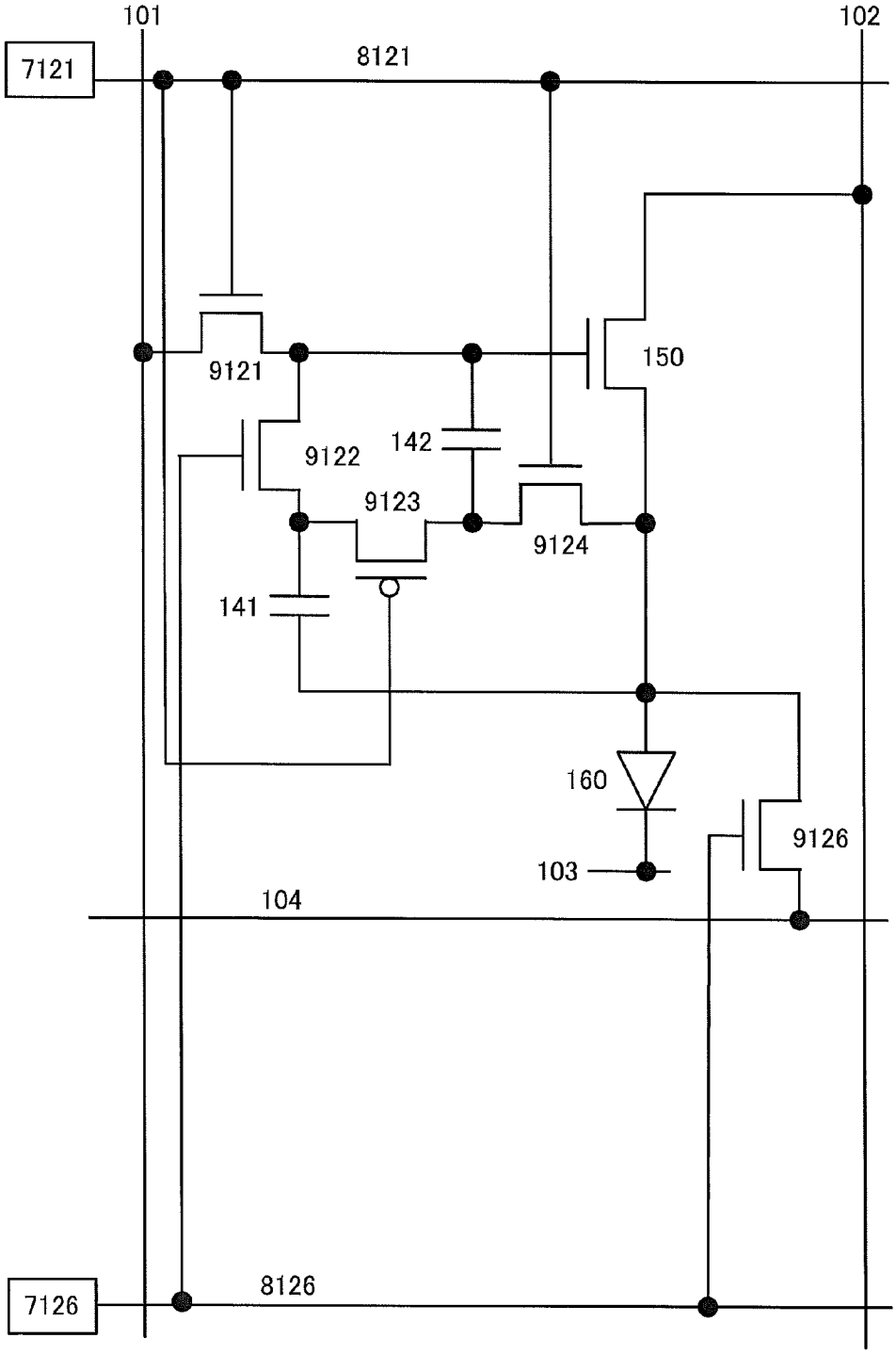
FIG. 43 illustrates a pixel circuit of one embodiment of the present invention.

In a similar manner, FIG. 42 and FIG. 43 each illustrate an example different from the case of FIG. 29 in that one wiring functions as a plurality of wirings.

Note that the wiring 8121, the wiring 8122, the wiring 8123, the wiring 8124, the wiring 8125, and the wiring 8126 each have a function of supplying or transmitting a selection signal. Alternatively, the wiring 8121, the wiring 8122, the wiring 8123, the wiring 8124, the wiring 8125, and the wiring 8126 each have a function of supplying or transmitting a control signal. The selection signal or the control signal is, for example, a digital signal. However, one embodiment of the present invention is not limited thereto; the potential of the selection signal or the control signal may be constant.

Further, the circuit 7121, the circuit 7122, the circuit 7123, the circuit 7124, the circuit 7125, and the circuit 7126 each have a function of supplying a pulse signal and a selection signal. Note that the circuit 7121, the circuit 7122, the circuit 7123, the circuit 7124, the circuit 7125, and the circuit 7126 may have either the same configuration or different configurations. Examples of the circuit 7121, the circuit 7122, the circuit 7123, the circuit 7124, the circuit 7125, and the circuit 7126 are a pulse output circuit and a gate driver circuit.

Note that in this specification, a transistor is an element having at least three terminals of a gate, a drain, and a source. In addition, the transistor has a channel region between a drain (a drain terminal, a drain region, or a drain electrode) and a source (a source terminal, a source region, or a source electrode), and a current can flow through the drain, the channel region, and the source. Here, since the source and the drain of the transistor may change depending on the structure, the operating condition, and the like of the transistor, it is difficult to define which is a source or a drain. Therefore, in this document (the specification, the claims, the drawings, and the like), regions functioning as a source and a drain are not called the source and the drain in some cases. In such a case, for example, one of the source and the drain may be referred to as a first terminal and the other thereof may be referred to as a second terminal. Alternatively, one of the source and the drain may be referred to as a first electrode and the other thereof may be referred to as a second electrode. Alternatively, one of the source and the drain may be referred to as a first region and the other thereof may be referred to as a second region. Alternatively, one of the source and the drain may be referred to as a source region and the other thereof may be called a drain region.

Note that a transistor may be an element including at least three terminals of a base, an emitter and a collector. Also in this case, one of the emitter and the collector is referred to as a first terminal, a first electrode, or a first region, and the other of the emitter and the collector is referred to as a second terminal, a second electrode, or a second region in some cases. Note that in the case where a bipolar transistor is used as a transistor, the term "gate" can be replaced with the term "base".

Note that terms such as "first", "second", and "third" are used for distinguishing various elements, members, regions, layers, and areas from others. Therefore, the terms such as "first", "second", and "third" do not limit the number of elements, members, regions, layers, areas, and the like. Further, for example, "first" can be replaced with "second", "third", or the like.

In this specification and the like, any of a variety of switches can be used as a switch. A switch is turned on or off to determine whether a current flows therethrough or not. Alternatively, the switch has a function of determining and changing a current path. For example, the switch has a function of determining whether a current flows through a current path 1 or a current path 2 and switching the paths. Examples of a switch are an electrical switch and a mechanical switch. That is, there is no particular limitation on the kind of switch as long as it can control the flow of a current. Examples of the switch are a transistor (e.g., a bipolar transistor or a MOS transistor), a diode (e.g., a PN diode, a PIN diode, a Schottky diode, a metal-insulator-metal (MIM) diode, a metal-insulator-semiconductor (MIS) diode, or a diode-connected transistor), and a logic circuit combining such elements. An example of a mechanical switch is a switch formed using a MEMS (micro electro mechanical system) technology, such as a digital micromirror device (DMD). The switch includes an electrode which can be moved mechanically, and is turned on or off in accordance with the movement of the electrode.

Examples of a transistor with a low off-state current are a transistor provided with an LDD region, a transistor with a multi-gate structure, and a transistor including an oxide semiconductor in a semiconductor layer. Alternatively, in the case where a combination of transistors functions as a switch, a complementary switch including both n-channel and p-channel transistors may be employed. A complementary switch achieves appropriate operation even when a potential input to the switch is changed relative to an output potential.

Note that in the case of using a transistor as a switch, an n-channel transistor is preferably used as the switch when the potential of a source of the transistor which operates as the switch is close to the potential of a low-potential-side power supply (e.g., Vss, GND, or 0 V). On the other hand, a p-channel transistor is preferably used as the switch when the potential of the source is close to the potential of a high-potential-side power supply (e.g., Vdd). This is because the absolute value of the gate-source voltage can be increased when the potential of a source of the n-channel transistor is close to the potential of a low-potential-side power supply and when the potential of a source of the p-channel transistor is close to the potential of a high-potential-side power supply, so that the transistor can more accurately operate as a switch. Alternatively, this is because the transistor does not often perform source follower operation, so that the output voltage is not often decreased.

Note that a CMOS switch including both n-channel and p-channel transistors may be employed as a switch. The use of a CMOS switch as a switch allows more accurate operation of the switch because a current can flow when either the p-channel transistor or the n-channel transistor is turned on. Thus, a voltage can be appropriately output regardless of whether the voltage of an input signal to the switch is high or low. Alternatively, the voltage amplitude of a signal for turning on or off the switch can be made small, so that power consumption can be reduced.

Note that when a transistor is used as a switch, the switch includes an input terminal (one of a source and a drain), an output terminal (the other of the source and the drain), and a terminal for controlling conduction (a gate) in some cases. On the other hand, when a diode is used as a switch, the switch does not have a terminal for controlling conduction in some cases. Therefore, when a diode is used as a switch, the number of wirings for controlling terminals can be small as compared with the case of using a transistor as a switch.

Note that, for example, a transistor with a structure where gate electrodes are provided above and below a channel can be used as a transistor. With the structure where the gate electrodes are provided above and below the channel, a circuit structure where a plurality of transistors are connected in parallel is provided. Thus, a channel region is increased, so that the amount of current can be increased. When the structure where the gate electrodes are provided above and below the channel is employed, a depletion layer is easily formed; thus, the subthreshold swing (S value) can be improved.

Note that, for example, a transistor with a structure where a source electrode or a drain electrode overlaps with a channel region (or part thereof) can be used as a transistor. When the structure where the source electrode or the drain electrode overlaps with the channel region (or part thereof) is employed, unstable operation due to electric charge accumulated in part of the channel region can be prevented.

Note that the capacitor may have a structure in which an insulating film is sandwiched between wirings, semiconductor layers, electrodes, or the like, for example. The capacitor has a function of holding a voltage which depends on the characteristics of the transistor (e.g., a voltage depending on the threshold voltage or a voltage depending on mobility). Further, the capacitor has a function of holding a voltage (e.g., Vsig or a video signal) which depends on the amount of current supplied to a load such as the light-emitting element.

Note that the load means an object having a rectifying property, an object having capacitance, an object having resistance, a circuit including a switch, a pixel circuit, a current source circuit, or the like. For example, the object having a rectifying property has current-voltage characteristics showing different resistance values which depend on the direction of an applied bias, and has an electric property which allows a current to flow only in one direction. Specifically, the load may be a display element (e.g., a liquid crystal element or an EL element), a light-emitting element (EL (electroluminescence) element (e.g., an EL element containing organic and inorganic materials, an organic EL element, or an inorganic EL element), an LED (e.g., a white LED, a red LED, a green LED, or a blue LED), a transistor (a transistor which emits light which depends on the amount of a current), or an electron emitter), a part of a display element or a light-emitting element (e.g., a pixel electrode, an anode, or a cathode), or the like.

An example of the light-emitting element is an element including an anode, a cathode, and an EL layer interposed between the anode and the cathode. Examples of the EL layer are a layer utilizing light emission (fluorescence) from a singlet exciton, a layer utilizing light emission (phosphorescence) from a triplet exciton, a layer utilizing light emission (fluorescence) from a singlet exciton and light emission (phosphorescence) from a triplet exciton, a layer formed using an organic material, a layer formed using an inorganic material, a layer formed using an organic material and an inorganic material, a layer including a high-molecular material, a layer including a low-molecular material, and a layer including a high-molecular material and a low-molecular material. Note that the present invention is not limited thereto, and various types of EL elements can be used.

Figure 6A:
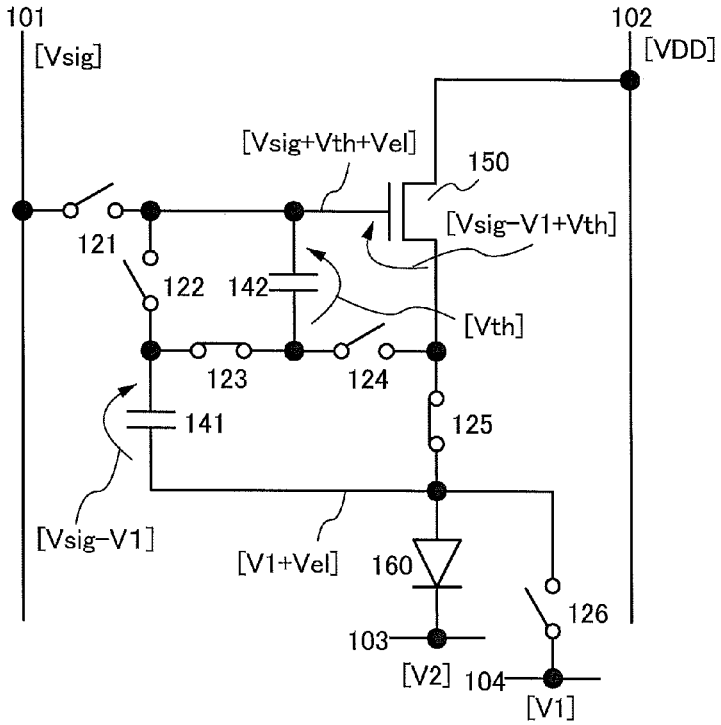
FIGS. 6A and 6B each illustrate a pixel circuit and its operation of one embodiment of the present invention.
Figure 6B:
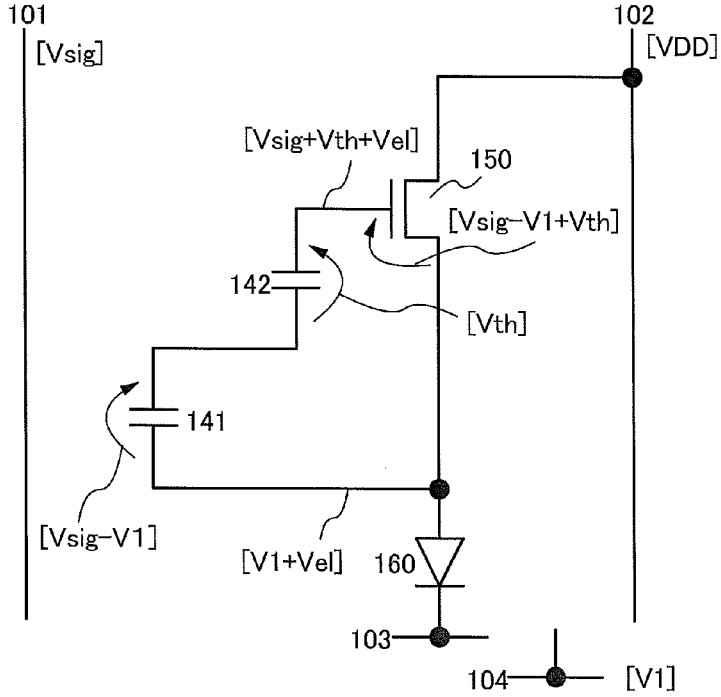
Figure 7:
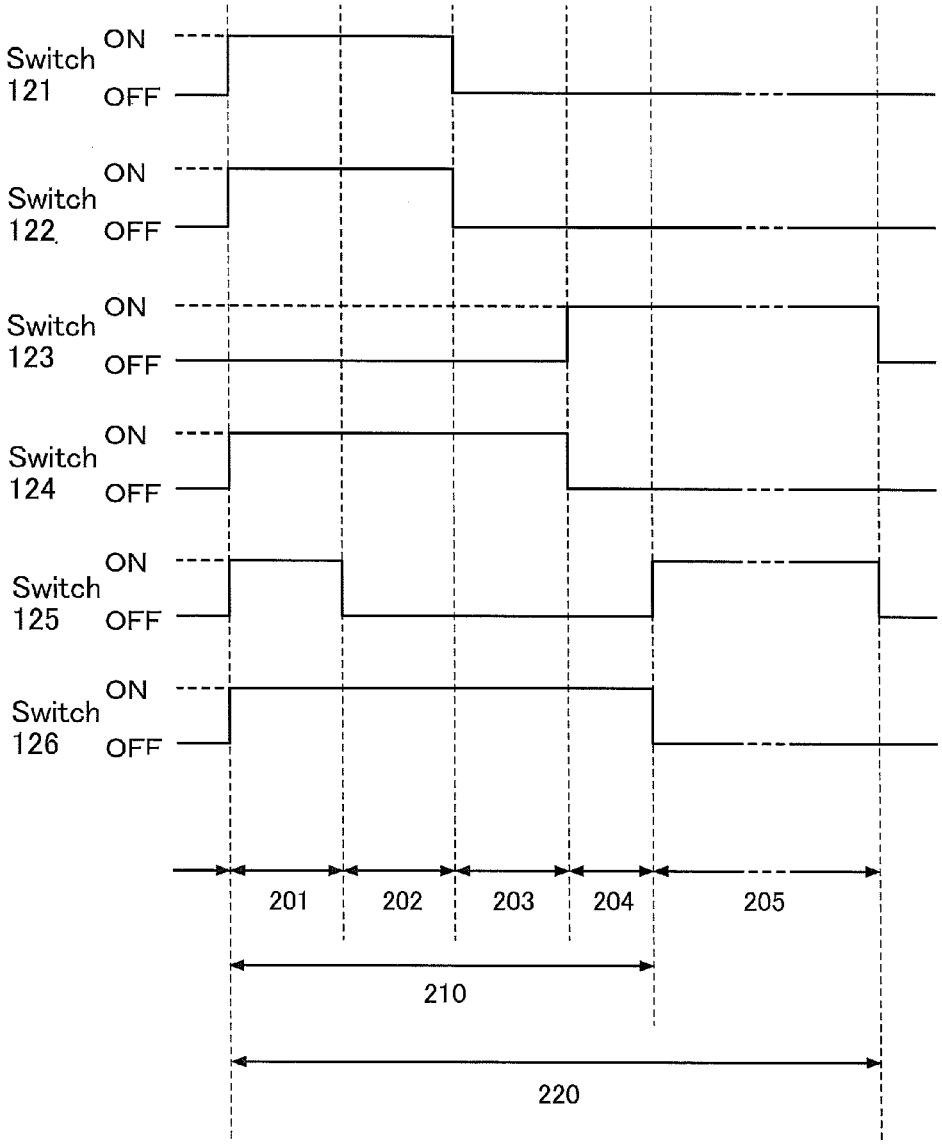
FIG. 7 is a timing chart for operating a pixel circuit of one embodiment of the present invention.

Next, an operation example of the pixel circuit illustrated in FIG. 1 will be described with reference to FIGS. 2A and 2B, FIGS. 3A and 3B, FIGS. 4A and 4B, FIGS. 5A and 5B, and FIGS. 6A and 6B which illustrates the operations of the switches and FIG. 7 showing a timing chart. Note that in the timing chart in FIG. 7, one frame period 220 corresponding to a period in which an image for one screen is displayed is divided into an initialization period 201, a discharge period 202, a signal input termination period 203, a signal addition period 204, and a light emission period 205. The periods except the light emission period in one frame period are collectively referred to as an address period 210. Although the length of one frame period is not particularly limited, it is preferably 1/60 seconds or less, more preferably 1/120 seconds or less so that an image viewer does not perceive flicker.

Note that it is also possible that any of the initialization period 201, the discharge period 202, the signal input termination period 203, and the signal addition period 204 is not provided. For example, the signal input termination period 203 or the signal addition period 204 may be omitted. Alternatively, another period, for example, a mobility correction period may be additionally provided. Therefore, the operating method is not limited to that in FIGS. 2A and 2B, FIGS. 3A and 3B, FIGS. 4A and 4B, FIGS. 5A and 5B, FIGS. 6A and 6B, and FIG. 7.

The wiring 103 is connected to the cathode of the light-emitting element 160, and the potential of the cathode is the potential of the wiring 103 (V2). Thus, a potential higher than or equal to V2+Velth+Vth+$\alpha$ ($\alpha$ is a given positive number) is supplied to the wiring 102, for example. Note that V2 is a potential which is higher than the potential of the wiring 104 (V1) within the range that allows the light-emitting element 160 to be forward biased in operation. Alternatively, V2 may be equal to the potential of the wiring 104 (V1).

Figure 2A:
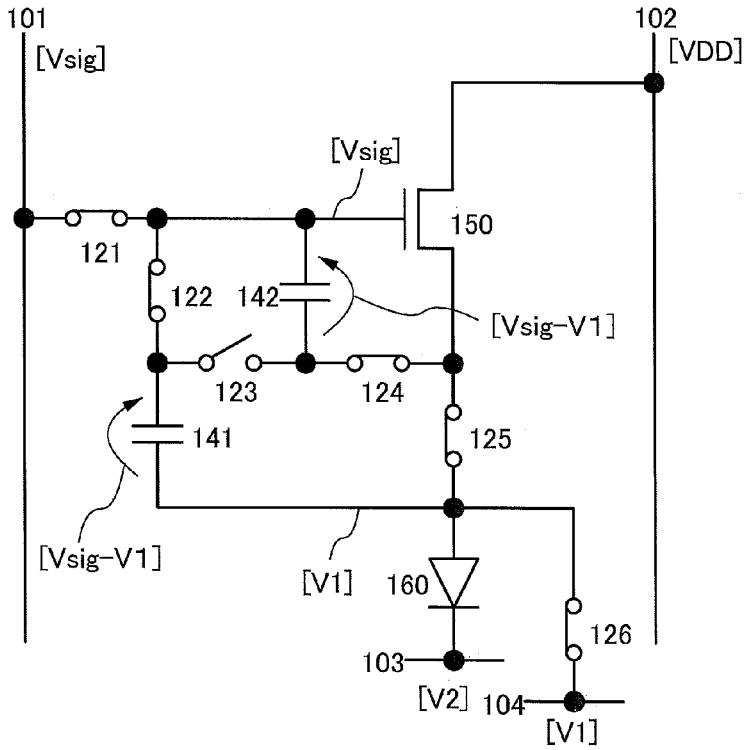
FIGS. 2A and 2B each illustrate a pixel circuit and its operation of one embodiment of the present invention.
Figure 2B:
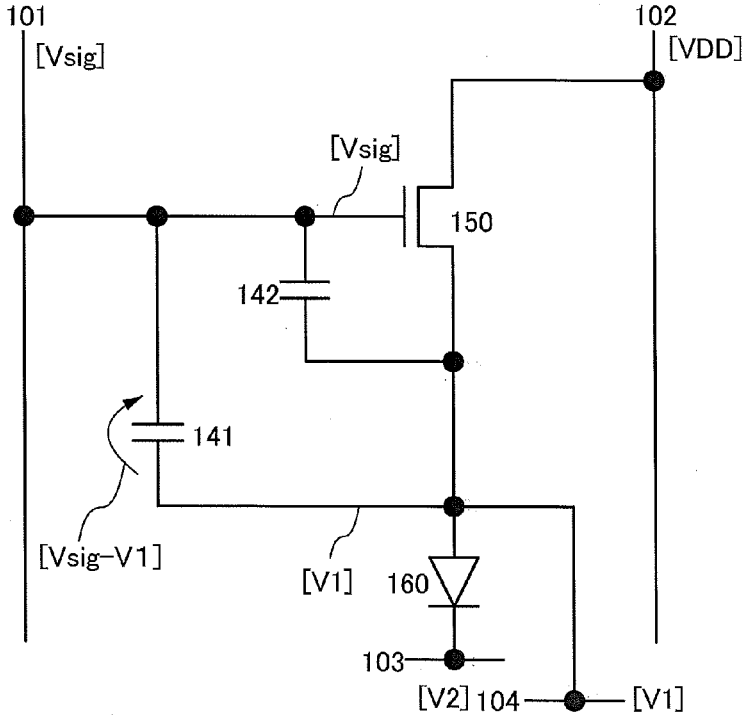

First, in the initialization period 201 in the timing chart of FIG. 7, the switch 121 is on, the switch 122 is on, the switch 123 is off, the switch 124 is on, the switch 125 is on, and the switch 126 is on as in FIG. 2A.

For example, the potential of a signal for expressing the gray level of a pixel which corresponds to a video signal, that is, the potential of a signal (Vsig) depending on luminance data, is supplied to the wiring 101; the power supply potential (Vdd) is supplied to the wiring 102; the potential (V2) for controlling the light-emitting element 160 is supplied to the wiring 103; and a reference potential (V1) of the circuit is supplied to the wiring 104. Note that one embodiment of the present invention is not limited thereto; another signal or potential may be supplied to each wiring.

At this time, the transistor 150 is turned on; however, the light-emitting element is not fed with a voltage higher than or equal to Velth and thus does not operate. The capacitor 141 and the capacitor 142 hold Vsig−V1. Note that in the initialization period 201, at least the capacitor 142 holds a voltage higher than Vth.

Note that the pixel circuit in FIG. 2A is an example for illustrating the operation in the initialization period 201. Thus, the mode of the switch and the connection mode of the switches, the wirings, the capacitors, the transistors, and the like are not limited to those illustrated in FIG. 2A as long as the pixel circuit has the mode satisfying the circuit diagram of FIG. 2B in the initialization period 201, for example.

Note that the switch 122 may be off in the initialization period 201, in which case the voltage is applied to the capacitor 141 in another period.

Figure 3A:
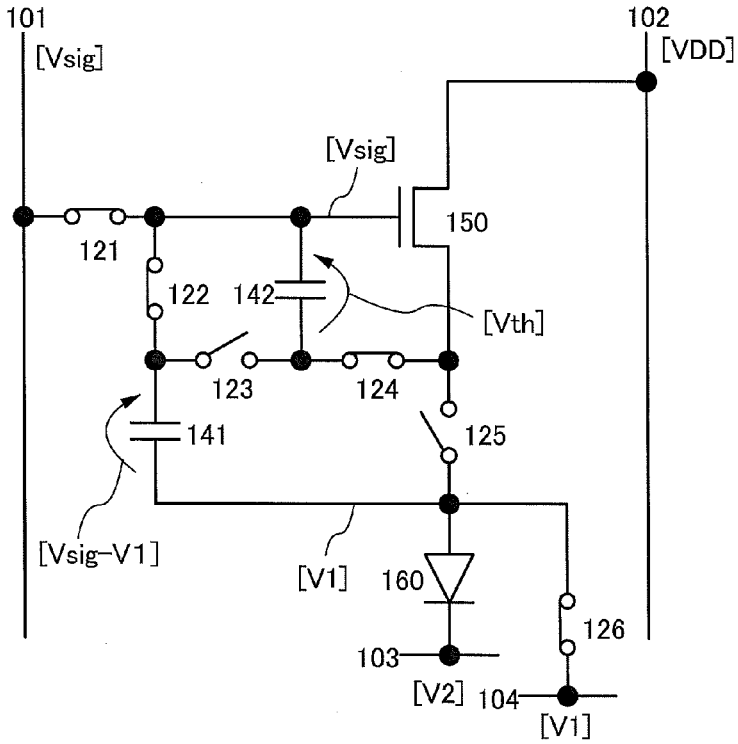
FIGS. 3A and 3B each illustrate a pixel circuit and its operation of one embodiment of the present invention.
Figure 3B:
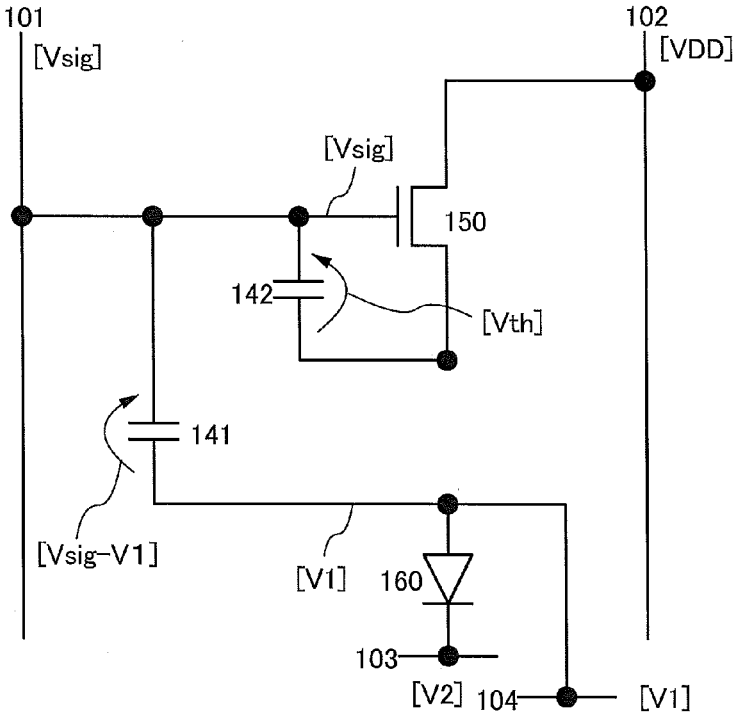

Next, in the discharge period 202 in the timing chart of FIG. 7, the switch 121 is on, the switch 122 is on, the switch 123 is off, the switch 124 is on, the switch 125 is off, and the switch 126 is on as in FIG. 3A.

Here, the potential of the source of the transistor 150 is gradually raised and then the transistor 150 is turned off. At this time, Vgs becomes Vth and thus the capacitor 142 holds Vth. The capacitor 141 remains holding Vsig−V1. Note that Vsig−V1 is held in the capacitor 141 in the initialization period 201 and/or the discharge period 202.

Note that the pixel circuit in FIG. 3A is an example for illustrating the operation in the discharge period 202. Thus, the mode of the switch and the connection mode of the switches, the wirings, the capacitors, the transistors, and the like are not limited to those illustrated in FIG. 3A as long as the pixel circuit has the mode illustrated in the circuit diagram of FIG. 3B in the discharge period 202, for example.

Note that in some cases, it takes a very long time until Vgs becomes equal to the threshold voltage Vth of the transistor 150. For this reason, in many cases, the semiconductor device is driven while Vgs is not completely decreased to the threshold voltage Vth. That is to say, in many cases, the discharge period 202 is finished while Vgs is slightly higher than the threshold voltage Vth. In other words, at the time when the discharge period 202 is finished, Vgs becomes equal to or substantially equal to the threshold voltage.

A period until when Vgs becomes equal to the threshold voltage Vth of the transistor 150 depends on the mobility of the transistor 150. Specifically, in the case where the mobility is higher, it takes a shorter period of time until Vgs becomes equal to the threshold voltage Vth, whereas in the case where the mobility is lower, it takes a longer period of time until Vgs becomes equal to the threshold voltage Vth. When discharging is performed in the same length of period, Vgs becomes a smaller value closer to Vth in the case where the mobility is higher, and Vgs becomes a larger value more distant from Vth in the case where the mobility is lower. For this reason, the discharge period 202 is set to be shorter, whereby Vgs can be obtained in accordance with variations in mobility. That is, Vgs can be adjusted so that on-state currents do not vary between transistors due to variation in mobility.

Note that in the discharge period 202, operation can be performed regardless of whether the threshold voltage Vth of the transistor 150 is a positive voltage or a negative voltage. This is because the potential of the source of the transistor 150 can be raised until the transistor 150 is turned off. In other words, when the potential of the source of the transistor 150 becomes higher than the potential of the gate of the transistor 150, the transistor 150 can be finally turned off and Vgs can become equal to Vth. Thus, normal operation can be performed regardless of whether the transistor 150 is an enhancement (normally-off) transistor or a depletion (normally-on) transistor.

Therefore, even when the transistor 150 is likely to become a depletion transistor or may become a depletion transistor due to deterioration, variations, or the like, normal operation can be performed; thus, it is possible to employ a transistor including an oxide semiconductor in an active layer as the transistor 150.

Note that the switch 126 may be off in the discharge period 202. Similarly, the switch 122 may be off. In the case where the switch 126 or the switch 122 is off, the voltage is applied to the capacitor 141 in another period.

Figure 4A:
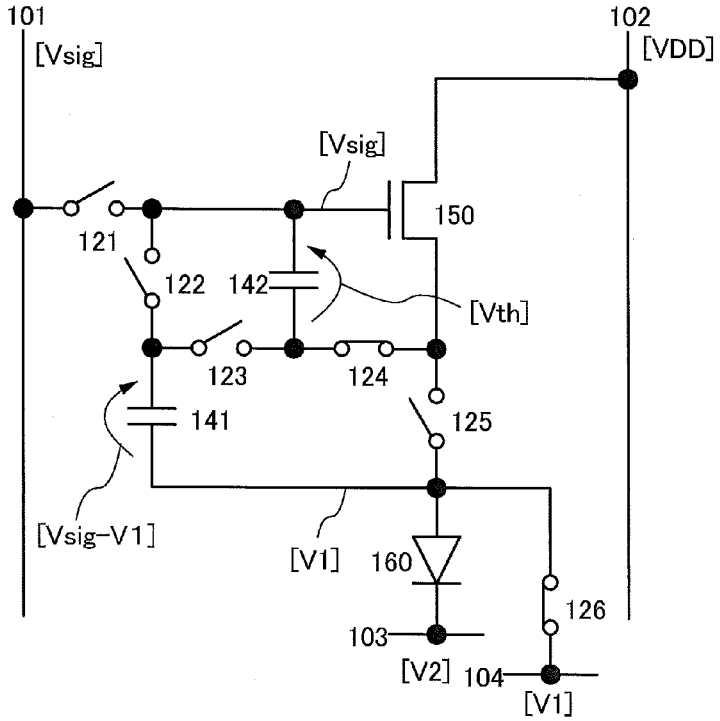
FIGS. 4A and 4B each illustrate a pixel circuit and its operation of one embodiment of the present invention.
Figure 4B:
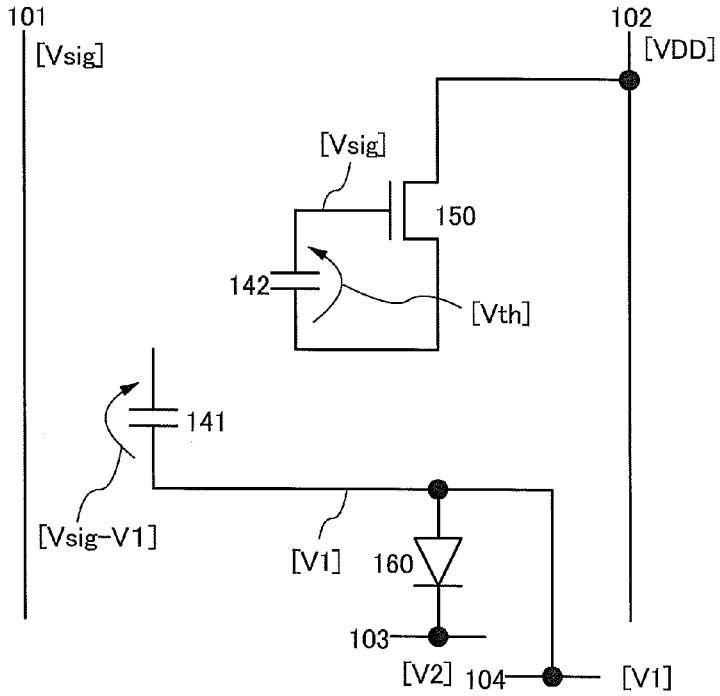

Next, in the signal input termination period 203 in the timing chart of FIG. 7, the switch 121 is off, the switch 122 is off, the switch 123 is off, the switch 124 is on, the switch 125 is off, and the switch 126 is on as in FIG. 4A.

Here, the voltage (Vsig−V1) held in the capacitor 141 and the voltage (a voltage equal to or substantially equal to Vth) held in the capacitor 142 are determined.

Note that the pixel circuit in FIG. 4A is an example for illustrating the operation in the signal input termination period 203. Thus, the mode of the switch and the connection mode of the switches, the wirings, the capacitors, the transistors, and the like are not limited to those illustrated in FIG. 4A as long as the pixel circuit has the mode satisfying the circuit diagram of FIG. 4B in the signal input termination period 203, for example.

Note that the switch 126 may be off in the signal input termination period 203. Similarly, the switch 124 may be off.

The signal input termination period 203 allows reduction of mixing of signals or noises due to overlapping of on/off switching operations of the switches. Note that the signal input termination period 203 may be skipped; the signal addition period 204 may start after the discharge period 202.

Figure 5A:
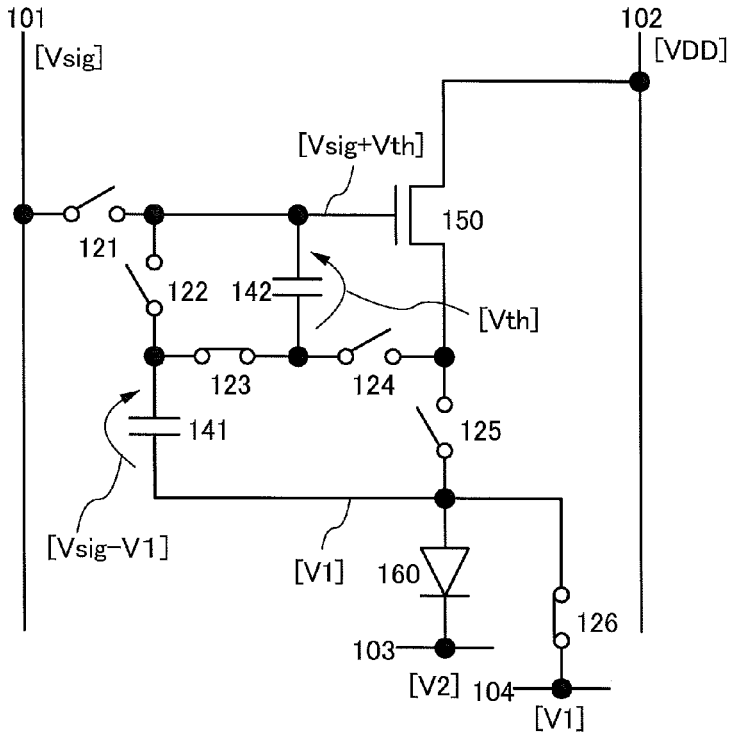
FIGS. 5A and 5B each illustrate a pixel circuit and its operation of one embodiment of the present invention.
Figure 5B:
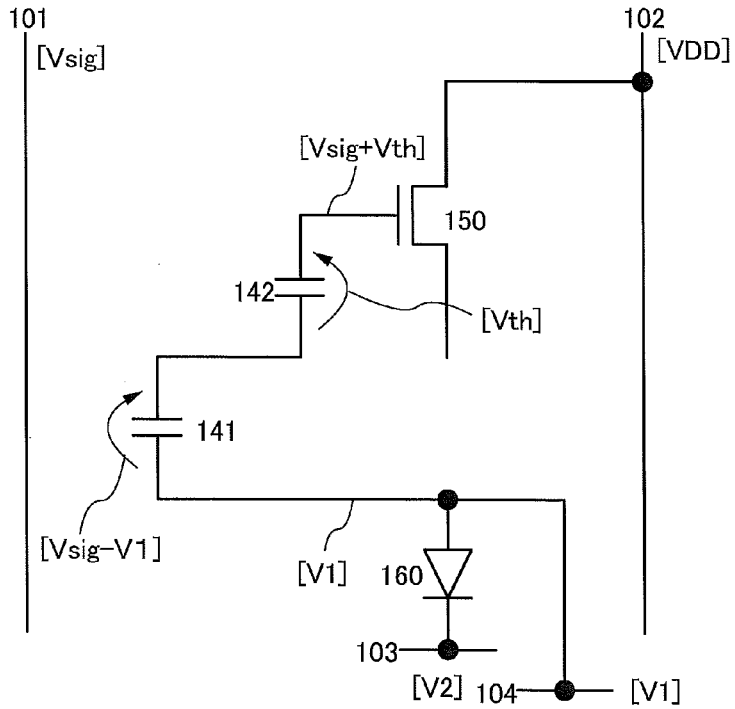

Next, in the signal addition period 204 in the timing chart of FIG. 7, the switch 121 is off, the switch 122 is off, the switch 123 is on, the switch 124 is off, the switch 125 is off, and the switch 126 is on as in FIG. 5A.

Here, the voltages of the capacitor 141 and the capacitor 142 are summed up, so that a voltage of Vsig+Vth is applied to the gate of the transistor 150.

Note that the pixel circuit in FIG. 5A is an example for illustrating the operation in the signal addition period 204. Thus, the mode of the switch and the connection mode of the switches, the wirings, the capacitors, the transistors, and the like are not limited to those illustrated in FIG. 5A as long as the pixel circuit has the mode illustrated in the circuit diagram of FIG. 5B in the signal addition period 204, for example.

Note that the switch 126 may be off in the signal addition period 204. Similarly, the switch 125 may be on. In the case where the switch 126 is off and the switch 125 is on, a current may be supplied to the light-emitting element 160 from the transistor 150.

The signal addition period 204 allows reduction of mixing of signals or noises due to overlapping of on/off switching operations of the switches. Note that the signal addition period 204 may be skipped; the light emission period 205 may start after the discharge period 202 or the signal input termination period 203.

Next, in the light emission period 205 in the timing chart of FIG. 7, the switch 121 is off, the switch 122 is off, the switch 123 is on, the switch 124 is off, the switch 125 is on, and the switch 126 is off as in FIG. 6A.

The switch 126 is turned off, so that a current flows through the light-emitting element 160 and the potential of the source of the transistor 150 is raised to V1+Vel. Here, Vel is a voltage applied to the light-emitting element 160. This voltage depends on a current flowing through the light-emitting element 160, the current-voltage characteristics, the deterioration state, or the temperature of the light-emitting element 160, or the like. To the gate of the transistor 150, a voltage of Vsig+Vth+Vel is applied. At this time, Vgs of the transistor 150 is Vsig−V1+Vth.

That is to say, a voltage obtained by addition of Vth is applied to the gate of the transistor 150; thus, the light-emitting element can be prevented from being influenced by variations in Vth between pixels and a fluctuation in Vth due to deterioration of the transistor, so that an image with a constant luminance can be displayed.

Further, even in the case where Vth is a negative voltage, that is, in the case where the transistor is a depletion (normally-on) transistor, the light-emitting element can be prevented from being influenced by variations in Vth between pixels and a fluctuation in Vth due to deterioration of the transistor, so that an image with a constant luminance can be displayed.

Figure 14:
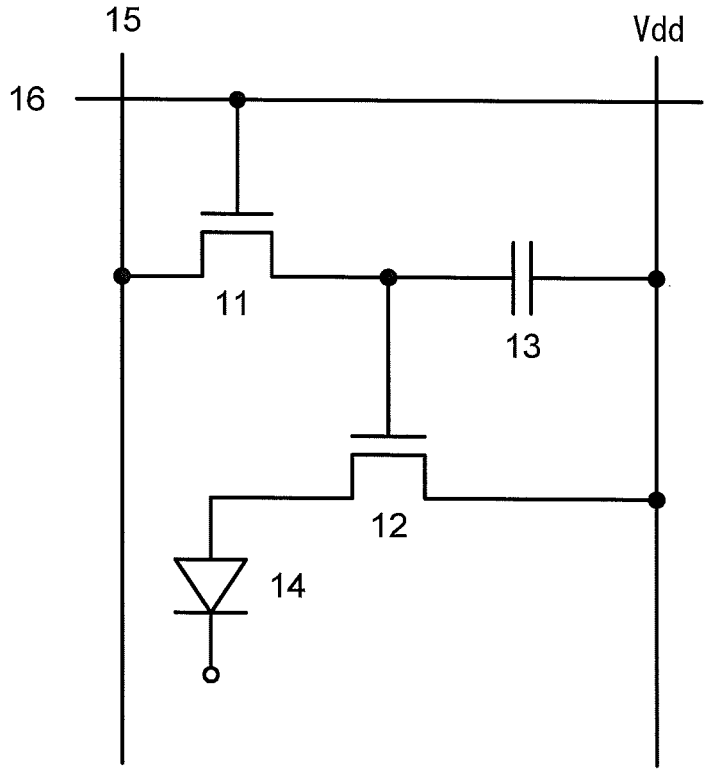
FIG. 14 illustrates a pixel configuration using a conventional art.
Figure 15:
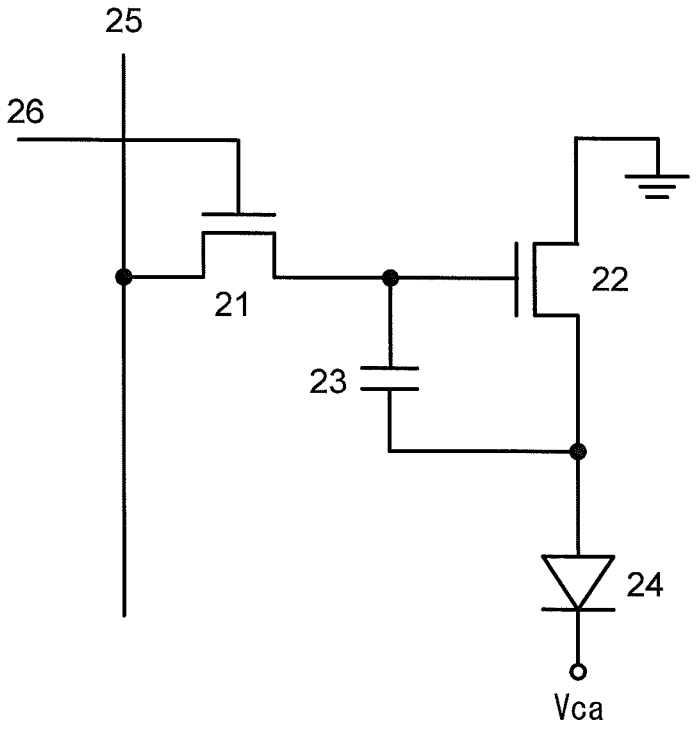
FIG. 15 illustrates a pixel configuration using a conventional art.
Figure 16:
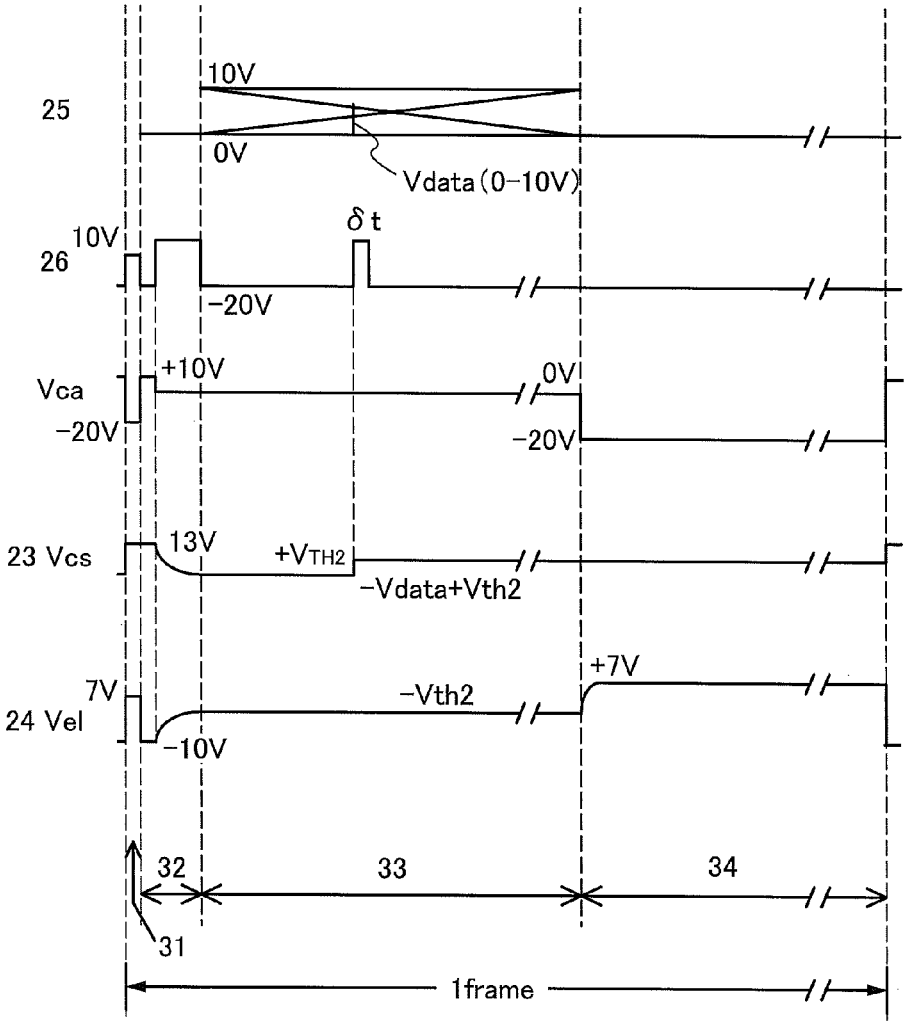
FIG. 16 is a timing chart for operating the pixel described as a conventional art.

When the light-emitting element deteriorates, Vel is raised in some cases. Alternatively, Vel varies due to variations in the characteristics of the light-emitting element or variations in characteristics depending on the emission color. Note that deterioration of the light-emitting element is not limited to the case where the current-voltage characteristics thereof are shifted in parallel with the current-voltage characteristics before deterioration. For example, deterioration of the light-emitting element also includes the case where a differential value is different from a differential value before deterioration when a slope of characteristics and characteristics are represented by curves. In the case where a driver transistor is an n-channel transistor, in a conventional pixel circuit in FIG. 14 or the like, when Vel is raised, the source potential is raised and thus Vgs is lowered, so that a current flowing through the light-emitting element decreases, leading to a reduction in the luminance of a display image. However, in the pixel circuit in the semiconductor device of one embodiment of the present invention, a voltage obtained by addition of Vel is applied to the gate of the transistor 150 and Vgs becomes Vsig−V1+Vth, so that the operation can be prevented from being influenced by a raise in Vel because of deterioration of the light-emitting element 160, and variations in Vela Consequently, an image with a constant luminance can be displayed.

Note that the switch 125 may be turned off in the light emission period not to pass a current through the light-emitting element 160 so that the light-emitting element 160 is made to be in a non-light emission state. In such a manner, the driving method can be changed from hold driving in which light is emitted in almost all periods in one frame period to a driving method close to impulsive driving in which a light emission period is short. Specifically, by decreasing the duty ratio (the rate of a light emission period in one frame period), the driving method can be closer to impulsive driving, leading to an increase in response speed of moving images. Thus, afterimages are less likely to be perceived.

Note that in the case of operating the transistor 150 in the saturation region, as the channel length L is shorter, a larger amount of current easily flows by a breakdown when a drain voltage is extremely increased.

Figure 13:
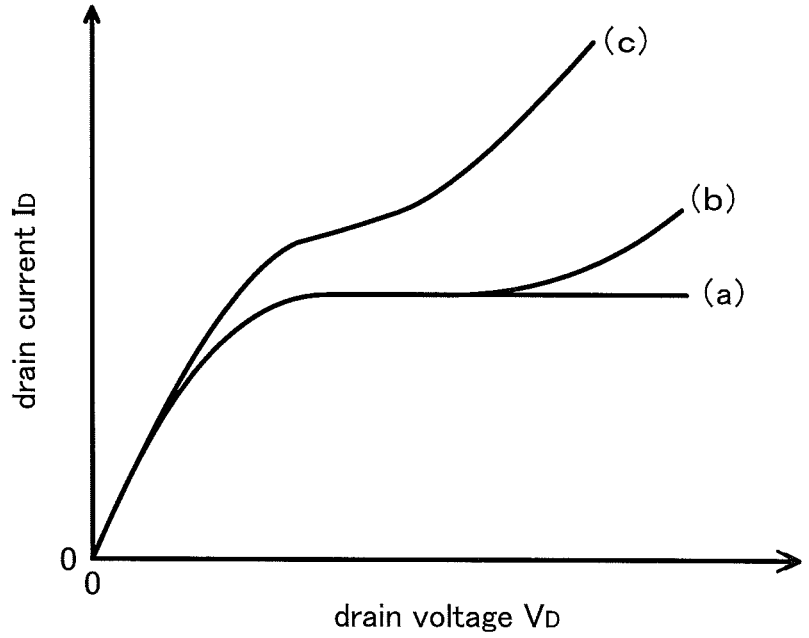
FIG. 13 is a model graph showing voltage-current characteristics of a transistor.

When the drain voltage is increased to exceed a pinch-off voltage, a pinch-off point moves to the source side and an effective channel length which substantially functions as a channel decreases. This increases a current value, and such a phenomenon is called a channel length modulation. Note that the pinch-off point is a boundary portion at which the channel disappears and the thickness of the channel below the gate in that portion is 0. In addition, the pinch-off voltage means a voltage when the pinch-off point is at the drain edge. This phenomenon is also more likely to occur as the channel length L is shorter. FIG. 13 is an example of a model diagram showing variations in voltage-current characteristics caused by the channel length modulation. Note that the channel lengths L of transistors (a), (b), and (c) satisfy (a)>(b)>(c) in FIG. 13.

Thus, in the case of operating the transistor 150 in the saturation region, the current I with respect to the drain-source voltage Vds is preferably as constant as possible, so that the channel length L of the transistor 150 is preferably longer. For example, the channel length L of the transistor is preferably longer than the channel width W thereof. Alternatively, the channel length L is preferably in the range of 10 μm to 50 μm, more preferably in the range of 15 μm to 40 μm. In the case where the switches 121 to 126 are transistors, the channel length L of the transistor 150 is preferably longer than that of each of the transistors. Alternatively, the channel length L of the transistor 150 is preferably the longest in one pixel circuit. However, the channel length L and the channel width W are not limited thereto.

Since variations of the current value caused by variations in the threshold voltage and the mobility of the transistor can be suppressed as described above, a supply destination of a current controlled by the transistor is not particularly limited in one embodiment of the present invention. Therefore, an EL element (an organic EL element, an inorganic EL element, or an EL element containing both an organic material and an inorganic material) can be typically used for the light-emitting element 160 in FIG. 1. Alternatively, an electron emitter, a liquid crystal element, electronic ink, a resistive element, or the like can be used instead of the light-emitting element 160.

A supply destination of the current of the transistor 150 may be a circuit such as a current source circuit or a pixel circuit. Therefore, a circuit including the transistor 150 and the switches 121 to 126 can be used as a circuit other than a pixel circuit, such as an analog circuit, a source line driver circuit, or a DA converter circuit, or part thereof. Thus, the current of the transistor 150 can be supplied to various loads.

Note that it is only necessary for the transistor 150 to have a function of controlling a current supplied to the light-emitting element 160, so that there is no particular limitation on the type of a transistor used as the transistor 150; any of various types of transistors can be used as the transistor 150. For example, a thin film transistor (TFT) including a crystalline semiconductor film, a thin film transistor including a non-single-crystal semiconductor film typified by amorphous silicon or polycrystalline silicon, a transistor formed using a semiconductor substrate or an SOI substrate, a MOS transistor, a junction transistor, a bipolar transistor, a transistor including a compound semiconductor or oxide semiconductor such as ZnO or InGaZnO, a transistor including an organic semiconductor or a carbon nanotube, or the like can be used as the transistor 150.

In particular, a transistor including an oxide semiconductor in an active layer is suitable as a transistor which is likely to become a depletion (normally-on) transistor.

In the case of using the TFT, there are various advantages. For example, since the TFT can be formed at a temperature lower than that of the case of using single crystal silicon, manufacturing cost can be reduced and a larger manufacturing apparatus can be used. Since a larger manufacturing apparatus can be used, TFTs can be formed using a large substrate. Therefore, many display devices can be formed at the same time at low cost. Alternatively, a substrate having low heat resistance can be used because of a low manufacturing temperature. Therefore, the transistor can be formed using a light-transmitting substrate. Alternatively, transmission of light in a display element can be controlled by using the transistor formed using the light-transmitting substrate. Alternatively, part of a film included in the transistor can transmit light because the thickness of the transistor is small. Therefore, the aperture ratio can be increased.

Note that by using a catalyst (e.g., nickel) in forming polycrystalline silicon, crystallinity can be further increased and a transistor having excellent electric characteristics can be formed. Accordingly, a gate driver circuit (a scan line driver circuit), a source driver circuit (a signal line driver circuit), and a signal processing circuit (a signal generation circuit, a gamma correction circuit, a DA converter circuit, or the like) can be formed using the same substrate.

Note that by using a catalyst (e.g., nickel) in forming microcrystalline silicon, crystallinity can be further increased and a transistor having excellent electric characteristics can be formed. At this time, crystallinity can be increased by just performing heat treatment without performing laser irradiation. Accordingly, a gate driver circuit (a scan line driver circuit) and part of a source driver circuit (e.g., an analog switch) can be formed over the same substrate. Note that in the case where laser irradiation for crystallization is not performed, unevenness in crystallinity of silicon can be suppressed. Accordingly, an image with improved image quality can be displayed. Note that polycrystalline silicon or microcrystalline silicon can be formed without use of a catalyst (e.g., nickel).

Note that it is preferable that the crystallinity of silicon be improved to polycrystal, microcrystal, or the like in the whole panel; however, the crystallinity of silicon in the present invention is not limited thereto. The crystallinity of silicon may be improved only in part of the panel. A selective increase in crystallinity can be achieved by selective laser irradiation or the like. For example, only a peripheral driver circuit region, which is a region excluding pixels, may be irradiated with laser light. Alternatively, only a region of a gate driver circuit, a source driver circuit, or the like may be irradiated with laser light. Alternatively, only part of a source driver circuit (e.g., an analog switch) may be irradiated with laser light. By such selective laser irradiation, the crystallinity of silicon only in a region in which a circuit needs to operate at high speed can be improved. Because a pixel region is not particularly needed to be operated at high speed, even if crystallinity is not improved, the pixel circuit can be operated without problems. Thus, a region whose crystallinity is improved is small, so that manufacturing steps can be decreased. As a result, the throughput can be increased and the manufacturing cost can be reduced. Alternatively, the number of manufacturing apparatuses needed is small; thus, the manufacturing cost can be reduced.

Examples of the transistor are a transistor including a compound semiconductor (e.g., SiGe or GaAs) or an oxide semiconductor (e.g., zinc oxide, indium gallium zinc oxide, indium zinc oxide, indium tin oxide, tin oxide, titanium oxide, aluminum zinc tin oxide, or indium tin zinc oxide) and a thin film transistor including a thin film of such a compound semiconductor or oxide semiconductor. Thus, the manufacturing temperature can be low and for example, such a transistor can be formed at room temperature. Accordingly, the transistor can be formed directly on a substrate having low heat resistance, such as a plastic substrate or a film substrate. Note that such a compound semiconductor or oxide semiconductor can be used for not only a channel portion of a transistor but also for other applications. For example, such a compound semiconductor or oxide semiconductor can be used for a wiring, a resistive element, a pixel electrode, a light-transmitting electrode, or the like. Since such an element can be formed at the same time as a transistor, the cost can be reduced.

Note that for example, a transistor formed by an ink jet method or a printing method can be used as a transistor. Accordingly, such a transistor can be formed at room temperature, can be formed at a low vacuum, or can be formed using a large substrate. Thus, the transistor can be formed without using a mask (reticle), which enables the layout of the transistor to be easily changed. Alternatively, the transistor can be formed without using a resist, leading to reductions in material cost and the number of steps. Further, a film can be formed only in a portion where the film is needed, a material is not wasted as compared with the case of employing a manufacturing method by which etching is performed after the film is formed over the entire surface, so that the cost can be reduced.

Note that for example, a transistor including an organic semiconductor or a carbon nanotube can be used as a transistor. Thus, such a transistor can be formed over a flexible substrate. A device including a transistor which includes an organic semiconductor or a carbon nanotube can resist a shock.

Note that transistors with a variety of different structures can be used for a transistor. For example, a MOS transistor, a junction transistor, a bipolar transistor, or the like can be used as a transistor. Since a MOS transistor has a small size, a plurality of transistors can be mounted. Note that a MOS transistor and a bipolar transistor may be formed over one substrate, in which case reductions in power consumption and size, high-speed operation, and the like can be achieved.

Note that in this specification and the like, for example, a transistor with a multi-gate structure having two or more gate electrodes can be used as a transistor. With the multi-gate structure, a structure where a plurality of transistors are connected in series is provided because channel regions are connected in series. Thus, with the multi-gate structure, the amount of off-state current can be reduced and the withstand voltage of the transistor can be increased (reliability can be improved). Alternatively, with the multi-gate structure, the drain-source current does not change so much even if the drain-source voltage fluctuates when the transistor operates in a saturation region, so that a flat slope of the voltage-current characteristics can be obtained. By utilizing the flat slope of the voltage-current characteristics, an ideal current source circuit or an active load having extremely high resistance can be obtained. Accordingly, a differential circuit, a current mirror circuit, or the like having excellent properties can be obtained.

Note that for example, a transistor with a structure where a gate electrode is formed above a channel region, a structure where a gate electrode is formed below a channel region, a staggered structure, an inverted staggered structure, a structure where a channel region is divided into a plurality of regions, a structure where channel regions are connected in parallel or in series, or the like can be used as a transistor.

Note that for example, a transistor with a structure where an LDD region is provided can be used as a transistor. Provision of the LDD region enables a reduction in off-current or an increase in the withstand voltage of the transistor (an improvement in reliability). Alternatively, by providing the LDD region, the drain current does not change so much even when the drain-source voltage fluctuates when the transistor operates in a saturation region, so that a flat slope of the voltage-current characteristics can be obtained.

Note that in this specification and the like, a transistor can be formed using any of a variety of substrates, for example. The type of a substrate is not limited to a certain type. Examples of the substrate are a semiconductor substrate (e.g., a single crystal substrate or a silicon substrate), an SOI substrate, a glass substrate, a quartz substrate, a plastic substrate, a metal substrate, a stainless steel substrate, a substrate including stainless steel foil, a tungsten substrate, a substrate including tungsten foil, a flexible substrate, an attachment film, paper including a fibrous material, and a base material film. Examples of the glass substrate are a barium borosilicate glass substrate, an aluminoborosilicate glass substrate, and a soda lime glass substrate. Examples of the flexible substrate are flexible synthetic resin substrates such as substrates of plastics typified by polyethylene terephthalate (PET), polyethylene naphthalate (PEN), and polyether sulfone (PES) and an acrylic substrate. An example of the attachment film is an attachment film formed using polypropylene, polyester, polyvinyl fluoride, polyvinyl chloride, or the like. An example of the base film is a base film formed using polyester, polyamide, polyimide, an inorganic vapor deposition film, paper, or the like. Specifically, when a transistor is formed using a semiconductor substrate, a single crystal substrate, an SOI substrate, or the like, the transistor can have few variations in characteristics, size, shape, or the like, high current supply capability, and a small size. Formation a circuit with the use of such transistors leads to a reduction in power consumption of the circuit or high integration of the circuit.

Note that a transistor may be formed using a substrate, and then, the transistor may be transferred to another substrate. Example of a substrate to which a transistor is transferred are, in addition to the above substrate over which the transistor can be formed, a paper substrate, a cellophane substrate, a stone substrate, a wood substrate, a cloth substrate (including a natural fiber (e.g., silk, cotton, or hemp), a synthetic fiber (e.g., nylon, polyurethane, or polyester), a regenerated fiber (e.g., acetate, cupra, rayon, or regenerated polyester), and the like), a leather substrate, and a rubber substrate. The use of such a substrate enables formation of a transistor with excellent properties, a transistor with low power consumption, or a device with high durability, high heat resistance, or a reduction in weight or thickness.

Note that all the circuits which are necessary to realize a desired function can be formed using one substrate (e.g., a glass substrate, a plastic substrate, a single crystal substrate, or an SOI substrate). In this manner, the cost can be reduced by a reduction in the number of components or reliability can be improved by a reduction in the number of connection points to circuit components.

Note that not all the circuits which are necessary to realize the predetermined function are needed to be formed using one substrate. That is, part of the circuits which are necessary to realize the predetermined function may be formed using a substrate and another part of the circuits which are necessary to realize the predetermined function may be formed using another substrate. For example, part of the circuits which are necessary to realize the predetermined function can be formed using a glass substrate and another part of the circuits which are necessary to realize the predetermined function can be formed using a single crystal substrate (or an SOI substrate). The single crystal substrate over which the another part of the circuits which are necessary to realize the predetermined function (such a substrate is also referred to as an IC chip) can be connected to the glass substrate by COG (chip on glass), and the IC chip can be provided over the glass substrate. Alternatively, the IC chip can be connected to the glass substrate by TAB (tape automated bonding), COF (chip on film), SMT (surface mount technology), a printed circuit board, or the like. When part of the circuits is formed over the same substrate as a pixel portion in this manner, the cost can be reduced by a reduction in the number of components or reliability can be improved by a reduction in the number of connection points between circuit components. In particular, a circuit in a portion where a driving voltage is high, a circuit in a portion where a driving frequency is high, or the like consumes much power in many cases. In view of the above, such a circuit is formed over a substrate (e.g., a single crystal substrate) different from a substrate over which a pixel portion is formed, whereby an IC chip is formed. The use of this IC chip allows prevention of increase in power consumption.

In this specification and the like, one pixel refers to one element whose brightness can be controlled, for example. For example, one pixel refers to one color element and brightness is expressed with the one color element. Therefore, in the case of a color display device including color elements of R (red), G (green), and B (blue), a minimum unit of an image is composed of three pixels of an R pixel, a G pixel, and a B pixel. Note that color elements are not limited to three colors, and color elements of more than three colors may be used or a color other than RGB may be used. For example, white may be added so that R, B, and W (W means white) can be used. Alternatively, one or more colors of yellow, cyan, magenta, emerald green, vermilion, and the like can be added to R, $C_3$ and B, for example. Alternatively, a color similar to at least one of R, G and B can be added to RGB. For example, R, B1, and B2 may be used. Although both B1 and B2 are blue, they have slightly different wavelengths. Similarly, R1, R2, and B may be used. When such color elements are used, an image closer to the real object can be displayed or power consumption can be reduced.

Note that in the case where the brightness of one color element is controlled using a plurality of regions, one region can correspond to one pixel. For example, when area ratio gray scale display is performed or subpixels are included, a plurality of regions that control brightness are provided in each color element and gradation is expressed with all the regions in some cases. In that case, one region that controls brightness can correspond to one pixel. That is, one color element is composed of a plurality of pixels. Note that even when a plurality of regions that control brightness are placed in one color element, they may be collectively referred to as one pixel. In this case, one color element is composed of one pixel. Note that in the case where the brightness of one color element is controlled using a plurality of regions, regions which contribute to display might have different sizes depending on pixels. In the plurality of regions which control brightness in each color element, signals to be supplied to the plurality of regions may be slightly different from each other so that the viewing angle can be widened. In other words, the potentials of pixel electrodes in a plurality of regions may be different from each other in one color element. Accordingly, voltages applied to liquid crystal molecules vary depending on the pixel electrodes. Therefore, the viewing angle can be widened.

Note that the explicit description "one pixel (for three colors)" corresponds to the case where three pixels of R, and B are considered as one pixel. Meanwhile, the explicit description "one pixel (for one color)" corresponds to the case where a plurality of regions are provided in each color element and collectively considered as one pixel.

Note that in this specification and the like, pixels might be provided (arranged) in a matrix, for example. Here, the expression "pixels are provided (arranged) in a matrix includes the case where the pixels are arranged in a straight line or a jagged line in the longitudinal direction or the lateral direction. Thus, for example, when full color display is performed with three color elements (e.g., R, G, and B), the following cases are included: the case where pixels are arranged in stripes, the case where dots of the three color elements are arranged in a delta pattern, the case where dots of the three color elements are provided in Bayer arrangement, and the case where dots of the three color elements are provided in a mosaic pattern. Further, the sizes of display regions may be different between dots of the color elements. Thus, power consumption can be reduced and the life of a display element can be increased.

Note that, in this specification and the like, a gate refers to the whole of a gate electrode and a gate wiring (also referred to as a gate line, a gate signal line, a scan line, a scan signal line, or the like), or part thereof. A gate electrode refers to part of a conductive film that overlaps with a semiconductor included in a channel region, with a gate insulating film interposed therebetween. Note that part of the gate electrode can overlap with an LDD (lightly doped drain) region or a source region (or a drain region) with the gate insulating film therebetween. A gate wiring refers to a wiring for connecting gate electrodes of transistors, a wiring for connecting gate electrodes in pixels, or a wiring for connecting a gate electrode to another wiring.

Note that there is a portion (a region, a conductive film, a wiring, or the like) which serves as both a gate electrode and a gate wiring. Such a portion (a region, a conductive film, a wiring, or the like) may be referred to as either a gate electrode or a gate wiring. That is, there is a region where a gate electrode and a gate wiring cannot be clearly distinguished from each other. For example, in the case where a channel region overlaps with part of an extended gate wiring, the overlap portion (region, conductive film, wiring, or the like) functions as both a gate wiring and a gate electrode. Thus, such a portion (a region, a conductive film, a wiring, or the like) may be referred to as either a gate electrode or a gate wiring.

Note that a portion (a region, a conductive film, a wiring, or the like) which is formed of the same material as a gate electrode and forms the same island as the gate electrode to be connected to the gate electrode may also be referred to as a gate electrode. Similarly, a portion (a region, a conductive film, a wiring, or the like) which is formed of the same material as a gate wiring and forms the same island as the gate wiring to be connected to the gate wiring may also be referred to as a gate wiring. In a strict sense, such a portion (a region, a conductive film, a wiring, or the like) does not overlap with a channel region or does not have a function of connecting the gate electrode to another gate electrode in some cases. However, there is a portion (a region, a conductive film, a wiring, or the like) which is formed of the same material as a gate electrode or a gate wiring and forms the same island as the gate electrode or the gate wiring to be connected to the gate electrode or the gate wiring because of specifications in manufacturing, and the like. Thus, such a portion (a region, a conductive film, a wiring, or the like) may also be referred to as a gate electrode or a gate wiring.

For example, in a multi-gate transistor, a gate electrode is often connected to another gate electrode with the use of a conductive film formed using the same material as the gate electrode. Since such a portion (a region, a conductive film, a wiring, or the like) is a portion (a region, a conductive film, a wiring, or the like) for connecting a gate electrode to another gate electrode, the portion may be referred to as a gate wiring, or the portion may be referred to as a gate electrode because a multi-gate transistor can be considered as one transistor. That is, a portion (a region, a conductive film, a wiring, or the like) which is formed of the same material as a gate electrode or a gate wiring and forms the same island as the gate electrode or the gate wiring to be connected to the gate electrode or the gate wiring may be referred to as a gate electrode or a gate wiring. As another example, part of a conductive film that connects a gate electrode and a gate wiring and is formed using a material which is different from that of the gate electrode or the gate wiring may be referred to as either a gate electrode or a gate wiring.

Note that a gate terminal refers to part of a portion (a region, a conductive film, a wiring, or the like) of a gate electrode or part of a portion (a region, a conductive film, a wiring, or the like) which is electrically connected to the gate electrode.

In the case where a wiring is referred to as a gate wiring, a gate line, a gate signal line, a scan line, a scan signal line, or the like, a gate of a transistor is not connected to the wiring in some cases. In this case, the gate wiring, the gate line, the gate signal line, the scan line, or the scan signal line refers to a wiring formed in the same layer as the gate of the transistor, a wiring formed using the same material as the gate of the transistor, or a wiring formed at the same time as the gate of the transistor in some cases. Examples are a wiring for a storage capacitor, a power supply line, and a reference potential supply wiring.

A source refers to the whole or part of a source region, a source electrode, and a source wiring (also referred to as a source line, a source signal line, a data line, a data signal line, or the like). A source region refers to a semiconductor region containing a large amount of p-type impurities (e.g., boron or gallium) or n-type impurities (e.g., phosphorus or arsenic). Therefore, a region containing a small amount of p-type impurities or n-type impurities, that is, an LDD (lightly doped drain) region is not included in the source region in many cases. A source electrode is part of a conductive layer which is formed of a material different from that of a source region and is electrically connected to the source region. However, a source electrode and a source region may be collectively referred to as a source electrode. A source wiring refers to a wiring for connecting source electrodes of transistors, a wiring for connecting source electrodes in pixels, or a wiring for connecting a source electrode to another wiring.

However, there is a portion (a region, a conductive film, a wiring, or the like) functioning as both a source electrode and a source wiring. Such a portion (a region, a conductive film, a wiring, or the like) may be referred to as either a source electrode or a source wiring. That is to say, there is a region where a source electrode and a source wiring cannot be clearly distinguished from each other. For example, in the case where a source region overlaps with part of an extended source wiring, the overlap portion (region, conductive film, wiring, or the like) functions as both a source wiring and a source electrode. Accordingly, such a portion (a region, a conductive film, a wiring, or the like) may be called either a source electrode or a source wiring.

Note that a portion (a region, a conductive film, a wiring, or the like) which is formed using the same material as a source electrode and forms the same island as the source electrode to be connected to the source electrode, a portion (a region, a conductive film, a wiring, or the like) which connects a source electrode and another source electrode, or a portion (a region, a conductive film, a wiring, or the like) which overlaps with a source region may be referred to as a source electrode. Similarly, a region which is formed of the same material as a source wiring and forms the same island as the source wiring to be connected to the source wiring may also be referred to as a source wiring. In a strict sense, such a portion (a region, a conductive film, a wiring, or the like) does not have a function of connecting the source electrode to another source electrode in some cases. However, there is a portion (a region, a conductive film, a wiring, or the like) which is formed of the same material as a source electrode or a source wiring and forms the same island as the source electrode or the source wiring to be connected to the source electrode or the source wiring because of specifications in manufacturing, and the like. Thus, such a portion (a region, a conductive film, a wiring, or the like) may also be referred to as either a source electrode or a source wiring.

Note that, for example, part of a conductive film which connects a source electrode and a source wiring and is formed of a material different from that of the source electrode or the source wiring may also be referred to as either a source electrode or a source wiring.

Note that a source terminal refers to part of a source region, a source electrode, or a portion (a region, a conductive film, a wiring, or the like) which is electrically connected to the source electrode.

When a wiring is referred to as a source wiring, a source line, a source signal line, a data line, a data signal line, or the like, a source (drain) of a transistor is not connected to the wiring in some cases. In this case, the source wiring, the source line, the source signal line, the data line, or the data signal line refers to a wiring formed in the same layer as the source (drain) of the transistor, a wiring formed of the same material of the source (drain) of the transistor, or a wiring formed at the same time as the source (drain) of the transistor in some cases. Examples are a wiring for a storage capacitor, a power supply line, and a reference potential supply wiring.

Note that a drain is similar to the source.

Figure 9:
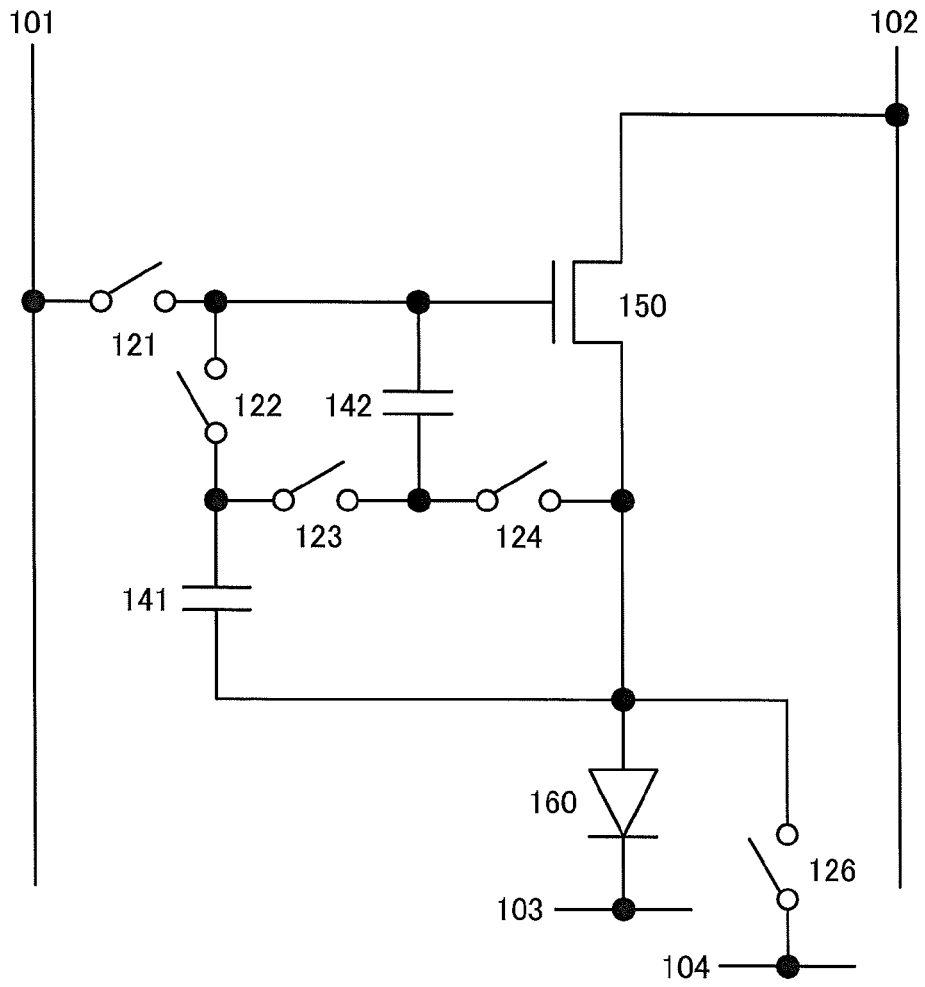
FIG. 9 illustrates a pixel circuit of one embodiment of the present invention.

The configuration of one embodiment of the present invention is not limited to the circuit configuration in FIG. 1. For example, one embodiment of the present invention may have a circuit configuration in FIG. 9. A circuit in FIG. 9 is different from those in FIG. 1 and FIG. 8 in that the switch 125 is not provided. In other words, the configuration of the circuit in FIG. 9 is similar to the configuration in FIG. 1 or FIG. 8 in which the switch 125 is constantly on. The operation of the pixel circuit in FIG. 9 will be described below. Note that a detailed description of part of the operation which is the same as that of the operation of the pixel circuit in FIG. 1 will be omitted.

When a switch is not provided as in FIG. 9, the circuit can be formed using a smaller number of transistors.

First, in an initialization period, the switch 121 is on, the switch 122 is on, the switch 123 is off, the switch 124 is on, and the switch 126 is on as in FIG. 2A.

At this time, the capacitor 141 and the capacitor 142 hold Vsig−V1.

Figure 25:
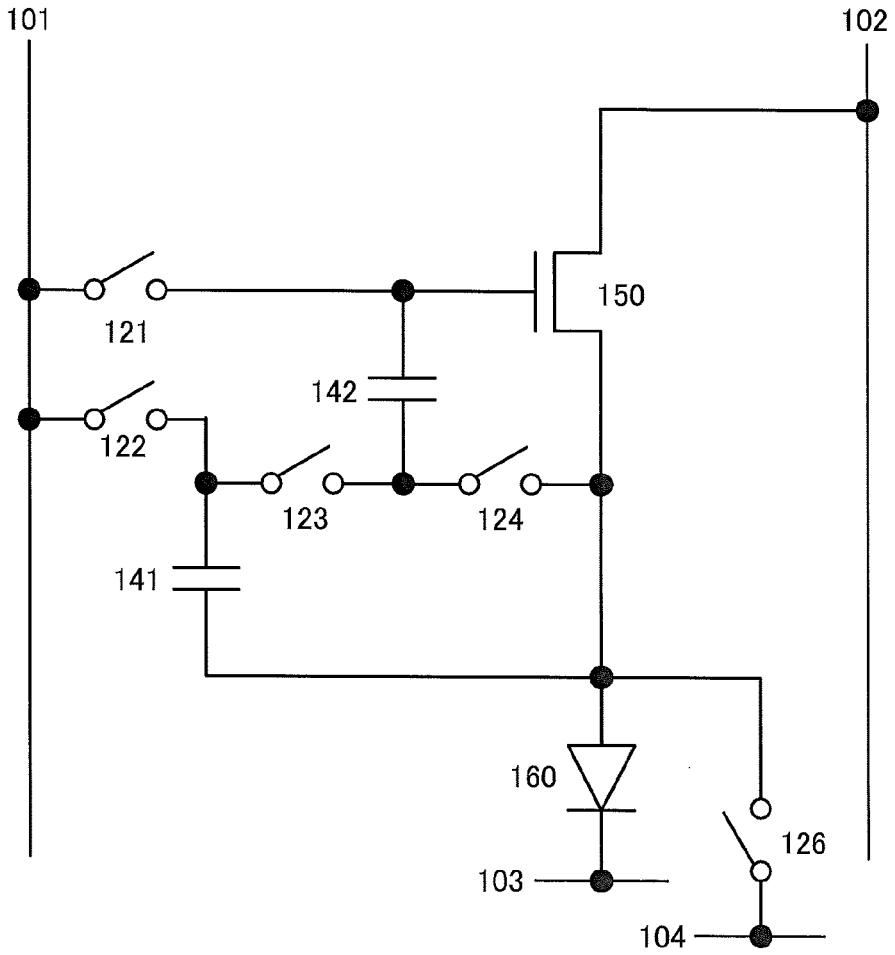
FIG. 25 illustrates a pixel circuit of one embodiment of the present invention.

Next, in a discharge period, the switch 121 is on, the switch 122 is off, the switch 123 is off, the switch 124 is on, and the switch 126 is off. The switch 122 is thus off in the discharge period, whereby a video signal held in the capacitor 141 can be prevented from being reduced. In this case, one electrode of the switch 122 may be connected to the wiring 101 instead of the gate of the transistor 150 as in FIG. 25.

Here, the potential of the source of the transistor 150 is gradually raised and then the transistor 150 is turned off or becomes in a state similar to the state where it is off. At this time, Vgs becomes equal to or substantially equal to Vth, and thus the capacitor 142 holds the voltage equal to or substantially equal to Vth. The capacitor 141 remains holding Vsig−V1.

If the potential of the source of the transistor 150 becomes too high at this time, the voltage across the light-emitting element 160 becomes higher than Velth in some cases. In such a case, a current might constantly pass through the light-emitting element 160. Thus, it is preferable to adjust the potential Vsig to a potential as low as possible so that the voltage across the light-emitting element 160 is a voltage lower than Velth. Particularly in the case where the transistor 150 is a depletion (normally-on) transistor, the potential of the source of the transistor 150 is more easily raised; therefore, it is preferable to adjust the potential Vsig to a potential as low as possible. For example, the upper limit of the potential Vsig may be lower than or equal to V2.

When the potential Vsig is lowered, the potential V1 is preferably lowered accordingly, in which case Vgs in a light emission period can be adjusted to an enough voltage.

Next, in a signal input termination period, the switch 121 is off, the switch 122 is off, the switch 123 is off, the switch 124 is on, and the switch 126 is on or off.

Here, the voltage (Vsig−V1) held in the capacitor 141 and the voltage (a voltage equal to or substantially equal to Vth) held in the capacitor 142 are determined.

Note that the switch 124 may be off in the signal input termination period.

The signal input termination period allows reduction of mixing of signals or noises due to overlapping of on/off switching operations of the switches. Note that the signal input termination period may be skipped; a signal addition period may start after the discharge period.

Next, in the signal addition period, the switch 121 is off, the switch 122 is off, the switch 123 is on, the switch 124 is off, and the switch 126 is on or off.

Here, the voltages of the capacitor 141 and the capacitor 142 are summed up, so that a voltage of Vsig+Vth is applied to the gate of the transistor 150.

The signal addition period allows reduction of mixing of signals or noises due to overlapping of on/off switching operations of the switches. Note that the signal addition period may be skipped; the light emission period may start after the discharge period or the signal input termination period.

Next, in the light emission period, the switch 121 is off, the switch 122 is off, the switch 123 is on, the switch 124 is off, and the switch 126 is off.

The switch 126 is turned off, so that a current flows through the light-emitting element 160 and the potential of the source of the transistor 150 is raised to V1+Vel. To the gate of the transistor 150, a voltage of Vsig+Vth+Vel is applied. At this time, Vgs of the transistor 150 becomes Vsig−V1+Vth corresponding to a potential difference between the gate and the source.

In the above manner, the light-emitting element can be prevented from being influenced by variations in Vth of the transistor 150 as in the pixel circuit in FIG. 1. Further, Vel can be prevented from being raised because of deterioration of the light-emitting element 160. Therefore, an image with a constant luminance can be displayed.

Figure 10:
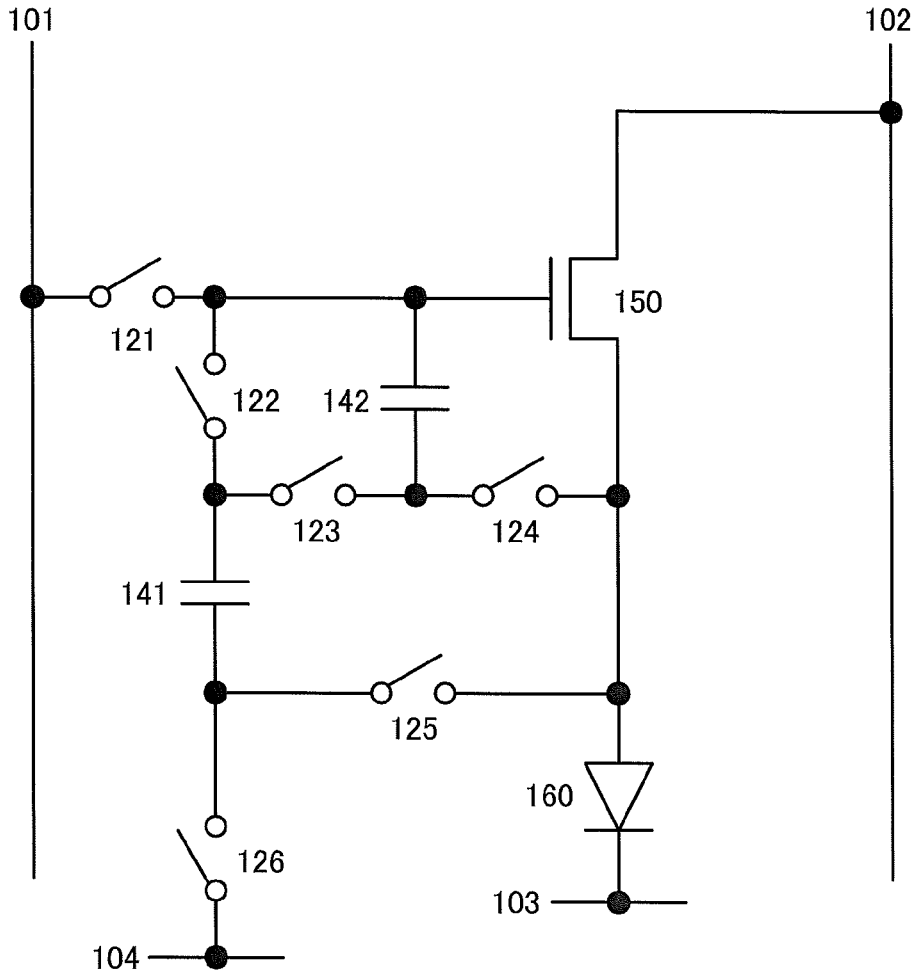
FIG. 10 illustrates a pixel circuit of one embodiment of the present invention.

One embodiment of the present invention may be a circuit configuration in FIG. 10. A circuit in FIG. 10 is different from that in FIG. 1 in the positions of the switch 125 and the switch 126; one electrode of the switch 125 and one electrode of the switch 126 are connected to the other electrode of the capacitor 141. The operation of the pixel circuit in FIG. 10 will be described below. Note that a detailed description of part of the operation which is the same as those of the operations of the pixel circuits in FIG. 1 and FIG. 9 will be omitted.

First, in an initialization period, the switch 121 is on, the switch 122 is on, the switch 123 is off, the switch 124 is on, the switch 125 is on, and the switch 126 is on.

At this time, the capacitor 141 and the capacitor 142 hold Vsig−V1.

Note that the switch 122 may be off in the initialization period, in which case the voltage is applied to the capacitor 141 in another period.

Next, in a discharge period, the switch 121 is on, the switch 122 is on, the switch 123 is off, the switch 124 is on, the switch 125 is off, and the switch 126 is on.

Here, the potential of the source of the transistor 150 is gradually raised and then the transistor 150 is turned off or becomes in a state similar to the state where it is off. At this time, Vgs becomes equal to or substantially equal to Vth, and thus the capacitor 142 holds the voltage equal to or substantially equal to Vth. The capacitor 141 remains holding Vsig−V1.

Note that the switch 126 may be off in the discharge period. Similarly, the switch 122 may be off. In the case where the switch 122 is off, the switch 125 may be either on or off. In the case where the switch 125 is on, the switch 126 is preferably off.

If the potential of the source of the transistor 150 becomes too high at this time, the voltage across the light-emitting element 160 becomes higher than Velth in some cases. In such a case, a current might constantly pass through the light-emitting element 160. Thus, it is preferable to adjust the potential Vsig to a potential as low as possible so that the voltage across the light-emitting element 160 is a voltage lower than Velth. Particularly in the case where the transistor 150 is a depletion (normally-on) transistor, the potential of the source of the transistor 150 is more easily raised; therefore, it is preferable to adjust the potential Vsig to a potential as low as possible. For example, the upper limit of the potential Vsig may be lower than or equal to V2.

When the potential Vsig is lowered, the potential V1 is preferably lowered accordingly, in which case Vgs in a light emission period can be adjusted to an enough voltage.

Next, in a signal input termination period, the switch 121 is off, the switch 122 is off, the switch 123 is off, the switch 124 is on, the switch 125 is off, and the switch 126 is on.

Here, the voltage (Vsig−V1) held in the capacitor 141 and the voltage (a voltage equal to or substantially equal to Vth) held in the capacitor 142 are determined.

Note that the switch 126 may be off in the signal input termination period. Similarly, the switch 124 may be off.

The signal input termination period allows reduction of mixing of signals or noises due to overlapping of on/off switching operations of the switches. Note that the signal input termination period may be skipped; a signal addition period may start after the discharge period.

Next, in a signal addition period, the switch 121 is off, the switch 122 is off, the switch 123 is on, the switch 124 is off, the switch 125 is off, and the switch 126 is on.

Here, the voltages of the capacitor 141 and the capacitor 142 are summed up, so that a voltage of Vsig+Vth is applied to the gate of the transistor 150.

Note that the switch 126 may be off in the signal addition period. Similarly, the switch 125 may be on.

The signal addition period allows reduction of mixing of signals or noises due to overlapping of on/off switching operations of the switches. Note that the signal addition period may be skipped; the light emission period may start after the discharge period or the signal input termination period.

Next, in the light emission period, the switch 121 is off, the switch 122 is off, the switch 123 is on, the switch 124 is off, the switch 125 is on, and the switch 126 is off.

The switch 126 is turned off, so that a current flows through the light-emitting element 160 and the potential of the source of the transistor 150 is raised to V1+Vel. To the gate of the transistor 150, a voltage of Vsig+Vth+Vel is applied. At this time, Vgs of the transistor 150 becomes Vsig−V1+Vth corresponding to a potential difference between the gate and the source.

In the above manner, the light-emitting element can be prevented from being influenced by variations in Vth of the transistor 150 as in the pixel circuit in FIG. 1. Further, Vel can be prevented from being raised because of deterioration of the light-emitting element 160. Therefore, an image with a constant luminance can be displayed.

Figure 26:
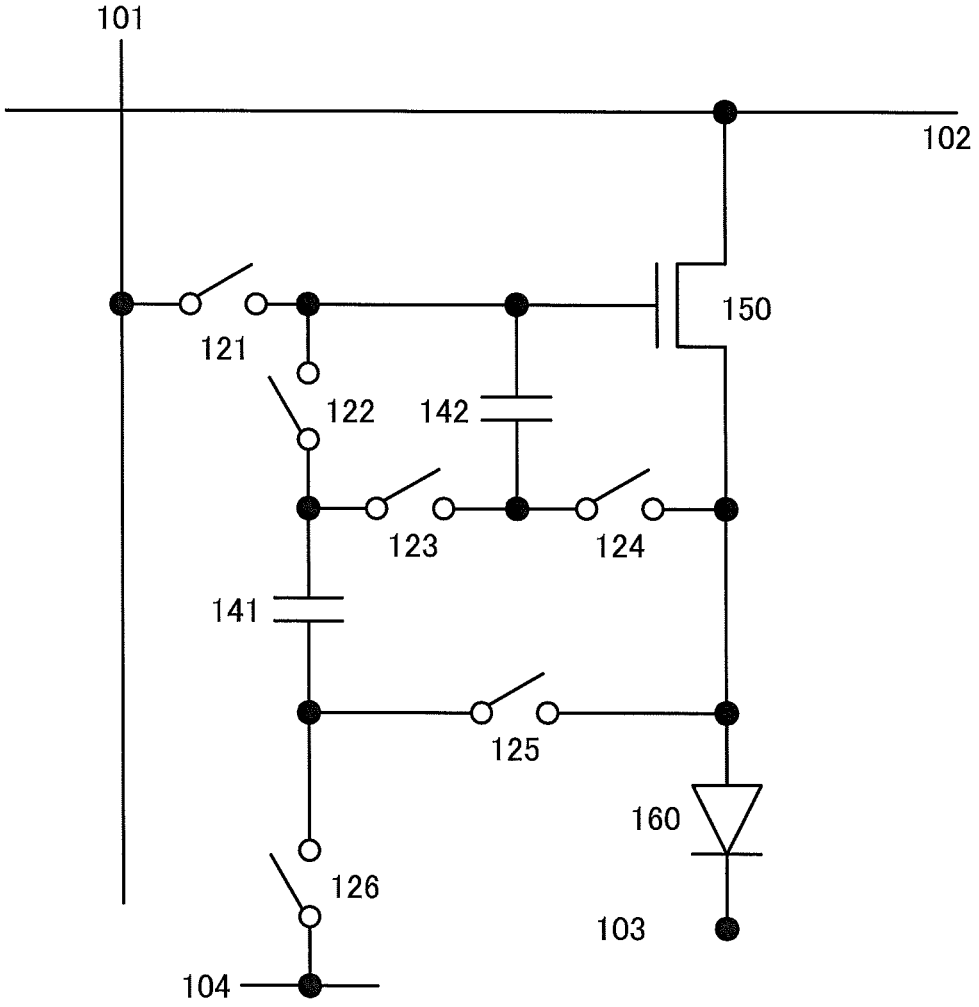
FIG. 26 illustrates a pixel circuit of one embodiment of the present invention.

In one embodiment of the present invention, the potential of the wiring 102 may be a pulsed potential in the circuit configuration of FIG. 10. FIG. 26 is a circuit diagram illustrating such a circuit configuration. The operation of the pixel circuit in FIG. 26 in the case where the potential of the wiring 102 is a pulsed potential will be described below. Note that a detailed description of part of the operation of the pixel circuit which is the same as those of the operations of the pixel circuits in FIG. 1, FIG. 9, and FIG. 10 will be omitted.

First, in a first initialization period, the wiring 102 is at Low level, the switch 121 is off, the switch 122 is on or off, the switch 123 is on or off, the switch 124 is on or off, the switch 125 is on or off, and the switch 126 is on or off.

Under the conditions, the potential of a node to which the transistor 150 and the light-emitting element 160 are connected can be lowered in advance. Therefore, in a second initialization period, a node to which the transistor 150 and the light-emitting element 160 are connected can be set to a given potential rapidly.

Note that the switch 121 may be on in the first initialization period.

Next, in a second initialization period, the wiring 102 is at High level, the switch 121 is on, the switch 122 is on, the switch 123 is off, the switch 124 is on, the switch 125 is on, and the switch 126 is on.

At this time, the capacitor 141 and the capacitor 142 hold Vsig−V1.

Figure 27:
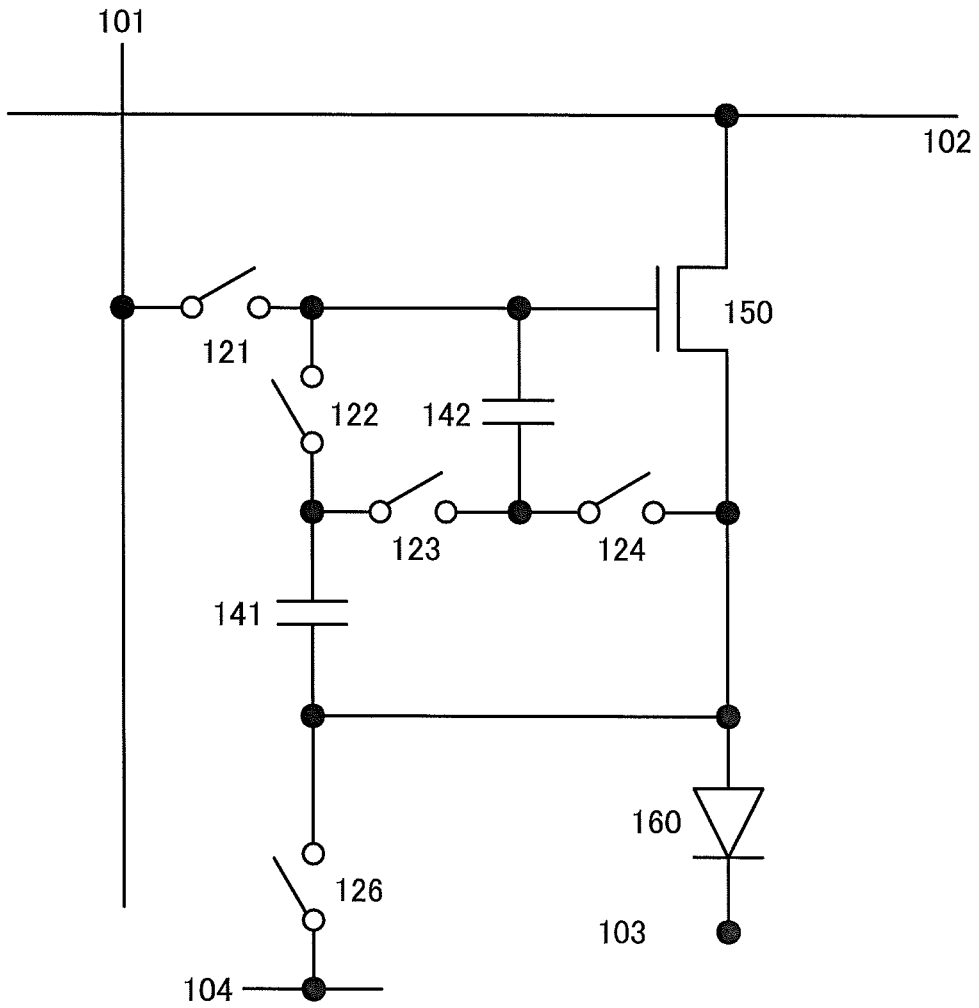
FIG. 27 illustrates a pixel circuit of one embodiment of the present invention.

Next, in a discharge period, the wiring 102 is at High level, the switch 121 is on, the switch 122 is on, the switch 123 is off, the switch 124 is on, the switch 125 is off, and the switch 126 is on. Note that when the switch 122 is turned off before the discharge period, a signal held in the capacitor 141 can be prevented from being reduced. In the case where such an operation is performed, the switch 125 can be omitted as in FIG. 27.

Here, the potential of the source of the transistor 150 is gradually raised and then the transistor 150 is turned off or becomes in a state similar to the state where it is off. At this time, Vgs becomes equal to or substantially equal to Vth, and thus the capacitor 142 holds the voltage equal to or substantially equal to Vth. The capacitor 141 remains holding Vsig−V1.

Next, in a signal input termination period, the wiring 102 is at High level, the switch 121 is off, the switch 122 is off, the switch 123 is off, the switch 124 is on, the switch 125 is off, and the switch 126 is on.

Here, the voltage (Vsig−V1) held in the capacitor 141 and the voltage (a voltage equal to or substantially equal to Vth) held in the capacitor 142 are determined.

Next, in a signal addition period, the wiring 102 is at High level, the switch 121 is off, the switch 122 is off, the switch 123 is on, the switch 124 is off, the switch 125 is off, and the switch 126 is on.

Here, the voltages of the capacitor 141 and the capacitor 142 are summed up, so that a voltage of Vsig+Vth is applied to the gate of the transistor 150.

Next, in a light emission period, the wiring 102 is at High level, the switch 121 is off, the switch 122 is off, the switch 123 is on, the switch 124 is off, the switch 125 is on, and the switch 126 is off.

The switch 126 is turned off, so that a current flows through the light-emitting element 160 and the potential of the source of the transistor 150 is raised to V1+Vel. To the gate of the transistor 150, a voltage of Vsig+Vth+Vel is applied. At this time, Vgs of the transistor 150 becomes Vsig−V1+Vth corresponding to a potential difference between the gate and the source.

In the above manner, the light-emitting element can be prevented from being influenced by variations in Vth of the transistor 150 as in the pixel circuit in FIG. 1. Further, Vel can be prevented from being raised because of deterioration of the light-emitting element 160. Therefore, an image with a constant luminance can be displayed.

In one embodiment of the present invention, the potential of the wiring 103 may be a pulsed potential in the circuit configuration of FIG. 10. The operation of the pixel circuit in FIG. 10 in the case where the potential of the wiring 103 is a pulsed potential will be described below. Note that a detailed description of part of the operation of the pixel circuit which is the same as those of the operations of the pixel circuits in FIG. 1 and FIG. 10 will be omitted.

First, in an initialization period, the wiring 103 is at Low level or High level, the switch 121 is on, the switch 122 is on, the switch 123 is off, the switch 124 is on, the switch 125 is on, and the switch 126 is on.

At this time, the capacitor 141 and the capacitor 142 hold Vsig−V1.

Next, in a discharge period, the wiring 103 is at High level, the switch 121 is on, the switch 122 is on, the switch 123 is off, the switch 124 is on, the switch 125 is off, and the switch 126 is on. Note that when the switch 122 is turned off before the discharge period, a signal held in the capacitor 141 can be prevented from being reduced. In the case where such an operation is performed, the switch 125 can be omitted as in FIG. 27.

Here, the potential of the source of the transistor 150 is gradually raised and then the transistor 150 is turned off. At this time, Vgs becomes Vth and thus the capacitor 142 holds Vth. The capacitor 141 remains holding Vsig−V1.

The potential of the wiring 103 is thus controlled, whereby the potential of the source of the transistor 150 can be raised without lowering the potential Vsig.

Next, in a signal input termination period, the wiring 103 is at High level, the switch 121 is off, the switch 122 is off, the switch 123 is off, the switch 124 is on, the switch 125 is off, and the switch 126 is on.

Here, the voltage (Vsig−V1) held in the capacitor 141 and the voltage (Vth) held in the capacitor 142 are determined.

Next, in a signal addition period, the wiring 103 is at High level, the switch 121 is off, the switch 122 is off, the switch 123 is on, the switch 124 is off, the switch 125 is off, and the switch 126 is on.

Here, the voltages of the wiring 104, the capacitor 141, and the capacitor 142 are summed up, so that a voltage of Vsig+Vth is applied to the gate of the transistor 150.

Next, in a light emission period, the wiring 103 is at Low-level, the switch 121 is off, the switch 122 is off, the switch 123 is on, the switch 124 is off, the switch 125 is on, and the switch 126 is off.

The switch 126 is turned off, so that a current flows through the light-emitting element 160 and the potential of the source of the transistor 150 is raised to V1+Vel. To the gate of the transistor 150, a voltage of Vsig+Vth+Vel is applied. At this time, Vgs of the transistor 150 becomes Vsig−V1+Vth corresponding to a potential difference between the gate and the source.

In the above manner, the light-emitting element can be prevented from being influenced by variations in Vth of the transistor 150 as in the pixel circuit in FIG. 1. Further, Vel can be prevented from being raised because of deterioration of the light-emitting element 160. Therefore, an image with a constant luminance can be displayed.

Figure 11:
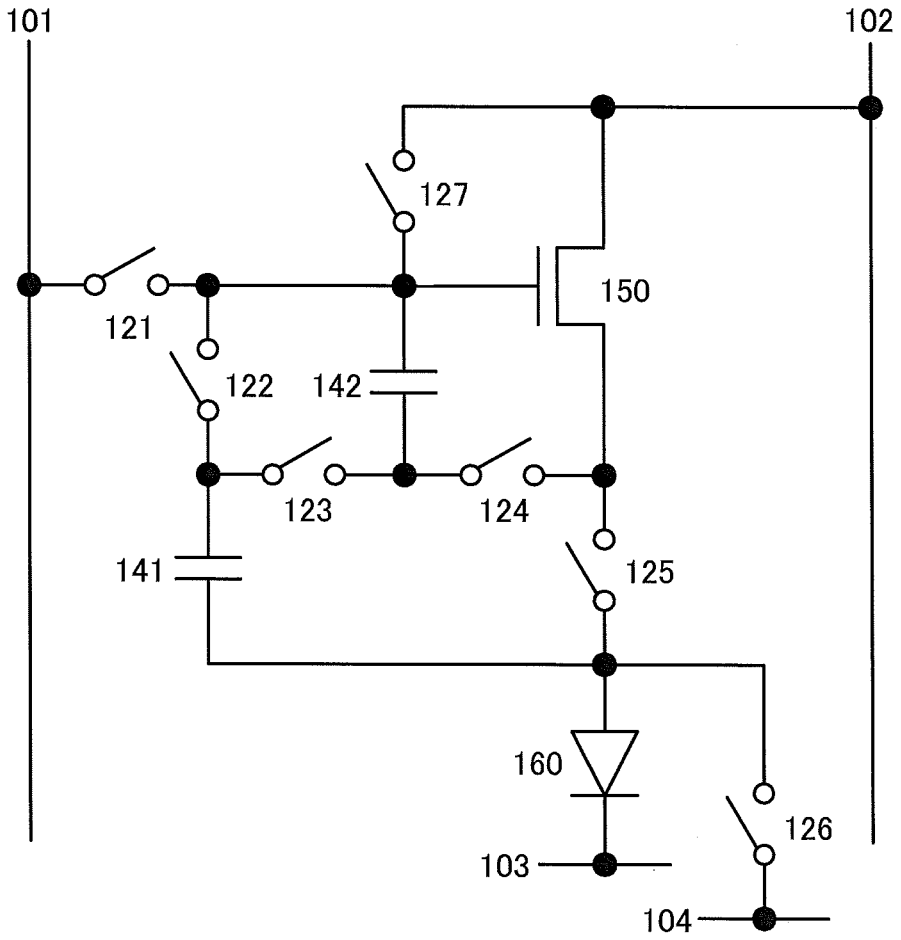
FIG. 11 illustrates a pixel circuit of one embodiment of the present invention.
Figure 30:
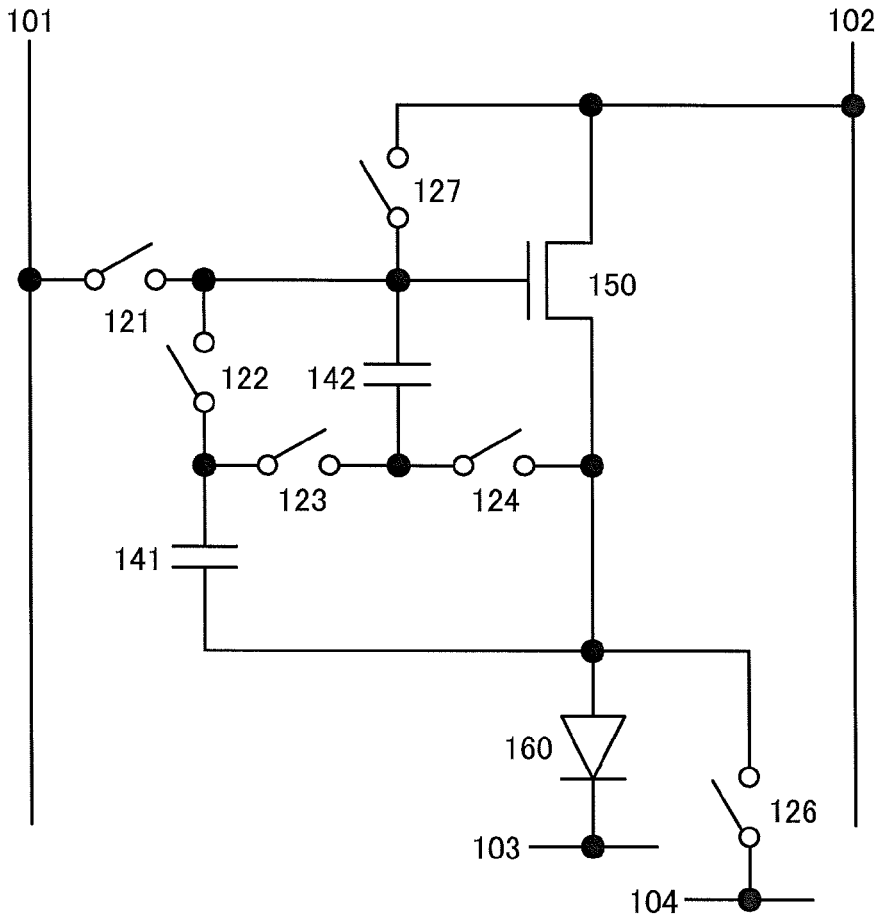
FIG. 30 illustrates a pixel circuit of one embodiment of the present invention.
Figure 31:
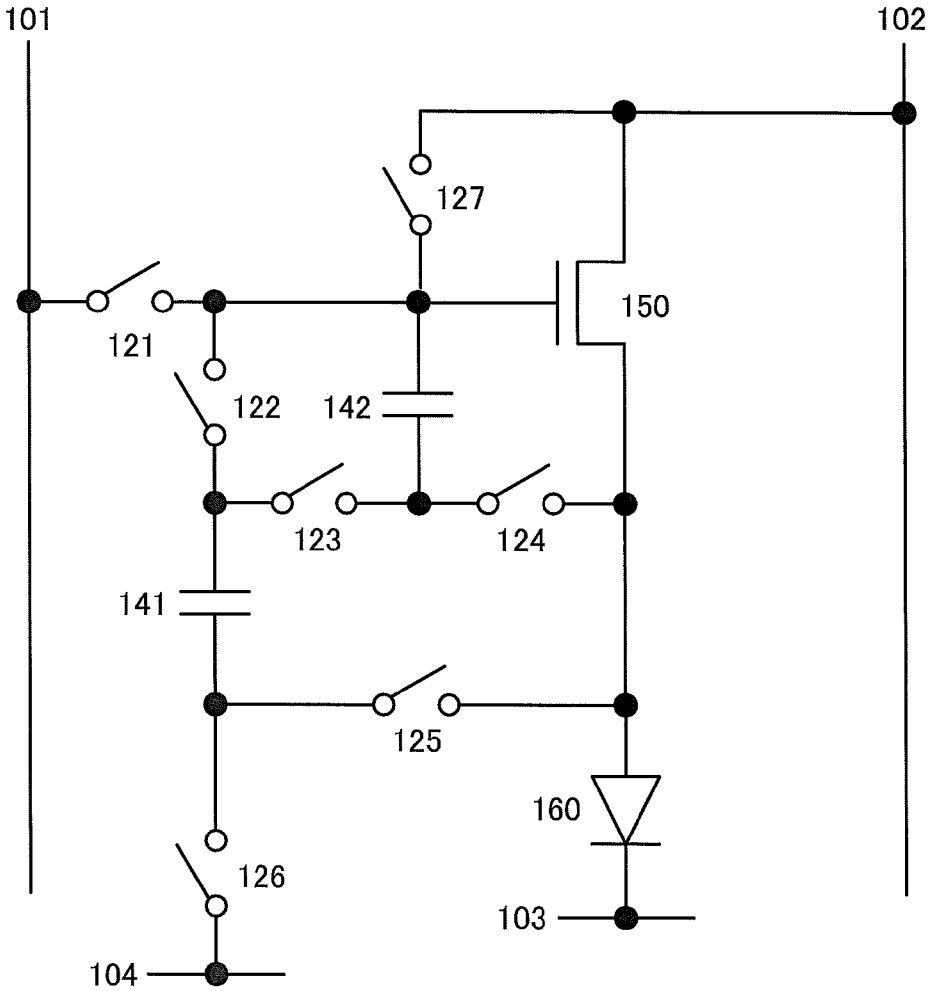
FIG. 31 illustrates a pixel circuit of one embodiment of the present invention.

One embodiment of the present invention may have a circuit configuration having a mobility correction function illustrated in FIG. 11. A circuit in FIG. 11 is different from that in FIG. 1 in that a switch 127 is provided between a gate and a drain of the transistor 150. The switch 127 can be provided also in a circuit other than the circuit in FIG. 1, such as the circuits in FIG. 9, FIG. 10, FIG. 25, FIG. 26, and FIG. 27. For example, FIG. 30 illustrates an example different from that in FIG. 9 in that the switch 127 is provided, and FIG. 31 illustrates an example different from that in FIG. 10 in that the switch 127 is provided. The operation of the pixel circuit illustrated in FIG. 11 will be described below. Note that a detailed description of part of the operation which is the same as that of the operation of the pixel circuit in FIG. 1 will be omitted.

A mobility correction period is provided after a signal addition period or before a light emission period. Note that the switch 127 is preferably off in periods other than the mobility correction period. Note that an embodiment of the present invention is not limited thereto.

In the mobility correction period, the switch 121 is off, the switch 122 is off, the switch 123 is on, the switch 124 is off, the switch 125 is on, the switch 126 is on or off, and the switch 127 is on.

Appropriate provision of the mobility correction period allows electric charge stored in the capacitor 142 and the capacitor 141 to be discharged, so that the gate potential of the transistor 150 can be intentionally changed in the negative direction. This change depends on the current-voltage characteristics of the transistor 150. For example, Vgs is slightly low when the mobility is low, whereas Vgs is lower when the mobility is high. In other words, Vgs depending on mobility can be obtained. That is to say, variations in mobility of the transistors 150 in pixels can be corrected.

Figure 12:
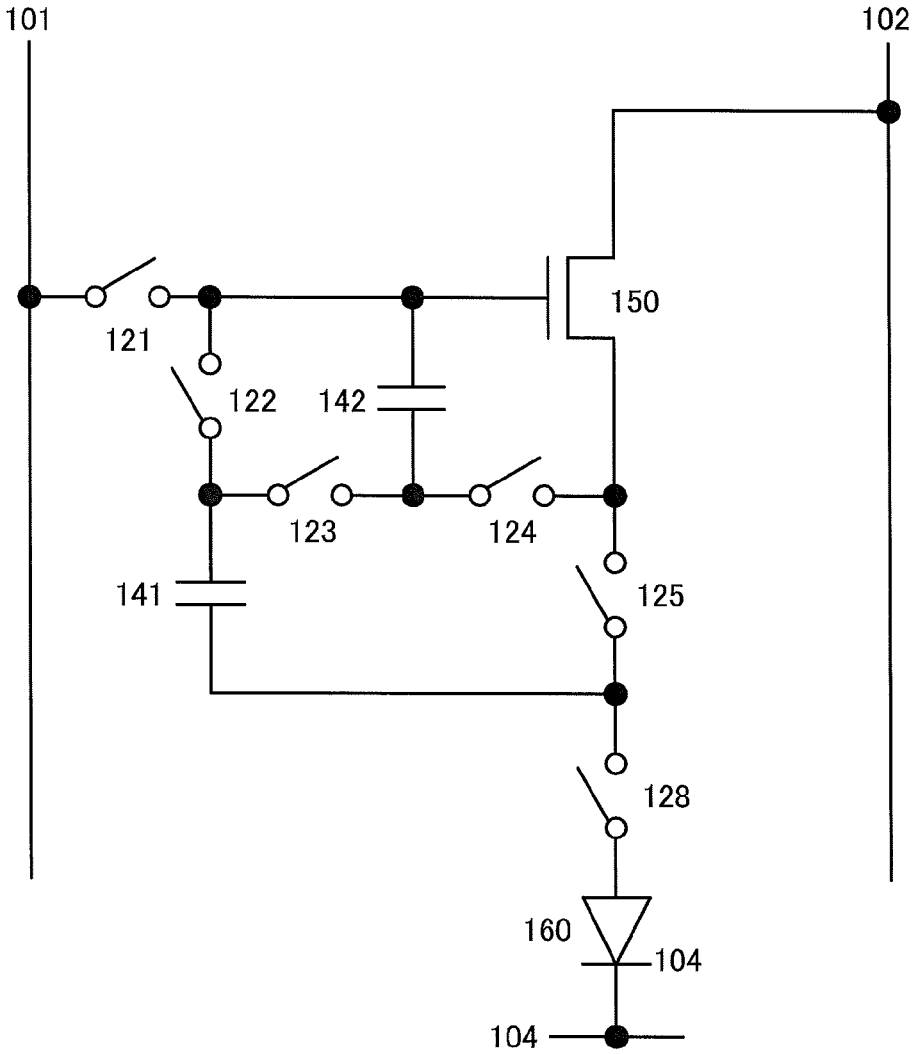
FIG. 12 illustrates a pixel circuit of one embodiment of the present invention.
Figure 32:
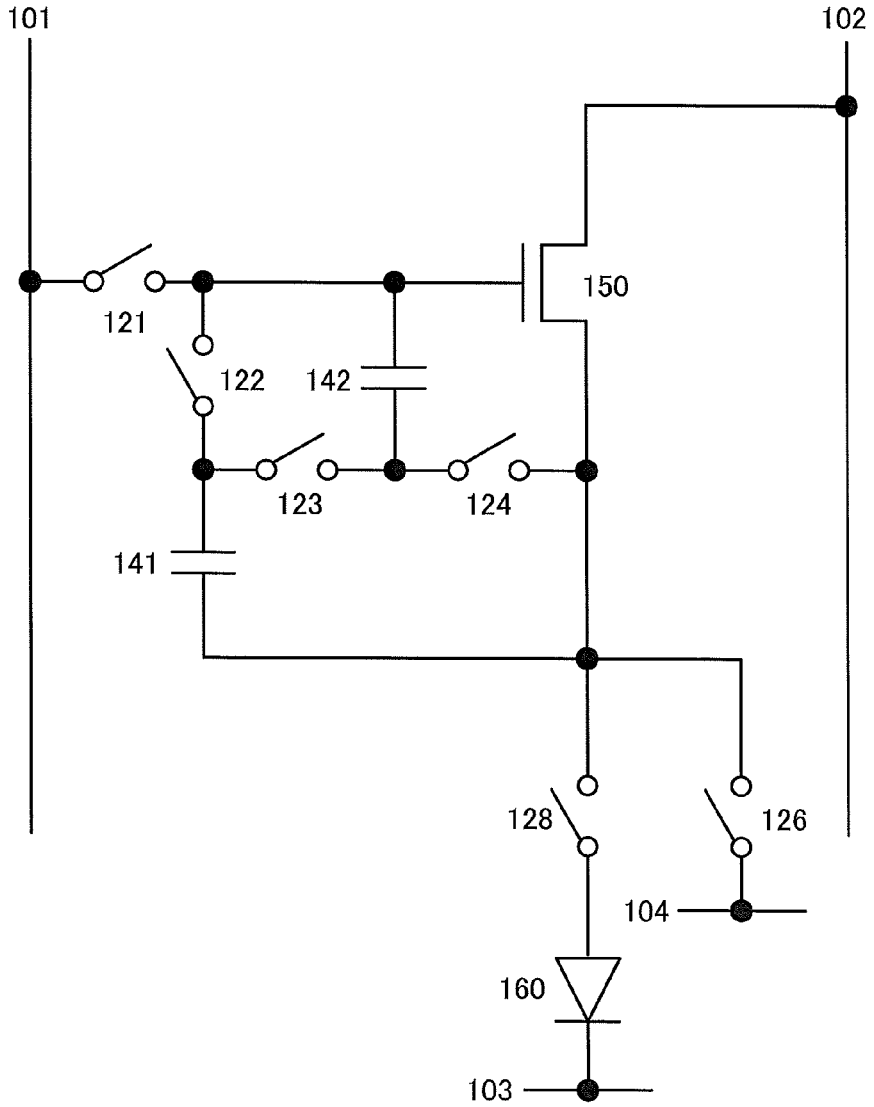
FIG. 32 illustrates a pixel circuit of one embodiment of the present invention.
Figure 33:
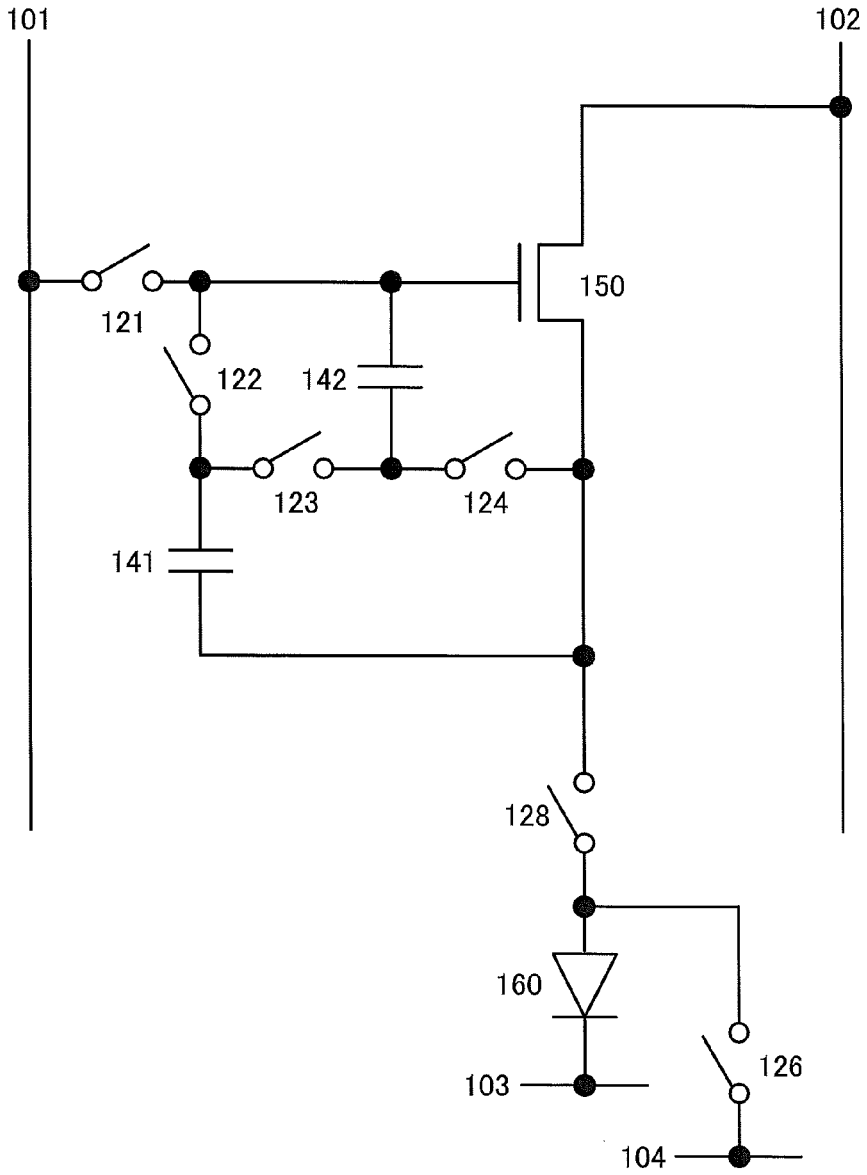
FIG. 33 illustrates a pixel circuit of one embodiment of the present invention.
Figure 34:
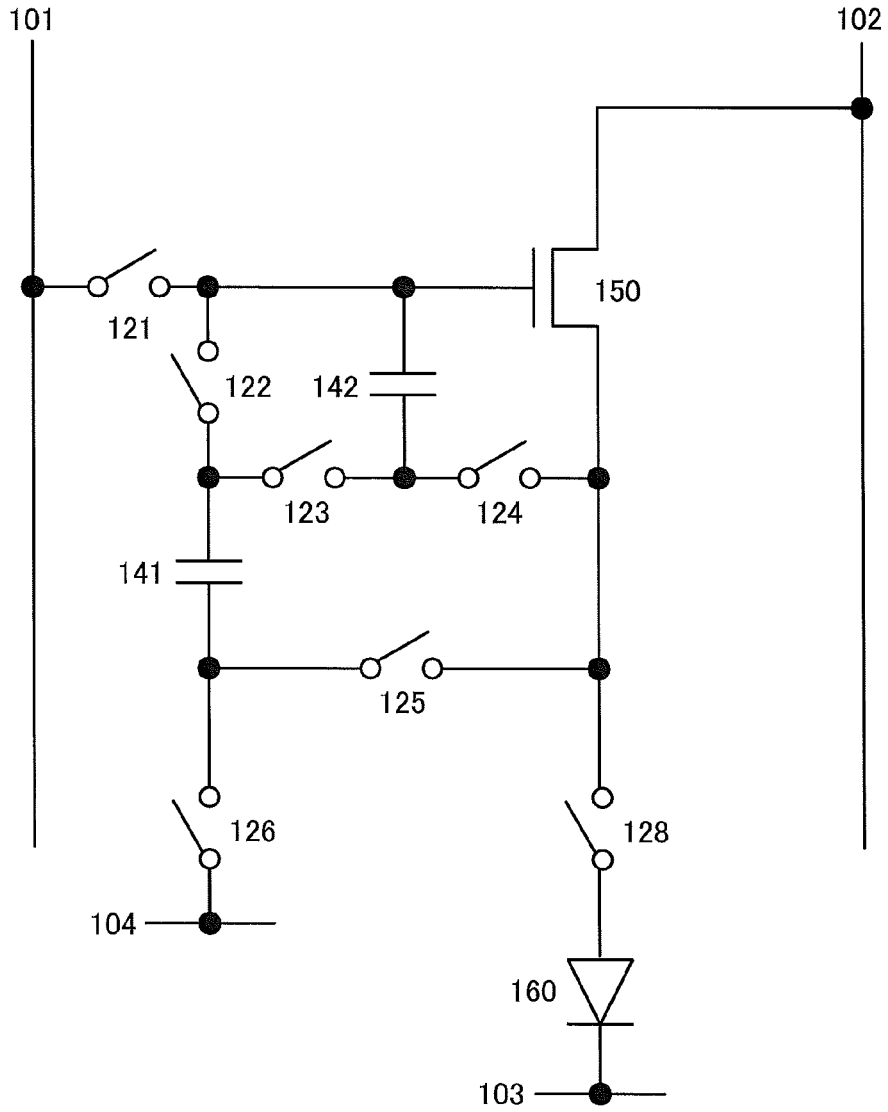
FIG. 34 illustrates a pixel circuit of one embodiment of the present invention.
Figure 35:
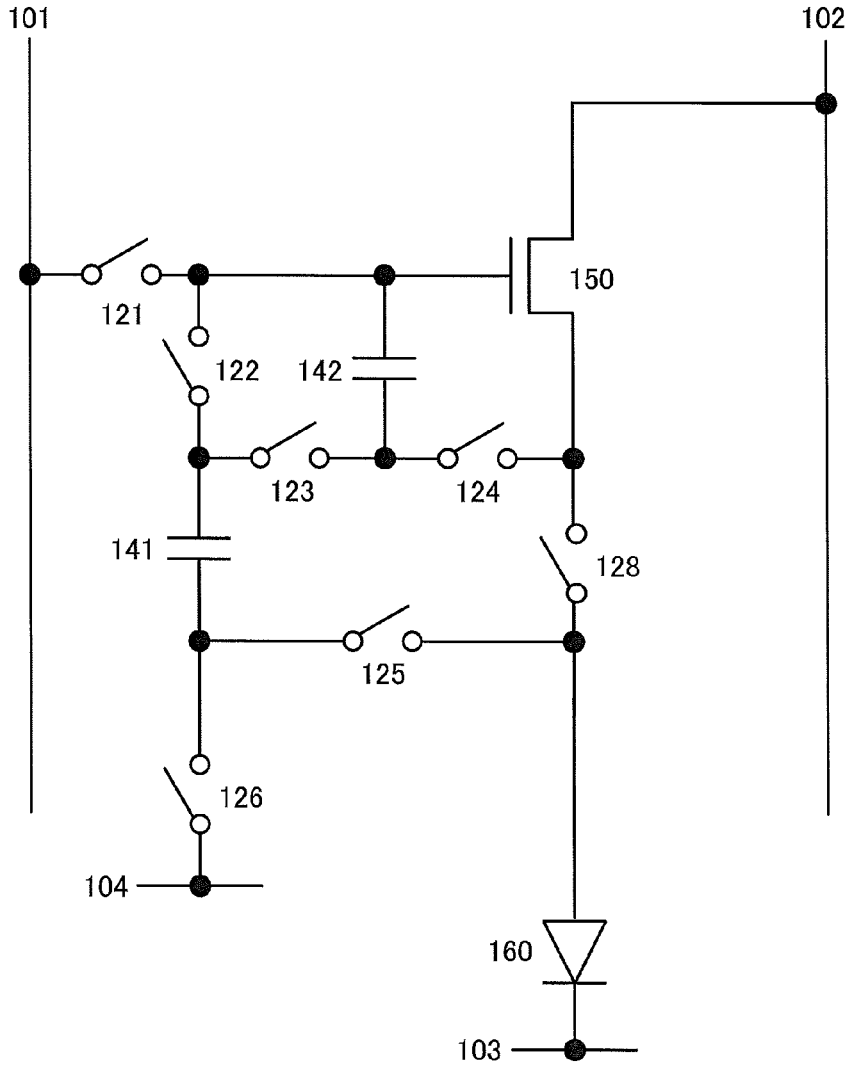
FIG. 35 illustrates a pixel circuit of one embodiment of the present invention.

One embodiment of the present invention may have a circuit configuration illustrated in FIG. 12. The operation of a pixel circuit illustrated in FIG. 12 will be described below. The circuit configuration in FIG. 12 is different from that in FIG. 1 in that a switch 128 is provided between the capacitor 141 and the light-emitting element 160 or between the switch 125 and the light-emitting element 160, the cathode electrode of the light-emitting element 160 is connected to the wiring 104, and the switch 126 is not provided. The switch 128 can be provided also in a circuit other than the circuit in FIG. 1, such as the circuits in FIGS. 8 to 11. For example, FIGS. 32 and 33 each illustrate an example different from that in FIG. 9 in that the switch 128 is provided, and FIGS. 34 and 35 each illustrate an example different from that in FIG. 10 in that the switch 128 is provided. Note that a detailed description of part of the operation which is the same as that of the operation of the pixel circuit in FIG. 1 will be omitted.

First, in an initialization period, the switch 121 is on, the switch 122 is on, the switch 123 is on, the switch 124 is on, the switch 125 is on, and the switch 128 is on. To the wiring 101, V1 is applied. Consequently, the potential of a node between the light-emitting element 160 and the switch 128 becomes V1. That is, the obtained state is similar to the state when the switch 126 is turned on in FIG. 2A.

Next, in a discharge period, the switch 121 is on, the switch 122 is on or off, the switch 123 is off, the switch 124 is on, the switch 125 is on or off, and the switch 128 is off. To the wiring 101, Vsig or a voltage higher than V1 is applied.

Here, the potential of the source of the transistor 150 is gradually raised and then the transistor 150 is turned off. At this time, Vgs becomes equal to or substantially equal to Vth and thus the capacitor 142 holds Vth.

Next, a signal input period is provided. In the signal input period, Vsig is supplied to the wiring 101, and the switch 121 is on, the switch 122 is on, the switch 123 is off, the switch 124 is off, the switch 125 is off, and the switch 128 is on, so that a voltage depending on Vsig is applied to the capacitor 141.

Note that the switch 125 may be turned on to supply electric charge which depends on the current characteristics of the transistor 150 from the transistor 150 to the capacitor 141.

Next, in a signal input termination period, the switch 121 is off, the switch 122 is off, the switch 123 is off, the switch 124 is on, the switch 125 is off, and the switch 128 is off.

Here, the voltage (a voltage equal to or substantially equal to Vsig−V1) held in the capacitor 141 and the voltage (a voltage equal to or substantially equal to Vth) held in the capacitor 142 are determined.

Next, in a signal addition period, the switch 121 is off, the switch 122 is off, the switch 123 is on, the switch 124 is off, the switch 125 is off, and the switch 128 is off.

Here, the voltages of the capacitor 141 and the capacitor 142 are summed up, so that a voltage of Vsig+Vth is applied to the gate of the transistor 150.

Next, in a light emission period, the switch 121 is off, the switch 122 is off, the switch 123 is on, the switch 124 is off, the switch 125 is on, and the switch 128 is on.

The switch 128 is turned on, so that a current flows through the light-emitting element 160 and the potential of the source of the transistor 150 is raised to V1+Vel. To the gate of the transistor 150, a voltage of Vsig+Vth+Vel is applied. At this time, Vgs of the transistor 150 becomes Vsig−V1+Vth corresponding to a potential difference between the gate and the source.

In the above manner, the light-emitting element can be prevented from being influenced by variations in Vth of the transistor 150 as in the pixel circuit in FIG. 1. Further, Vel can be prevented from being raised because of deterioration of the light-emitting element 160. Therefore, an image with a constant luminance can be displayed.

The configuration of a pixel circuit in a semiconductor device of one embodiment of the present invention is not limited to the configurations illustrated in FIG. 1 and FIGS. 8 to 12; some parts of the circuit configurations may be combined.

Note that FIG. 1 and FIGS. 8 to 12 each illustrate an example of a circuit configuration; thus, a transistor can be provided additionally. In each node in FIG. 1, FIGS. 8 to 12, and the like, it is also possible not to provide an additional transistor, switch, passive element, or the like.

Note that such an operation for correcting variations in the threshold voltage or the like of the transistor 150 is performed in this embodiment; however, one embodiment of the present invention is not limited thereto. For example, a current can be supplied to a load or the light-emitting element to operate the circuit without such an operation for correcting variations in threshold voltage.

In this embodiment, an example of a basic principle is described. Thus, part or the whole of this embodiment can be freely combined with or replaced with part or the whole of another embodiment.

Embodiment 2

In the above embodiment, a transistor included in the pixel of the display device is an n-channel transistor. In this embodiment, a circuit configuration where a transistor whose channel formation region is formed in an oxide semiconductor layer is used for the pixel of the display device will be particularly described.

Although a description is given assuming that the transistor 150 in the pixel circuit is simply an n-channel transistor in FIG. 1, an oxide semiconductor layer can be used for a channel formation region of the transistor.

The use of a transistor which includes a channel formation region in an oxide semiconductor layer as the transistor 150 enables the off-state current of the transistor to be reduced. Accordingly, the pixel can have a circuit configuration which does not easily allow malfunction.

Note that each switch included in the pixel circuit may be a transistor which includes a channel formation region in an oxide semiconductor layer. Specifically, a transistor including an oxide semiconductor can be used as each of the switches 121 to 126 illustrated in FIG. 1.

A transistor including an oxide semiconductor can be used as each of the transistors and the switches in the pixel circuits in FIGS. 8 to 12 which are described in Embodiment 1 as well as those in the pixel circuit in FIG. 1. Note that either all or any of the transistor and the switches in the pixel circuit may each be a transistor including an oxide semiconductor.

Note that an off-state current in this specification is a current which flows between a source and a drain when a transistor is off. In the case of an n-channel transistor (whose threshold voltage is, for example, approximately 0 V to 2 V), an off-state current refers to a current flowing between the source and the drain when a negative voltage is applied between the gate and the source.

Next, a material for an oxide semiconductor layer in which a channel formation region of a transistor is formed will be described below.

As the oxide semiconductor, for example, any of the following can be used: an indium oxide, a tin oxide, a zinc oxide, an In—Zn-based oxide, an Sn—Zn-based oxide, an Al—Zn-based oxide, a Zn—Mg-based oxide, a Sn—Mg-based oxide, an In—Mg-based oxide, an In—Ga-based oxide, an In—Ga—Zn-based oxide (also referred to as IGZO), an In—Al—Zn-based oxide, an In—Sn—Zn-based oxide, a Sn—Ga—Zn-based oxide, an Al—Ga—Zn-based oxide, a Sn—Al—Zn-based oxide, an In—Hf—Zn-based oxide, an In—La—Zn-based oxide, an In—Ce—Zn-based oxide, an In—Pr—Zn-based oxide, an In—Nd—Zn-based oxide, an In—Sm—Zn-based oxide, an In—Eu—Zn-based oxide, an In—Gd—Zn-based oxide, an In—Tb—Zn-based oxide, an In—Dy—Zn-based oxide, an In—Ho—Zn-based oxide, an In—Er—Zn-based oxide, an In—Tm—Zn-based oxide, an In—Yb—Zn-based oxide, an In—Lu—Zn-based oxide, an In—Sn—Ga—Zn-based oxide, an In—Hf—Ga—Zn-based oxide, an In—Al—Ga—Zn-based oxide, an In—Sn—Al—Zn-based oxide, an In—Sn—Hf—Zn-based oxide, and an In—Hf—Al—Zn-based oxide. The above oxide semiconductor may contain silicon.

Note that for example, an "In—Ga—Zn-based oxide" means an oxide containing In, Ga, and Zn and there is no particular limitation on the ratio of In, Ga, and Zn. The In—Ga—Z-based oxide may contain another metal element in addition to In, Ga, and Zn. Note that an In—Ga—Zn-based oxide has sufficiently high resistance when there is no electric field and thus an off-state current can be sufficiently reduced. In addition, also having high field-effect mobility, the In—Ga—Zn-based oxide is suitable for a semiconductor material used for a semiconductor device.

For example, an In—Ga—Zn-based oxide with an atomic ratio of In:Ga:Zn=1:1:1 (=1/3:1/3:1/3) or In:Ga:Zn=2:2:1 (=2/5:2/5:1/5), or any of oxides whose composition is in the neighborhood of the above compositions can be used. Alternatively, an In—Sn—Zn-based oxide with an atomic ratio of In:Sn:Zn=1:1:1 (=1/3:1/3:1/3), In:Sn:Zn=2:1:3 (=1/3:1/6:1/2), or In:Sn:Zn=2:1:5 (=1/4:1/8:5/8), or any of oxides whose composition is in the neighborhood of the above compositions may be used.

Note that one embodiment of the disclosed invention is not limited thereto, and a material having appropriate composition depending on semiconductor characteristics (mobility, threshold, variation, and the like) may be used. Further, it is preferable to appropriately set the carrier density, the impurity concentration, the defect density, the atomic ratio of a metal element and oxygen, the interatomic distance, the density, or the like in order to obtain necessary semiconductor characteristics.

Note that the oxide semiconductor film can be formed by a sputtering method using a target containing indium (In), gallium (Ga), and zinc (Zn). In the case of forming an In—Ga—Zn-based oxide semiconductor film by a sputtering method, it is preferable to use a target of an In—Ga—Zn-based oxide having an atomic ratio of In:Ga:Zn=1:1:1, 4:2:3, 3:1:2, 1:1:2, 2:1:3, or 3:1:4. When an oxide semiconductor film is formed using a target of an In—Ga—Zn-based oxide having the aforementioned atomic ratio, a polycrystal or CAAC is likely to be formed. The filling rate of the target including In, Ga, and Zn is greater than or equal to 90%, preferably greater than or equal to 95%. With the use of such a target with a high filling rate, a dense oxide semiconductor film is formed.

In the case where an In—Zn-based oxide material is used as an oxide semiconductor, a target of the In—Zn-based oxide has a composition ratio of In:Zn=50:1 to 1:2 in an atomic ratio ($In_2O_3$:ZnO=25:1 to 1:4 in a molar ratio), preferably In:Zn=20:1 to 1:1 in an atomic ratio ($In_2O_3$:ZnO=10:1 to 1:2 in a molar ratio), further preferably In:Zn=1.5:1 to 15:1 in an atomic ratio ($In_2O_3$:ZnO=3:4 to 15:2 in a molar ratio). For example, in a target used for formation of an oxide semiconductor film including an In—Zn-based oxide which has an atomic ratio of In:Zn:O=X:Y:Z, the relation of $Z>1.5X+Y$ is satisfied. The mobility can be improved by keeping the rate of Zn within the above range.

In the case of forming a film of an In—Sn—Zn-based oxide semiconductor as an oxide semiconductor film by a sputtering method, it is preferable to use an In—Sn—Zn—O target having the following atomic ratio: the atomic ratio of In:Sn:Zn is 1:1:1, 2:1:3, 1:2:2, or 20:45:35.

Specifically, the oxide semiconductor film may be formed as follows: the substrate is held in the treatment chamber kept at reduced pressure, a sputtering gas from which hydrogen and moisture have been removed is introduced into the treatment chamber from which remaining moisture is being removed, and the above target is used. The substrate temperature may be higher than or equal to 100° C. and lower than or equal to 600° C., preferably higher than or equal to 200° C. and lower than or equal to 400° C. in film formation. By forming the oxide semiconductor film in a state where the substrate is heated, the concentration of an impurity contained in the formed oxide semiconductor film can be reduced. In addition, damage due to sputtering can be reduced. In order to remove remaining moisture in the treatment chamber, an entrapment vacuum pump is preferably used. For example, a cryopump, an ion pump, or a titanium sublimation pump is preferably used. The exhaustion unit may be a turbo pump provided with a cold trap. In the treatment chamber which is exhausted with the cryopump, for example, a hydrogen atom, a compound including a hydrogen atom, such as water ($H_2O$), (more preferably, also a compound including a carbon atom), and the like are removed, whereby the concentration of the impurity contained in the oxide semiconductor film formed in the treatment chamber can be reduced.

Note that the oxide semiconductor film formed by sputtering or the like contains a large amount of moisture or hydrogen (including a hydroxyl group) as an impurity in some cases. Moisture and hydrogen each easily form a donor level and thus serves as an impurity in the oxide semiconductor. In order to reduce impurities such as moisture and hydrogen in the oxide semiconductor film (dehydrate or dehydrogenate the oxide semiconductor film), the oxide semiconductor film is subjected to heat treatment in a reduced-pressure atmosphere, an inert gas atmosphere of nitrogen, a rare gas, or the like, an oxygen gas atmosphere, or an ultra dry air (the air whose moisture amount is 20 ppm (−55° C. by conversion into a dew point) or less, preferably 1 ppm or less, more preferably 10 ppb or less, in the case where measurement is performed with a dew point meter in a cavity ring down laser spectroscopy (CRDS) method) atmosphere.

By performing the heat treatment on the oxide semiconductor film, moisture or hydrogen in the oxide semiconductor film can be eliminated. Specifically, the heat treatment may be performed at a temperature in the range of higher than or equal to 250° C. and lower than or equal to 750° C., preferably at a temperature in the range of higher than or equal to 400° C. and lower than the strain point of the substrate. For example, the heat treatment may be performed at 500° C. for approximately 3 minutes to 6 minutes. When an RTA method is used for the heat treatment, dehydration or dehydrogenation can be performed in a short time; therefore, the treatment can be performed even at a temperature in the range of higher than the strain point of a glass substrate.

Note that in some cases, through the heat treatment, oxygen is released from the oxide semiconductor film and oxygen vacancies are formed in the oxide semiconductor film. In this case, it is preferable that treatment for supplying oxygen to the oxide semiconductor film be performed after the heat treatment so that oxygen vacancies are reduced.

For example, heat treatment performed in an atmosphere containing oxygen allows oxygen to be supplied to the oxide semiconductor film. Heat treatment for supplying oxygen may be performed under conditions similar to those of the above heat treatment for reducing the concentration of moisture or hydrogen. Note that the heat treatment for supplying oxygen is performed in an atmosphere containing oxygen, such as an oxygen gas or an ultra dry air atmosphere (the moisture content is lower than or equal to 20 ppm (−55° C. by conversion into a dew point), preferably lower than or equal to 1 ppm, more preferably lower than or equal to 10 ppb, in the measurement with the use of a dew point meter of a cavity ring down laser spectroscopy (CRDS) system).

It is preferable that in the gas containing oxygen, the concentration of water or hydrogen be low. Specifically, the concentration of impurities in the gas containing oxygen is lower than or equal to 1 ppm, preferably lower than or equal to 0.1 ppm.

Alternatively, as a method for supplying oxygen to the oxide semiconductor film, an ion implantation method, an ion doping method, a plasma immersion ion implantation method, plasma treatment, or the like can be used. If a crystal part included in the oxide semiconductor film is damaged after oxygen is supplied to the oxide semiconductor film, heat treatment can be performed so that the damaged crystal part is repaired.

An insulating film containing oxygen may be used as an insulating film, such as a gate insulating film, which is in contact with the oxide semiconductor film so that oxygen is supplied from the insulating film to the oxide semiconductor film. The insulating film containing oxygen is preferably made to contain oxygen in a proportion higher than that in the stoichiometric composition by heat treatment in an oxygen atmosphere, oxygen doping, or the like. Oxygen doping means addition of oxygen to a semiconductor film. In addition, oxygen doping includes oxygen plasma doping in which oxygen which is made to be plasma is added to a semiconductor film. The oxygen doping may be performed using an ion implantation method or an ion doping method. Through oxygen doping treatment, an insulating film which includes a region where the proportion of oxygen is higher than that in the stoichiometric composition can be formed. Then, heat treatment is performed after formation of the insulating film containing oxygen, so that oxygen is supplied from the insulating film to the oxide semiconductor film. With the above structure, oxygen vacancies serving as donors can be reduced in the oxide semiconductor film and the stoichiometric composition of the oxide semiconductor included in the oxide semiconductor film can be satisfied. As a result, the oxide semiconductor film can be made substantially i-type and variations in electrical characteristics of the transistor due to oxygen vacancies can be reduced, which results in improvement of electrical characteristics.

Note that the heat treatment for supplying oxygen from the insulating film to the oxide semiconductor film is performed in an atmosphere of nitrogen, ultra dry air, or a rare gas (e.g., argon or helium) preferably at 200° C. to 400° C. inclusive, for example, 250° C. to 350° C. inclusive. It is preferable that the water content in the gas be 20 ppm or less, preferably 1 ppm or less, more preferably 10 ppb or less.

A structure of an oxide semiconductor film will be described below.

In this specification, a term "parallel" indicates that the angle formed between two straight lines is greater than or equal to −10° and less than or equal to 10°, and accordingly also includes the case where the angle is greater than or equal to −5° and less than or equal to 5°. In addition, a term "perpendicular" indicates that the angle formed between two straight lines is greater than or equal to 80° and less than or equal to 100°, and accordingly includes the case where the angle is greater than or equal to 85° and less than or equal to 95°.

In this specification, the trigonal and rhombohedral crystal systems are included in the hexagonal crystal system.

An oxide semiconductor film is classified roughly into a single-crystal oxide semiconductor film and a non-single-crystal oxide semiconductor film. The non-single-crystal oxide semiconductor film includes any of an amorphous oxide semiconductor film, a microcrystalline oxide semiconductor film, a polycrystalline oxide semiconductor film, a c-axis aligned crystalline oxide semiconductor (CAAC-OS) film, and the like.

The amorphous oxide semiconductor film has disordered atomic arrangement and no crystalline component. A typical example thereof is an oxide semiconductor film in which no crystal part exists even in a microscopic region, and the whole of the film is amorphous.

The microcrystalline oxide semiconductor film includes a microcrystal (also referred to as nanocrystal) with a size greater than or equal to 1 nm and less than 10 nm, for example. Thus, the microcrystalline oxide semiconductor film has a higher degree of atomic order than the amorphous oxide semiconductor film. Hence, the density of defect states of the microcrystalline oxide semiconductor film is lower than that of the amorphous oxide semiconductor film.

The CAAC-OS film is one of oxide semiconductor films including a plurality of crystal parts, and most of the crystal parts each fit inside a cube whose one side is less than 100 nm. Thus, there is a case where a crystal part included in the CAAC-OS film fits inside a cube whose one side is less than 10 nm, less than 5 nm, or less than 3 nm. The density of defect states of the CAAC-OS film is lower than that of the microcrystalline oxide semiconductor film. The CAAC-OS film is described in detail below.

In a transmission electron microscope (TEM) image of the CAAC-OS film, a boundary between crystal parts, that is, a grain boundary is not clearly observed. Thus, in the CAAC-OS film, a reduction in electron mobility due to the grain boundary is less likely to occur.

According to the TEM image of the CAAC-OS film observed in a direction substantially parallel to a sample surface (cross-sectional TEM image), metal atoms are arranged in a layered manner in the crystal parts. Each metal atom layer has a morphology reflected by a surface over which the CAAC-OS film is formed (hereinafter, a surface over which the CAAC-OS film is formed is referred to as a formation surface) or a top surface of the CAAC-OS film, and is arranged in parallel to the formation surface or the top surface of the CAAC-OS film.

On the other hand, according to the TEM image of the CAAC-OS film observed in a direction substantially perpendicular to the sample surface (plan TEM image), metal atoms are arranged in a triangular or hexagonal configuration in the crystal parts. However, there is no regularity of arrangement of metal atoms between different crystal parts.

From the results of the cross-sectional TEM image and the plan TEM image, alignment is found in the crystal parts in the CAAC-OS film.

A CAAC-OS film is subjected to structural analysis with an X-ray diffraction (XRD) apparatus. For example, when the CAAC-OS film including an $InGaZnO_4$ crystal is analyzed by an out-of-plane method, a peak appears frequently when the diffraction angle (2θ) is around 31°. This peak is derived from the (009) plane of the $InGaZnO_4$ crystal, which indicates that crystals in the CAAC-OS film have c-axis alignment, and that the c-axes are aligned in a direction substantially perpendicular to the formation surface or the top surface of the CAAC-OS film.

On the other hand, when the CAAC-OS film is analyzed by an in-plane method in which an X-ray enters a sample in a direction substantially perpendicular to the c-axis, a peak appears frequently when 28 is around 56°. This peak is derived from the (110) plane of the $InGaZnO_4$ crystal. Here, analysis (0 scan) is performed under conditions where the sample is rotated around a normal vector of a sample surface as an axis (ϕ axis) with 20 fixed at around 56°. In the case where the sample is a single-crystal oxide semiconductor film of $InGaZnO_4$, six peaks appear. The six peaks are derived from crystal planes equivalent to the (110) plane. On the other hand, in the case of a CAAC-OS film, a peak is not clearly observed even when 0 scan is performed with 2θfixed at around 56°.

According to the above results, in the CAAC-OS film having c-axis alignment, while the directions of a-axes and b-axes are different between crystal parts, the c-axes are aligned in a direction parallel to a normal vector of a formation surface or a normal vector of a top surface. Thus, each metal atom layer arranged in a layered manner observed in the cross-sectional TEM image corresponds to a plane parallel to the a-b plane of the crystal.

Note that the crystal part is formed concurrently with deposition of the CAAC-OS film or is formed through crystallization treatment such as heat treatment. As described above, the c-axis of the crystal is aligned in a direction parallel to a normal vector of a formation surface or a normal vector of a top surface. Thus, for example, in the case where a shape of the CAAC-OS film is changed by etching or the like, the c-axis might not be necessarily parallel to a normal vector of a formation surface or a normal vector of a top surface of the CAAC-OS film.

Further, the degree of crystallinity in the CAAC-OS film is not necessarily uniform. For example, in the case where crystal growth leading to the CAAC-OS film occurs from the vicinity of the top surface of the film, the degree of the crystallinity in the vicinity of the top surface is higher than that in the vicinity of the formation surface in some cases. Further, when an impurity is added to the CAAC-OS film, the crystallinity in a region to which the impurity is added is changed, and the degree of crystallinity in the CAAC-OS film varies depending on regions.

Note that when the CAAC-OS film with an $InGaZnO_4$ crystal is analyzed by an out-of-plane method, a peak of 2θ may also be observed at around 36°, in addition to the peak of 2θ at around 31°. The peak of 2θ at around 36° indicates that a crystal having no c-axis alignment is included in part of the CAAC-OS film. It is preferable that in the CAAC-OS film, a peak of 28 appear at around 31° and a peak of 2θ do not appear at around 36°.

In a transistor using the CAAC-OS film, change in electric characteristics due to irradiation with visible light or ultraviolet light is small. Thus, the transistor has high reliability.

Note that an oxide semiconductor film may be a stacked film including two or more films of an amorphous oxide semiconductor film, a microcrystalline oxide semiconductor film, and a CAAC-OS film, for example.

Examples of a crystal structure of the CAAC-OS film are described in detail with reference to FIGS. 18A to 18E, FIGS. 19A to 19C, FIGS. 20A to 20C, and FIGS. 21A and 21B. In FIGS. 18A to 18E, FIGS. 19A to 19C, FIGS. 20A to 20C, and FIGS. 21A and 21B, the vertical direction corresponds to the c-axis direction and a plane perpendicular to the c-axis direction corresponds to the a-b plane, unless otherwise specified. When the terms "upper half" and "lower half" are simply used, they refer to an upper half above the a-b plane and a lower half below the a-b plane (an upper half and a lower half with respect to the a-b plane). Furthermore, in FIGS. 18A to 18E, 0 surrounded by a circle represents a tetracoordinate O atom and O surrounded by a double circle represents a tricoordinate O atom.

Figure 18A:
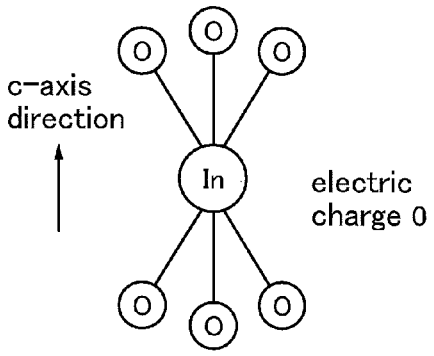
FIGS. 18A to 18E each illustrate an example of a semiconductor layer of one embodiment of the present invention.

FIG. 18A illustrates a structure including one hexacoordinate In atom and six tetracoordinate oxygen atoms (hereinafter referred to as tetracoordinate O atoms) proximate to the In atom. Here, a structure including one metal atom and oxygen atoms proximate thereto is referred to as a small group. The structure in FIG. 18A is actually an octahedral structure, but is illustrated as a planar structure for simplicity. Note that three tetracoordinate O atoms exist in each of an upper half and a lower half in FIG. 18A. In the small group illustrated in FIG. 18A, electric charge is 0.

Figure 18D:
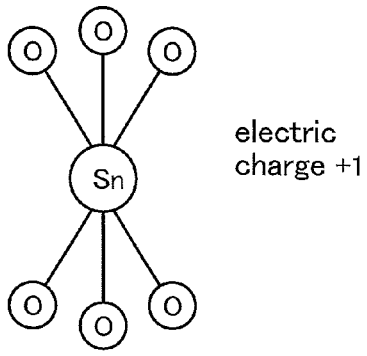
Figure 18B:
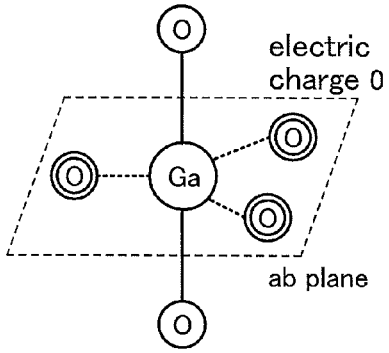

FIG. 18B illustrates a structure including one pentacoordinate Ga atom, three tricoordinate oxygen atoms (hereinafter referred to as tricoordinate O atoms) proximate to the Ga atom, and two tetracoordinate O atoms proximate to the Ga atom. All the tricoordinate O atoms exist on the a-b plane. One tetracoordinate O atom exists in each of an upper half and a lower half in FIG. 18B. An In atom can also have the structure illustrated in FIG. 18B because an In atom can have five ligands. In the small group illustrated in FIG. 18B, electric charge is 0.

Figure 18E:
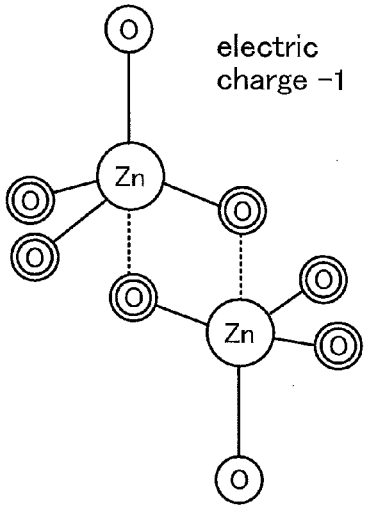
Figure 18C:
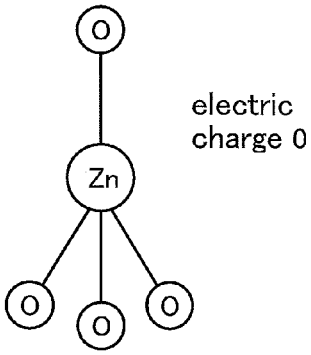

FIG. 18C illustrates a structure including one tetracoordinate Zn atom and four tetracoordinate O atoms proximate to the Zn atom. In FIG. 18C, one tetracoordinate O atom exists in an upper half and three tetracoordinate O atoms exist in a lower half. Alternatively, three tetracoordinate O atoms may exist in the upper half and one tetracoordinate O atom may exist in the lower half in FIG. 18C. In the small group illustrated in FIG. 18C, electric charge is 0.

FIG. 18D illustrates a structure including one hexacoordinate Sn atom and six tetracoordinate O atoms proximate to the Sn atom. In FIG. 18D, three tetracoordinate O atoms exist in each of an upper half and a lower half. In the small group illustrated in FIG. 18D, electric charge is +1.

FIG. 18E illustrates a small group including two Zn atoms. In FIG. 18E, one tetracoordinate O atom exists in each of an upper half and a lower half. In the small group illustrated in FIG. 18E, electric charge is −1.

Here, a plurality of small groups forms a medium group, and a plurality of medium groups forms a large group.

Now, a rule of bonding between the small groups is described. The three O atoms in the upper half with respect to the hexacoordinate In atom in FIG. 18A each have three proximate In atoms in the downward direction, and the three O atoms in the lower half each have three proximate In atoms in the upward direction. The one O atom in the upper half with respect to the pentacoordinate Ga atom in FIG. 18B has one proximate Ga atom in the downward direction, and the one O atom in the lower half has one proximate Ga atom in the upward direction. The one O atom in the upper half with respect to the tetracoordinate Zn atom in FIG. 18C has one proximate Zn atom in the downward direction, and the three O atoms in the lower half each have three proximate Zn atoms in the upward direction. In this manner, the number of tetracoordinate O atoms above a metal atom is equal to the number of metal atoms proximate to and below each of the tetracoordinate O atoms. Similarly, the number of tetracoordinate O atoms below a metal atom is equal to the number of metal atoms proximate to and above each of the tetracoordinate O atoms. Since the coordination number of the tetracoordinate O atom is 4, the sum of the number of metal atoms proximate to and below the O atom and the number of metal atoms proximate to and above the O atom is 4. Accordingly, when the sum of the number of tetracoordinate O atoms above a metal atom and the number of tetracoordinate O atoms below another metal atom is 4, the two kinds of small groups including the metal atoms can be bonded. The reason is described below. For example, in the case where the hexacoordinate metal (In or Sn) atom is bonded through three tetracoordinate O atoms in the lower half, it is bonded to the pentacoordinate metal (Ga or In) atom or the tetracoordinate metal (Zn) atom.

A metal atom whose coordination number is 4, 5, or 6 is bonded to another metal atom through a tetracoordinate O atom in the c-axis direction. In addition to the above, a medium group can be formed in a different manner by combining a plurality of small groups so that the total electric charge of the layered structure is 0.

Figure 19A:
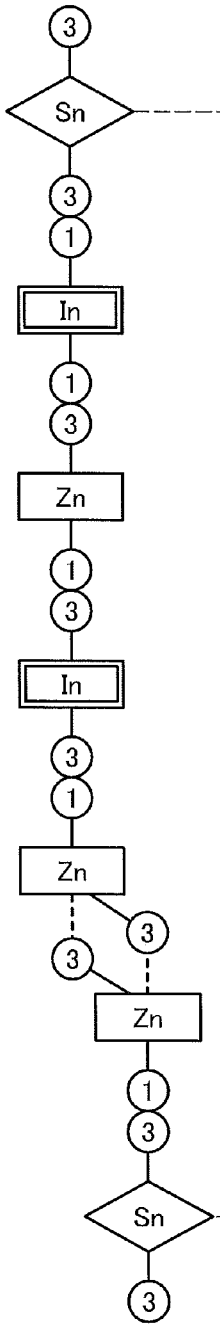
FIGS. 19A to 19C illustrate an example of a semiconductor layer of one embodiment of the present invention.
Figure 19B:
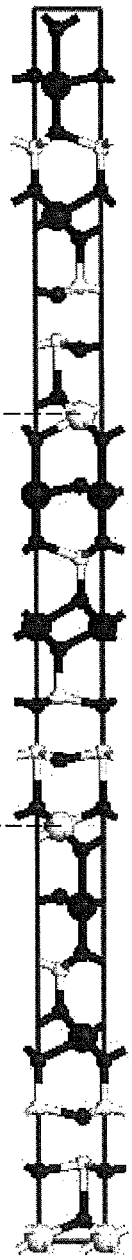
Figure 19C:
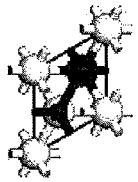

FIG. 19A illustrates a model of a medium group included in a layered structure of an In—Sn—Zn-based oxide. FIG. 19B illustrates a large group including three medium groups. Note that FIG. 19C illustrates an atomic arrangement in the case where the layered structure in FIG. 19B is observed from the c-axis direction.

In FIG. 19A, a tricoordinate O atom is omitted for simplicity, and a tetracoordinate O atom is illustrated by a circle; the number in the circle shows the number of tetracoordinate O atoms. For example, three tetracoordinate O atoms existing in each of an upper half and a lower half with respect to a Sn atom is denoted by circled 3. In a similar manner, in FIG. 19A, one tetracoordinate O atom existing in each of an upper half and a lower half with respect to an In atom is denoted by circled 1. FIG. 19A also illustrates a Zn atom proximate to one tetracoordinate O atom in a lower half and three tetracoordinate O atoms in an upper half, and a Zn atom proximate to one tetracoordinate O atom in an upper half and three tetracoordinate O atoms in a lower half.

In the medium group included in the layered structure of the In—Sn—Zn-based oxide in FIG. 19A, in the order starting from the top, a Sn atom proximate to three tetracoordinate O atoms in each of an upper half and a lower half is bonded to an In atom proximate to one tetracoordinate O atom in each of an upper half and a lower half, the In atom is bonded to a Zn atom proximate to three tetracoordinate O atoms in an upper half, the Zn atom is bonded to an In atom proximate to three tetracoordinate O atoms in each of an upper half and a lower half through one tetracoordinate O atom in a lower half with respect to the Zn atom, the In atom is bonded to a small group that includes two Zn atoms and is proximate to one tetracoordinate O atom in an upper half, and the small group is bonded to a Sn atom proximate to three tetracoordinate O atoms in each of an upper half and a lower half through one tetracoordinate O atom in a lower half with respect to the small group. A plurality of such medium groups is bonded, so that a large group is formed.

Here, electric charge for one bond of a tricoordinate O atom and electric charge for one bond of a tetracoordinate O atom can be assumed to be −0.667 and −0.5, respectively. For example, electric charge of a (hexacoordinate or pentacoordinate) In atom, electric charge of a (tetracoordinate) Zn atom, and electric charge of a (pentacoordinate or hexacoordinate) Sn atom are +3, +2, and +4, respectively. Accordingly, electric charge of a small group including a Sn atom is +1. Therefore, electric charge of −1, which cancels +1, is needed to form a layered structure including a Sn atom. As a structure having electric charge of −1, the small group including two Zn atoms as illustrated in FIG. 18E can be given. For example, with one small group including two Zn atoms, electric charge of one small group including a Sn atom can be cancelled, so that the total electric charge of the layered structure can be 0.

Specifically, when the large group illustrated in FIG. 19B is repeated, an In—Sn—Zn-based oxide crystal ($In_2SnZn_3O_8$) can be obtained. Note that a layered structure of the obtained In—Sn—Zn-based oxide crystal can be expressed as a composition formula, $In_2SnZn_2O_7(ZnO)_m$ (m is 0 or a natural number).

The above-described rule also applies to the following oxides: an In—Sn—Ga—Zn-based oxide, an In—Ga—Zn-based oxide (also referred to as IGZO), an In—Al—Zn-based oxide, a Sn—Ga—Zn-based oxide, an Al—Ga—Zn-based oxide, a Sn—Al—Zn-based oxide, an In—Hf—Zn-based oxide, an In—La—Zn-based oxide, an In—Ce—Zn-based oxide, an In—Pr—Zn-based oxide, an In—Nd—Zn-based oxide, an In—Sm—Zn-based oxide, an In—Eu—Zn-based oxide, an In—Gd—Zn-based oxide, an In—Tb—Zn-based oxide, an In—Dy—Zn-based oxide, an In—Ho—Zn-based oxide, an In—Er—Zn-based oxide, an In—Tm—Zn-based oxide, an In—Yb—Zn-based oxide, an In—Lu—Zn-based oxide, an In—Zn-based oxide, a Sn—Zn-based oxide, an Al—Zn-based oxide, a Zn—Mg-based oxide, a Sn—Mg-based oxide, an In—Mg-based oxide, an In—Ga-based oxide, an In-based oxide, an Sn-based oxide, a Zn-based oxide, and the like.

As an example, FIG. 20A illustrates a model of a medium group included in a layered structure of an In—Ga—Zn-based oxide.

In the medium group included in the layered structure of the In—Ga—Zn-based oxide in FIG. 20A, in the order starting from the top, an In atom proximate to three tetracoordinate O atoms in each of an upper half and a lower half is bonded to a Zn atom proximate to one tetracoordinate O atom in an upper half, the Zn atom is bonded to a Ga atom proximate to one tetracoordinate O atom in each of an upper half and a lower half through three tetracoordinate O atoms in a lower half with respect to the Zn atom, and the Ga atom is bonded to an In atom proximate to three tetracoordinate O atoms in each of an upper half and a lower half through the one tetracoordinate O atom in the lower half with respect to the Ga atom. A plurality of such medium groups is bonded, so that a large group is formed.

FIG. 20B illustrates a large group including three medium groups. Note that FIG. 20C illustrates an atomic arrangement in the case where the layered structure in FIG. 20B is observed from the c-axis direction.

Here, since electric charge of a (hexacoordinate or pentacoordinate) In atom, electric charge of a (tetracoordinate) Zn atom, and electric charge of a (pentacoordinate) Ga atom are +3, +2, and +3, respectively, electric charge of a small group including any of an In atom, a Zn atom, and a Ga atom is 0. As a result, the total electric charge of a medium group having a combination of such small groups is always 0.

In order to form the layered structure of the In—Ga—Zn-based oxide, a large group can be formed using not only the medium group illustrated in FIG. 20A but also a medium group in which the arrangement of the In atom, the Ga atom, and the Zn atom is different from that in FIG. 20A.

Specifically, when the large group illustrated in FIG. 20B is repeated, an In—Ga—Zn-based oxide crystal can be obtained. Note that a layered structure of the obtained In—Ga—Zn-based oxide crystal can be expressed as a composition formula, $InGaO_3(ZnO)_n$ (n is a natural number).

Figure 21A:
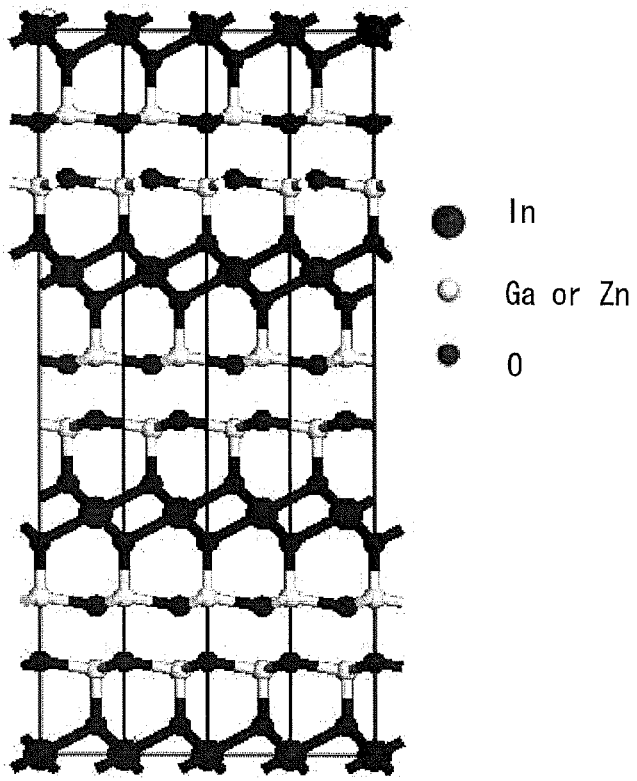
FIGS. 21A and 21B each illustrate an example of a semiconductor layer of one embodiment of the present invention.

In the case of n=1 ($InGaZnO_4$), a crystal structure illustrated in FIG. 21A can be obtained, for example. Note that, in the crystal structure in FIG. 21A, since a Ga atom and an In atom each have five ligands as described with reference to FIG. 18B, a structure where Ga is replaced with In can be obtained.

Figure 21B:
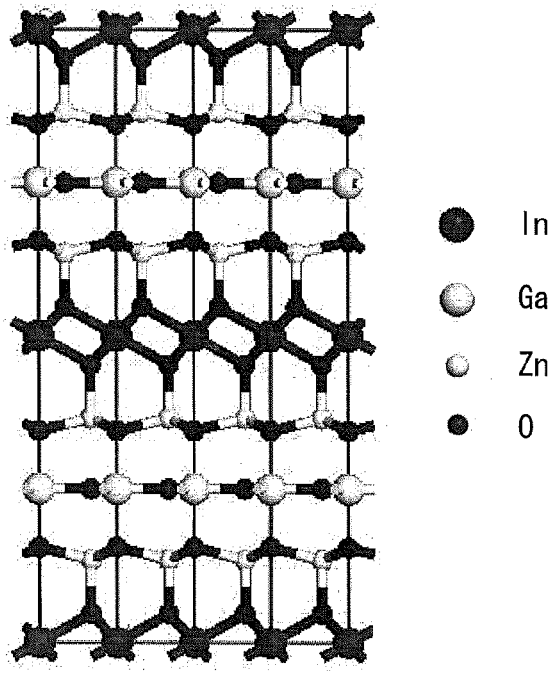

In the case of n=2 ($InGaZn_2O_5$), a crystal structure illustrated in FIG. 21B can be obtained, for example. Note that, in the crystal structure in FIG. 21B, since a Ga atom and an In atom each have five ligands as described with reference to FIG. 18B, a structure where Ga is replaced with In can be obtained.

For example, a CAAC-OS film can be deposited by a sputtering method using a polycrystalline oxide semiconductor sputtering target. When ions collide with the sputtering target, a crystal region included in the sputtering target may be separated from the target along an a-b plane; in other words, a sputtered particle having a plane parallel to an a-b plane (flat-plate-like sputtered particle or pellet-like sputtered particle) may flake off from the sputtering target. In that case, the flat-plate-like sputtered particle reaches a substrate while keeping its crystal state, whereby the CAAC-OS film can be formed over the substrate.

For the deposition of the CAAC-OS film, the following conditions are preferably used.

By reducing the mixing of impurities during the deposition, the crystal state can be prevented from being broken by the impurities. For example, the concentration of impurities (e.g., hydrogen, water, carbon dioxide, or nitrogen) which exist in the deposition chamber may be reduced. Furthermore, the concentration of impurities in a deposition gas may be reduced. Specifically, a deposition gas whose dew point is −80° C. or lower, preferably −100° C. or lower is used.

By increasing the substrate heating temperature during the deposition, migration of a sputtered particle is likely to occur after the sputtered particle is attached to a substrate surface. Specifically, the substrate heating temperature during the deposition is higher than or equal to 100° C. and lower than or equal to 740° C., preferably higher than or equal to 200° C. and lower than or equal to 500° C. By increasing the substrate heating temperature during the deposition, when the flat-plate-like sputtered particle reaches the substrate, migration occurs on the substrate surface, so that a flat plane of the flat-plate-like sputtered particle is attached to the substrate.

Furthermore, it is preferable that the proportion of oxygen in the deposition gas be increased and the power be optimized in order to reduce plasma damage at the deposition. The proportion of oxygen in the deposition gas is 30 vol % or higher, preferably 100 vol %.

As an example of the sputtering target, an In—Ga—Zn-based oxide target is described below.

The polycrystalline In—Ga—Zn-based oxide target is made by mixing $InO_X$ powder, $GaO_Y$ powder, and $ZnO_Z$ powder in a predetermined molar ratio, applying pressure, and performing heat treatment at a temperature higher than or equal to 1000° C. and lower than or equal to 1500° C. Note that X, Y, and Z are each a given positive number. Here, the predetermined molar ratio of $InO_X$ powder to $GaO_Y$ powder and $ZnO_Z$ powder is, for example, 2:2:1, 8:4:3, 3:1:1, 1:1:1, 4:2:3, or 3:1:2. The kinds of powders and the molar ratio for mixing the powders may be determined as appropriate depending on the desired sputtering target.

This embodiment is obtained by performing change, addition, modification, removal, application, superordinate conceptualization, or subordinate conceptualization on part or the whole of another embodiment. Thus, part of or the whole of this embodiment can be freely combined with or replaced with part of or the whole of another embodiment.

Embodiment 3

In this embodiment, the structure of a display device (also referred to as a display panel) including the pixel circuit described in Embodiment 1 will be described with reference to FIGS. 22A and 22B.

Note that a display device refers to a device having a display element. The display device may include a plurality of pixels each including a display element. The display device may include a peripheral driver circuit for driving the plurality of pixels. The peripheral driver circuit for driving the plurality of pixels may be formed over the same substrate as the plurality of pixels. The display device may include a peripheral driver circuit provided over a substrate by wiring bonding or bump bonding, namely, an IC chip connected by chip on glass (COG) or an IC chip connected by TAB or the like. The display device may include a flexible printed circuit (FPC) to which an IC chip, a resistor, a capacitor, an inductor, a transistor, or the like is attached. The display device may include a printed wiring board (PWB) which is connected through a flexible printed circuit (FPC) and to which an IC chip, a resistive element, a capacitor, an inductor, a transistor, or the like is attached. The display device may include an optical sheet such as a polarizing plate or a retardation plate. The display device may include a lighting device, a housing, an audio input and output device, a light sensor, or the like.

Note that the lighting device may include a backlight unit, a light guide plate, a prism sheet, a diffusion sheet, a reflective sheet, a light source (e.g., an LED or a cold cathode fluorescent lamp), a cooling device (e.g., a water cooling device or an air cooling device), or the like.

In addition, a light-emitting device refers to a device including a light-emitting element or the like. A light-emitting device including a light-emitting element as a display element is a specific example of a display device.

Note that a reflective device refers to a device including a light-reflecting element, a light diffraction element, a light-reflecting electrode, or the like.

A liquid crystal display device refers to a display device including a liquid crystal element. Liquid crystal display devices include a direct-view liquid crystal display, a projection liquid crystal display, a transmissive liquid crystal display, a reflective liquid crystal display, a transflective liquid crystal display, and the like.

A driving device refers to a device including a semiconductor element, an electric circuit, an electronic circuit and/or the like. Examples of the driving device are a transistor which controls input of a signal from a source signal line to a pixel (also referred to as a selection transistor, a switching transistor, or the like), a transistor which supplies a voltage or a current to a pixel electrode, and a transistor which supplies a voltage or a current to a light-emitting element. Other examples of the driving device are a circuit which supplies a signal to a gate signal line (also referred to as a gate driver, a gate line driver circuit, or the like) and a circuit which supplies a signal to a source signal line (also referred to as a source driver, a source line driver circuit, or the like).

Note that a display device, a semiconductor device, a lighting device, a cooling device, a light-emitting device, a reflecting device, a driving device, and the like are provided together in some cases. For example, a display device includes a semiconductor device and a light-emitting device in some cases. Alternatively, a semiconductor device includes a display device and a driving device in some cases.

Figures 22A, 22B:
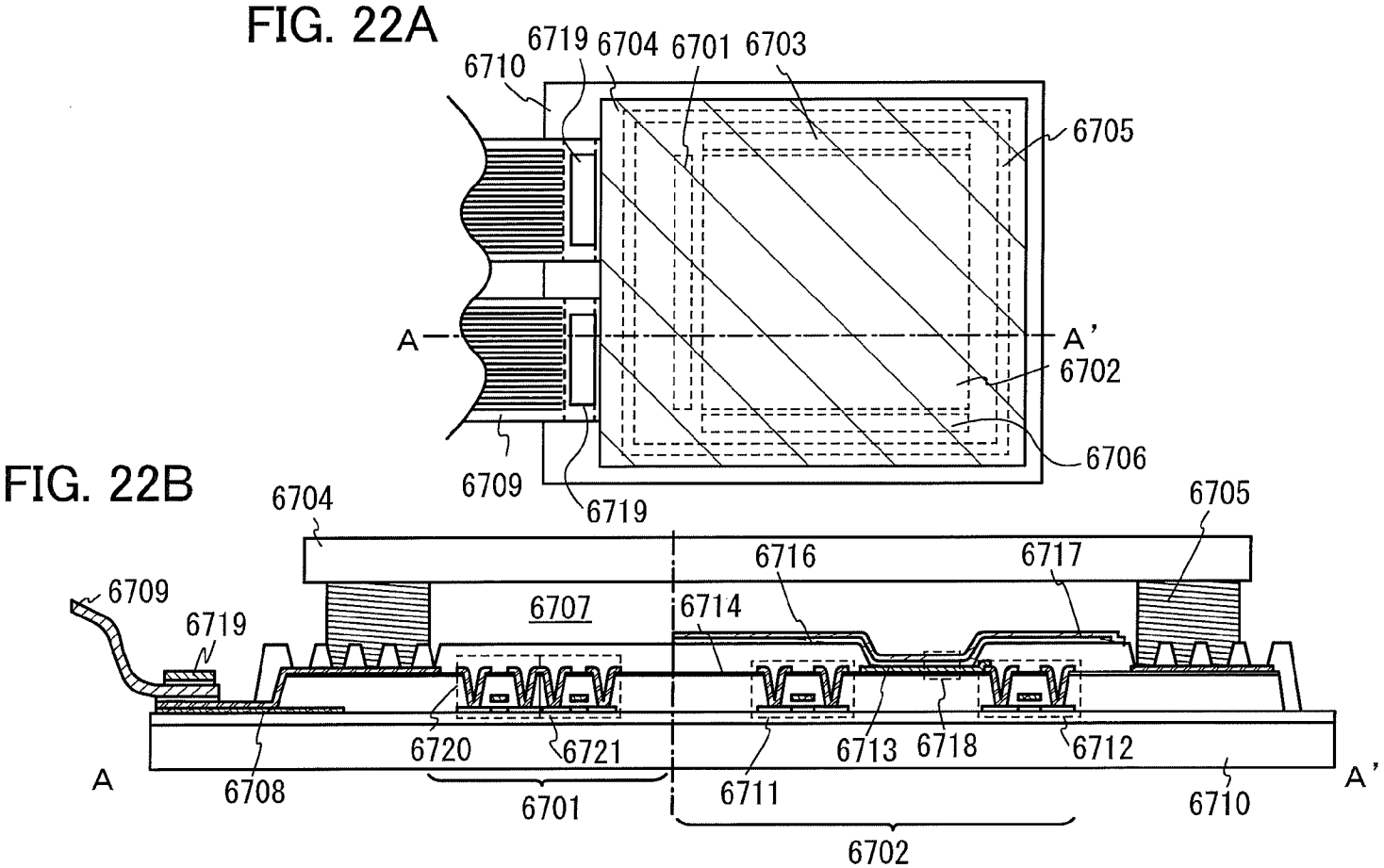
FIGS. 22A and 22B illustrate an example of a display panel of one embodiment of the present invention.

Note that FIG. 22A is a top plan view illustrating a display panel, and FIG. 22B is a cross-sectional view of FIG. 22A taken along A-A'. The display panel includes a signal line driver circuit 6701, a pixel portion 6702, a first scan line driver circuit 6703, and a second scan line driver circuit 6706, which are shown by dotted lines. In addition, a sealing substrate 6704 and a sealing material 6705 are provided. A portion surrounded by the sealing material 6705 is a space 6707.

Note that a wiring 6708 is a wiring for transmitting a signal input to the first scan line driver circuit 6703, the second scan line driver circuit 6706, and the signal line driver circuit 6701 and receives a video signal, a clock signal, a start signal, and the like from a flexible printed circuit (FPC) 6709 functioning as an external input terminal. An IC chip (a semiconductor chip including a memory circuit, a buffer circuit, and the like) 6719 is mounted over a connecting portion of the FPC 6709 and the display panel by chip on glass (COG) or the like. Although only the FPC 6709 is illustrated here, a printed wiring board (PWB) may be attached to the FPC 6709. The display device in this specification includes not only a main body of the display panel but one with an FPC or a PWB attached thereto. In addition, it also includes a display device on which an IC chip or the like is mounted.

Next, the cross-sectional structure is described with reference to FIG. 22B. The pixel portion 6702 and peripheral driver circuits (the first scan line driver circuit 6703, the second scan line driver circuit 6706, and the signal line driver circuit 6701) are formed over a substrate 6710. Here, the signal line driver circuit 6701 and the pixel portion 6702 are illustrated.

Note that the signal line driver circuit 6701 is formed of transistors having the same conductivity type, such as an n-channel transistor 6720 and an n-channel transistor 6721. A pixel can be formed using transistors having the same conductivity type with the use of any of the pixel configurations in FIG. 1 and FIGS. 8 to 12. Accordingly, the peripheral driver circuits are formed of n-channel transistors, whereby a display panel of a single conductivity type can be manufactured. It is needless to say that a CMOS circuit may be formed using a p-channel transistor as well as an n-channel transistor. Further, in this embodiment, a display panel in which the peripheral driver circuits are formed over one substrate is shown; however, the present invention is not limited thereto. All or some of the peripheral driver circuits may be formed into an IC chip or the like and mounted by COG or the like. In this case, the driver circuit does not need to be formed using transistors of a single conductivity type, and an n-channel transistor and a p-channel transistor can be used in combination.

Further, the pixel portion 6702 includes a transistor 6711 and a transistor 6712. Note that a source electrode of the transistor 6712 is connected to a first electrode (pixel electrode) 6713. An insulator 6714 is formed so as to cover end portions of the first electrode 6713. Here, the insulator 6714 is formed using a positive photosensitive acrylic resin film.

In order to obtain favorable coverage, the insulator 6714 is formed to have a curved surface having a curvature at a top end portion or a bottom end portion of the insulator 6714. For example, in the case of using a positive photosensitive acrylic as a material for the insulator 6714, it is preferable that only the top end portion of the insulator 6714 have a curved surface having a radius of curvature (0.2 μm to 3 μm). Alternatively, either a negative photosensitive resin or a positive photosensitive resin can be used as the insulator 6714.

A layer 6716 containing an organic compound and a second electrode (counter electrode) 6717 are formed over the first electrode 6713. Here, it is preferable to use a material having a high work function as a material for the first electrode 6713 which functions as an anode. For example, a single layer of an indium tin oxide film, an indium zinc oxide film, a titanium nitride film, a chromium film, a tungsten film, a Zn film, a Pt film, or the like, a stack of a titanium nitride film and a film containing aluminum as a main component, a three-layer structure of a titanium nitride film, a film containing aluminum as a main component, and a titanium nitride film, or the like can be used. When the layered structure is employed, low wiring resistance, favorable ohmic contact, and a function as an anode can be achieved.

The layer 6716 containing an organic compound is formed by an evaporation method using an evaporation mask, or an ink-jet method. A complex of a metal belonging to Group 4 of the periodic table of the elements is used for a part of the layer 6716 containing an organic compound. Besides, a low molecular material or a high molecular material may be used in combination as well. Further, as a material for the layer 6716 containing an organic compound, a single layer or a stacked layer of an organic compound is often used; however, in this embodiment, an inorganic compound may be used for a part of a film formed using an organic compound. Moreover, a known triplet material can also be used.

Further, as a material for the second electrode 6717 which functions as a cathode and is formed over the layer 6716 containing an organic compound, a material having a low work function (Al, Ag, Li, Ca, or an alloy thereof such as MgAg, MgIn, AlLi, $CaF_2$, or $Ca_3N_2$) may be used. In the case where light generated from the layer 6716 containing an organic compound passes through the second electrode 6717, a stack of a thin metal film with a small thickness and a transparent conductive film (of ITO (indium tin oxide), indium oxide-zinc oxide ($In_2O_3$—ZnO), zinc oxide (ZnO), or the like) is preferably used as the second electrode (cathode) 6717.

Further, by attaching the sealing substrate 6704 to the substrate 6710 with the sealing material 6705, a light-emitting element 6718 is provided in the space 6707 surrounded by the substrate 6710, the sealing substrate 6704, and the sealing material 6705. Note that the space 6707 may be filled with an inert gas (e.g., nitrogen, argon, or the like) or filled with the sealing material 6705.

Note that an epoxy-based resin is preferably used for the sealing material 6705. It is preferable to use a material that allows as little moisture or oxygen as possible to penetrate. As a material for the sealing substrate 6704, a glass substrate, a quartz substrate, a plastic substrate formed of fiberglass-reinforced plastics (FRP), polyvinylfluoride (PVF), polyester, acrylic, or the like can be used.

This embodiment is obtained by performing change, addition, modification, removal, application, superordinate conceptualization, or subordinate conceptualization on part or the whole of another embodiment. Thus, part of or the whole of this embodiment can be freely combined with or replaced with part of or the whole of another embodiment.

Embodiment 4

In this embodiment, an example of a semiconductor device including a driver circuit will be described.

An example of the structure of the semiconductor device of this embodiment will be described with reference to FIGS. 36A and 36B.

Figure 36A:
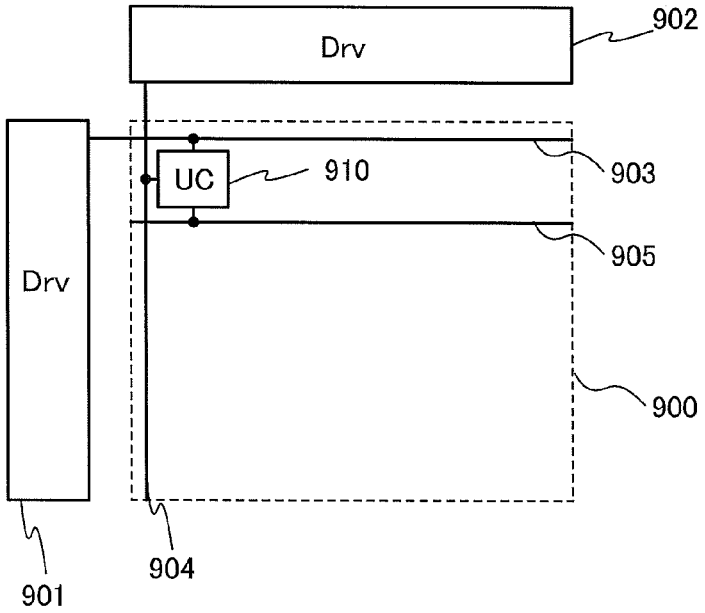
FIGS. 36A and 36B each illustrate an example of a semiconductor device.

The semiconductor device illustrated in FIG. 36A includes a driver circuit 901, a driver circuit 902, a wiring 903, a wiring 904, a wiring 905, and a unit circuit 910. Note that a plurality of unit circuits 910 may be provided. For example, a plurality of the pixel circuits in FIG. 1 or the like are provided as the unit circuits, whereby a display device can be formed.

The driver circuit 901 has a function of controlling the unit circuit 910 by inputting a potential or a signal to the unit circuit 910 through the wiring 903.

The driver circuit 901 is formed using a shift register, for example.

The driver circuit 902 has a function of controlling the unit circuit 910 by inputting a potential or a signal to the unit circuit 910 through the wiring 904.

The driver circuit 902 is formed using a shift register, for example.

Note that one of the driver circuits 901 and 902 may be provided over the same substrate as the unit circuit 910.

The wiring 905 can be a wiring for supplying a potential or a wiring for supplying a signal, for example. The wiring 905 is connected to the driver circuit 901 or another circuit. Note that the number of the wirings 905 may be two or more.

Figure 36B:
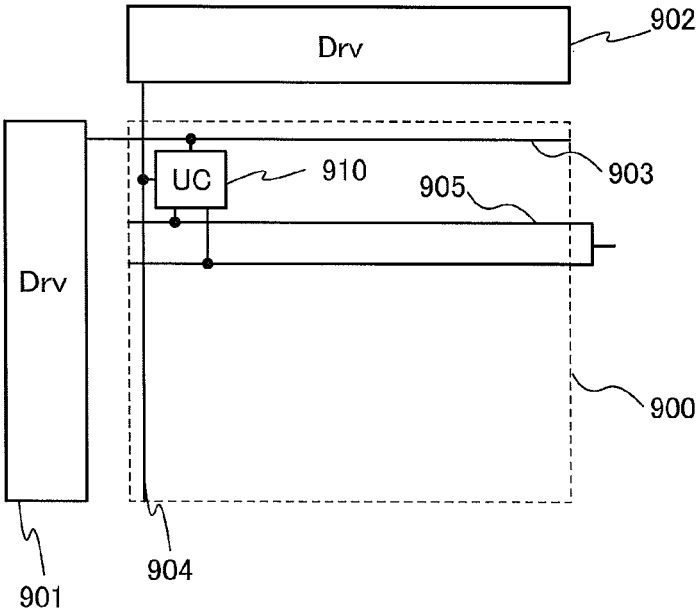

As illustrated in FIG. 36B, the wiring 905 may be a plurality of wirings which are connected to different elements in the unit circuit 910 and which are connected to each other outside a region 900 in which the unit circuit 910 is provided.

As described with reference to FIGS. 36A and 36B, in an example of the semiconductor device of this embodiment, a unit circuit and a driver circuit may be provided over the same substrate.

This embodiment is obtained by performing change, addition, modification, removal, application, superordinate conceptualization, or subordinate conceptualization on part or the whole of another embodiment. Thus, part of or the whole of this embodiment can be freely combined with, applied to, or replaced with part of or the whole of another embodiment.

Embodiment 5

In this embodiment, an example of a semiconductor device functioning as a display module will be described.

Figure 37:
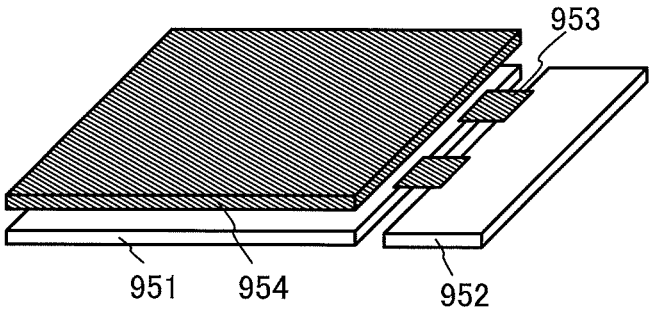
FIG. 37 illustrates an example of a display module.

An example of the structure of the semiconductor device of this embodiment will be described with reference to FIG. 37. FIG. 37 illustrates an example of the structure of the semiconductor device of this embodiment.

The semiconductor device illustrated in FIG. 37 includes a display panel 951, a circuit board 952 connected to the display panel 951 through a terminal 953, and a touch panel 954 overlapping with the display panel 951.

As the display panel 951, the semiconductor device of the above embodiment can be employed, for example.

The circuit board 952 is provided with a circuit having a function of controlling driving of the display panel 951 or the touch panel 954, or the like.

As the touch panel 954, a capacitive touch panel, a resistive touch panel, an optical touch panel, or the like can be used.

Instead of the touch panel 954, for example, a display module may be provided by provision of a radiator plate, an optical film, a polarizing plate, a retardation plate, a prism sheet, a diffusion plate, a backlight, and the like.

As illustrated in FIG. 37, the semiconductor device of this embodiment is formed using the semiconductor device described in the above embodiment and another component such as a touch panel.

Note that the touch panel and the display panel 951 may be formed over the same substrate. For example, in the case where a counter substrate is provided over a substrate where a transistor and a light-emitting element are formed, an electrode for the touch panel and the like may be formed over a surface of the counter substrate. The counter substrate has a function of sealing the light-emitting element in some cases and may also have a function of a touch panel. Alternatively, an element substrate may have a function of a touch panel.

This embodiment is obtained by performing change, addition, modification, removal, application, superordinate conceptualization, or subordinate conceptualization on part or the whole of another embodiment. Thus, part of or the whole of this embodiment can be freely combined with, applied to, or replaced with part of or the whole of another embodiment.

Embodiment 6

In this embodiment, examples of electronic devices and semiconductor devices will be described.

FIGS. 23A to 23H and FIGS. 24A to 24D illustrate electronic devices. These electronic devices can include a housing 5000, a display portion 5001, a speaker 5003, an LED lamp 5004, operation keys 5005 (including a power switch or an operation switch), a connection terminal 5006, a sensor 5007 (a sensor having a function of measuring force, displacement, position, speed, acceleration, angular velocity, rotational frequency, distance, light, liquid, magnetism, temperature, chemical substance, sound, time, hardness, electric field, current, voltage, electric power, radiation, flow rate, humidity, gradient, oscillation, odor, or infrared ray), a microphone 5008, and the like.

Figure 23A:
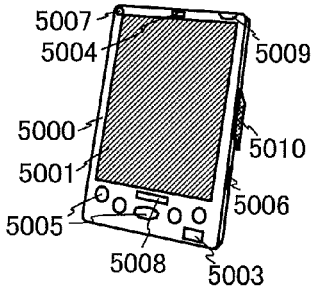
FIGS. 23A to 23H each illustrate an electronic device for which a display device of one embodiment of the present invention can be used.
Figure 23B:
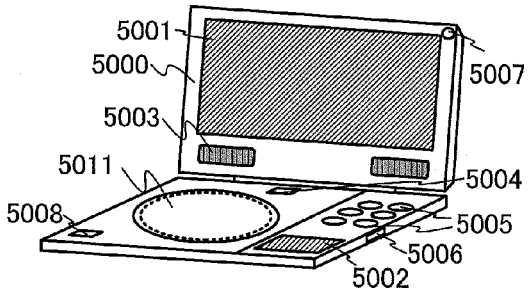
Figure 23C:
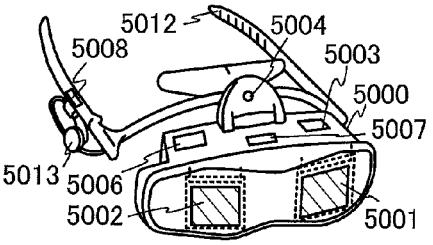
Figure 23D:
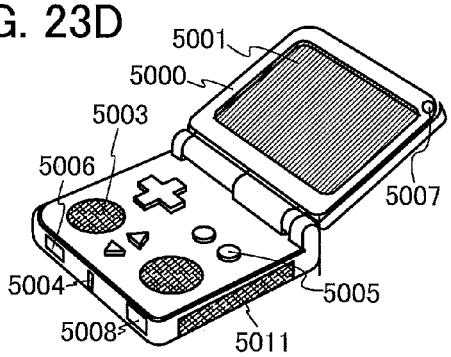
Figure 23E:
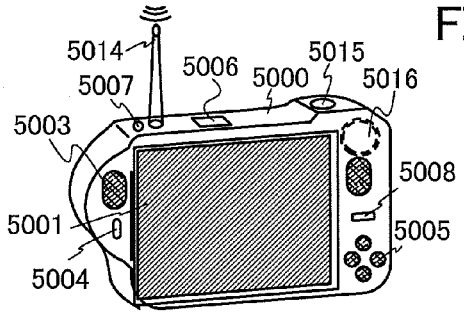
Figure 23F:
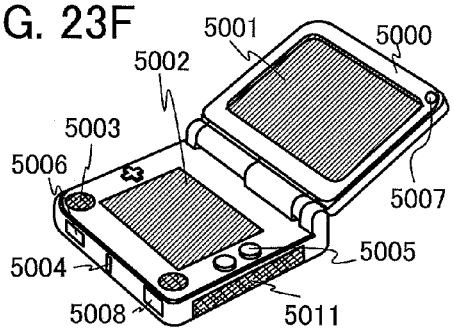
Figure 23G:
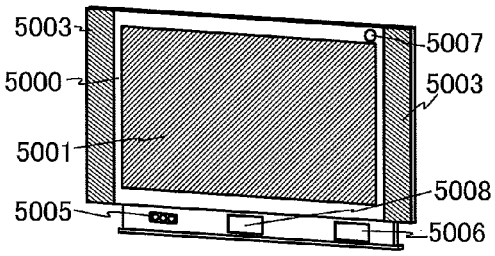
Figure 23H:
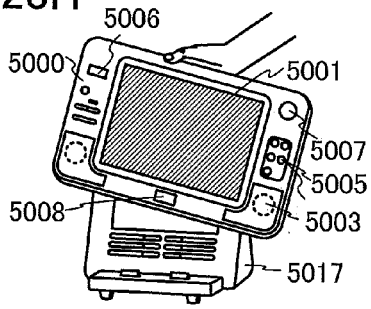
Figure 24A:
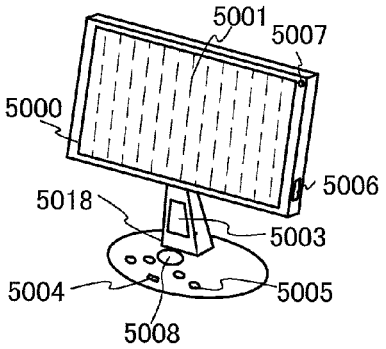
FIGS. 24A to 24H each illustrate an electronic device for which a display device of one embodiment of the present invention can be used.
Figure 24B:
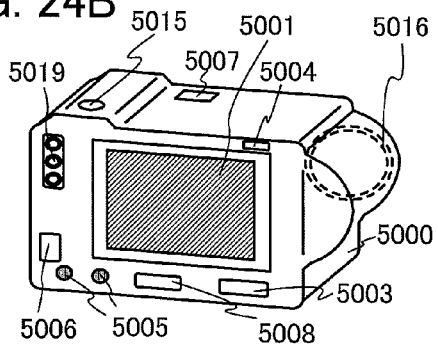
Figure 24C:
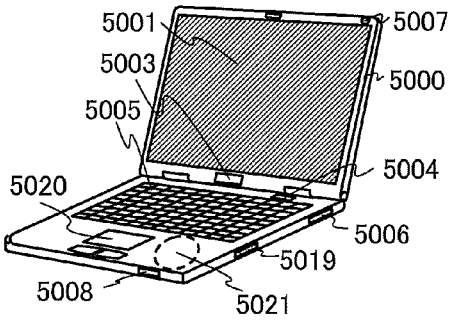
Figure 24D:
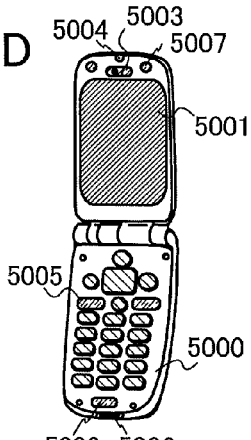

FIG. 23A illustrates a mobile computer which can include a switch 5009, an infrared port 5010, and the like in addition to the above components. FIG. 23B illustrates a portable image reproducing device (e.g., a DVD reproducing device) which is provided with a memory medium and can include a second display portion 5002, a memory medium reading portion 5011, and the like in addition to the above components. FIG. 23C illustrates a goggle-type display which can include the second display portion 5002, a supporting portion 5012, an earphone 5013, and the like in addition to the above components. FIG. 23D illustrates a portable game machine which can include the memory medium reading portion 5011 and the like in addition to the above components. FIG. 23E illustrates a digital camera which has a television reception function and can include an antenna 5014, a shutter button 5015, an image receiving portion 5016, and the like in addition to the above components. FIG. 23F illustrates a portable game machine which can include the second display portion 5002, the memory medium reading portion 5011, and the like in addition to the above components. FIG. 23G illustrates a television receiver which can include a tuner, an image processing portion, and the like in addition to the above components. FIG. 23H illustrates a portable television receiver which can include a charger 5017 capable of transmitting and receiving signals, and the like in addition to the above components. FIG. 24A illustrates a display which can include a support base 5018 and the like in addition to the above components. FIG. 24B illustrates a camera which can include an external connection port 5019, a shutter button 5015, an image reception portion 5016, and the like in addition to the above components. FIG. 24C illustrates a computer which can include a pointing device 5020, the external connection port 5019, a reader/writer 5021, and the like in addition to the above components. FIG. 24D illustrates a mobile phone which can include a transmitter, a receiver, a tuner of one-segment partial reception service for mobile phones and mobile terminals, and the like in addition to the above components.

The electronic devices illustrated in FIGS. 23A to 23H and FIGS. 24A to 24D can have a variety of functions. For example, a function of displaying a variety of data (a still image, a moving image, a text image, and the like) on a display portion, a touch panel function, a function of displaying a calendar, date, time, and the like, a function of controlling a process with a variety of software (programs), a wireless communication function, a function of being connected to a variety of computer networks with a wireless communication function, a function of transmitting and receiving a variety of data with a wireless communication function, a function of reading a program or data stored in a memory medium and displaying the program or data on a display portion, and the like can be given. Further, the electronic device including a plurality of display portions can have a function of displaying image data mainly on one display portion while displaying text data on another display portion, a function of displaying a three-dimensional image by displaying images where parallax is considered on a plurality of display portions, or the like. Furthermore, the electronic device including an image receiving portion can have a function of shooting a still image, a function of taking a moving image, a function of automatically or manually correcting a shot image, a function of storing a shot image in a memory medium (an external memory medium or a memory medium incorporated in the camera), a function of displaying a shot image on the display portion, or the like. Note that functions that can be provided for the electronic devices illustrated in FIGS. 23A to 23H and FIGS. 24A to 24D are not limited thereto, and the electronic devices can have a variety of functions.

The electronic devices described in this embodiment each include the display portion for displaying some sort of data.

Next, applications of a semiconductor device will be described.

Figure 24E:
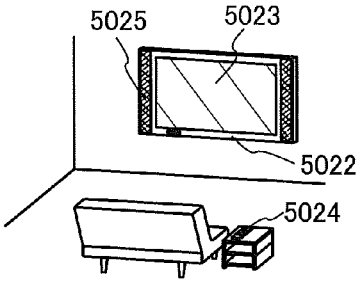

FIG. 24E illustrates an example in which a semiconductor device is incorporated in a building. FIG. 24E illustrates a housing 5022, a display portion 5023, a remote controller 5024, which is an operation portion, a speaker 5025, and the like. The semiconductor device is incorporated in the building as a wall-hanging type, so that the semiconductor device can be provided without requiring a wide space.

Figure 24F:
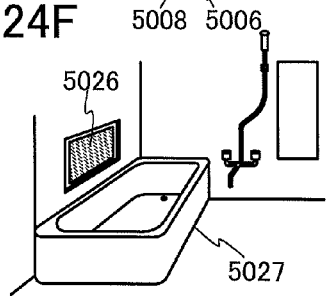

FIG. 24F illustrates another example in which a semiconductor device is incorporated in a building. The display panel 5026 is incorporated in a prefabricated bath 5027 so that a bather can watch the display panel 5026.

Note that although the wall and the prefabricated bath are taken as examples of the building in this embodiment, one embodiment of the present invention is not limited thereto and a semiconductor device can be provided in any of a variety of buildings.

Next, an example in which a semiconductor device is incorporated in a moving object will be described.

Figure 24G:
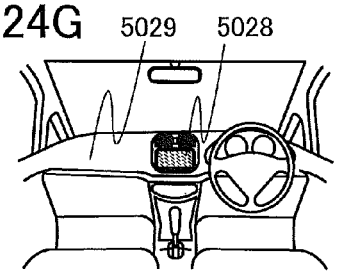

FIG. 24G illustrates an example in which a semiconductor device is provided in a vehicle. A display panel 5028 is provided in a body 5029 of a vehicle and can display data on the operation of the body or data input from inside or outside of the body on demand. Note that a navigation function may be provided.

Figure 24H:
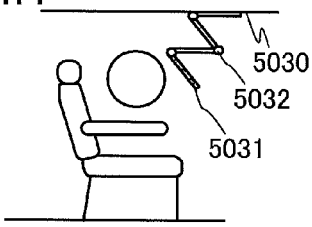

FIG. 24H illustrates an example in which a semiconductor device is incorporated in a passenger airplane. FIG. 24H illustrates a usage pattern when a display panel 5031 is provided for a ceiling 5030 above a seat of the passenger airplane. The display panel 5031 is attached to the ceiling 5030 with a hinge portion 5032, and a passenger can watch the display panel 5031 by stretching the hinge portion 5032. The display panel 5031 has a function of displaying data when operated by a passenger.

Note that although the body of the vehicle and the body of the airplane are taken as examples of the moving object, one embodiment of the present invention is not limited thereto. A semiconductor device can be provided for a variety of moving objects such as a two-wheel vehicle, a four-wheel vehicle (including an automobile and a bus), a train (including a monorail train and a railway train), and a ship.

Note that in this specification and the like, part of a diagram or a text described in one embodiment can be taken out to constitute one embodiment of the invention. Thus, in the case where a diagram or a text related to a certain part is described, a content taken out from the diagram or the text of the certain part is also disclosed as one embodiment of the invention and can constitute one embodiment of the invention. Therefore, for example, part of a diagram or a text including one or more of active elements (e.g., transistors and diodes), wirings, passive elements (e.g., capacitors and resistors), conductive layers, insulating layers, semiconductor layers, organic materials, inorganic materials, components, devices, operating methods, manufacturing methods, and the like can be taken out to constitute one embodiment of the invention. For example, M circuit elements (e.g., transistors or capacitors) (M is an integer) are picked up from a circuit diagram in which N circuit elements (e.g., transistors or capacitors) (N is an integer, where M<N) are provided, whereby one embodiment of the invention can be constituted. As another example, M layers (M is an integer) are picked up from a cross-sectional view in which N layers (N is an integer, where M<N) are provided, whereby one embodiment of the invention can be constituted. As another example, M elements (M is an integer) are picked up from a flow chart in which N elements (N is an integer, where M<N) are provided, whereby one embodiment of the invention can be constituted.

Note that, in the case where at least one specific example is illustrated in a diagram or a text described in one embodiment in this specification and the like, it will be readily appreciated by those skilled in the art that a broader concept of the specific example can be derived. Therefore, in the case where at least one specific example is illustrated in the diagram or the text described in one embodiment, a broader concept of the specific example is disclosed as one embodiment of the invention and can constitute one embodiment of the invention.

Note that, in this specification and the like, a content illustrated in at least a diagram (which may be part of the diagram) is disclosed as one embodiment of the invention and can constitute one embodiment of the invention. Therefore, when a certain content is illustrated in a diagram, the content is disclosed as one embodiment of the invention even without text description and can constitute one embodiment of the invention. Similarly, a diagram obtained by taking out part of a diagram is disclosed as one embodiment of the invention and can constitute one embodiment of the invention.

This application is based on Japanese Patent Application serial no. 2012-126376 filed with the Japan Patent Office on Jun. 1, 2012, the entire contents of which are hereby incorporated by reference.

What is claimed is:

1. A semiconductor device comprising:

a first switch;

a second switch;

a third switch;

a fourth switch;

a fifth switch;

a sixth switch;

a first capacitor;

a second capacitor;

a transistor; and a load, wherein one terminal of the first switch is electrically connected to a first wiring, wherein the other terminal of the first switch is directly connected to one terminal of the second switch, one terminal of the second capacitor, and a gate of the transistor, wherein the other terminal of the second switch is directly connected to one terminal of the third switch and one terminal of the first capacitor, wherein the other terminal of the third switch is directly connected to the other terminal of the second capacitor and one terminal of the fourth switch, wherein the other terminal of the fourth switch is directly connected to one of a source and a drain of the transistor and one terminal of the fifth switch, wherein the other terminal of the fifth switch is directly connected to the other terminal of the first capacitor and one terminal of the sixth switch, wherein the other terminal of the sixth switch is electrically connected to a fourth wiring, wherein a first terminal of the load is electrically connected to the one terminal or the other terminal of the fifth switch, wherein a second terminal of the load is electrically connected to a third wiring, and wherein the other of the source and the drain of the transistor is electrically connected to a second wiring.

2. The semiconductor device according to claim 1, further comprising a seventh switch, wherein one terminal of the seventh switch is electrically connected to the one terminal of the second capacitor, and wherein the other terminal of the seventh switch is electrically connected to the other of the source and the drain of the transistor.

3. The semiconductor device according to claim 1, wherein the third wiring and the fourth wiring are electrically connected to each other and are at the same potential.

4. The semiconductor device according to claim 1, wherein the first wiring is supplied with a video signal, wherein the second wiring is supplied with a first power supply voltage, wherein the third wiring is supplied with a cathode voltage, and wherein the fourth wiring is supplied with a second power supply voltage.

5. The semiconductor device according to claim 1, wherein the transistor is an n-channel transistor.

6. The semiconductor device according to claim 1, wherein the transistor includes an oxide semiconductor.

7. The semiconductor device according to claim 1, wherein the first to sixth switches are transistors.

8. A display device comprising the semiconductor device according to claim 1, wherein the load includes a light-emitting element.

9. A display module comprising the semiconductor device according to claim 1 and a touch panel or an FPC.

10. An electronic device comprising the semiconductor device according to claim 1 and a control switch, an antenna, or a sensor.

11. A method for driving a semiconductor device, the semiconductor device comprising:

a first switch, a second switch, a third switch, a fourth switch, a fifth switch, and a sixth switch;

a first capacitor and a second capacitor;

a transistor; and a load, wherein one terminal of the first switch is electrically connected to a first wiring, wherein the other terminal of the first switch is directly connected to one terminal of the second switch, one terminal of the second capacitor, and a gate of the transistor, wherein the other terminal of the second switch is directly connected to one terminal of the third switch and one terminal of the first capacitor, wherein the other terminal of the third switch is directly connected to the other terminal of the second capacitor and one terminal of the fourth switch, wherein the other terminal of the fourth switch is directly connected to one of a source and a drain of the transistor and one terminal of the fifth switch, wherein the other terminal of the fifth switch is directly connected to the other terminal of the first capacitor, a first terminal of the load, and one terminal of the sixth switch, wherein the other terminal of the sixth switch is connected to a fourth wiring, wherein a second terminal of the load is electrically connected to a third wiring, wherein the other of the source and the drain of the transistor is electrically connected to a second wiring, the method for driving the semiconductor device comprising:

a first period, a second period, a third period, a fourth period, and a fifth period, wherein the first period, the second period, the third period, the fourth period, and the fifth period are sequential with each other, wherein, in the first period, the first switch is on, the second switch is turned on, the third switch is turned off, the fourth switch is turned on, the fifth switch is turned on, the sixth switch is turned on, so that the transistor is turned on and a first voltage is applied to the first capacitor and the second capacitor, wherein, in the second period, the fifth switch is turned off so that the transistor is turned off and a second voltage is applied to the second capacitor, wherein, in the third period, the first switch is turned off and the second switch is turned off so that the first capacitor holds the first voltage and the second capacitor holds the second voltage, wherein, in the fourth period, the third switch is turned on and the fourth switch is turned off so that a sum of the first voltage of the first capacitor and the second voltage of the second capacitor is applied to the gate of the transistor, and wherein, in the fifth period, the fifth switch is turned on and the sixth switch is turned off so that the transistor is turned on, a current flows through the load, and a sum of the first voltage, the second voltage, and a voltage applied to the load is applied to the gate of the transistor.

12. The method for driving a semiconductor device according to claim 11, wherein the first wiring is supplied with a first potential, wherein the fourth wiring is supplied with a second potential, and wherein the first voltage is a difference between the first potential and the second potential.

13. The method for driving a semiconductor device according to claim 11, wherein the second voltage is a threshold voltage of the transistor.

14. The method for driving a semiconductor device according to claim 11, wherein the load includes a light-emitting element.

* * * * *